US012104390B2

(12) United States Patent
LaTray

(10) Patent No.: US 12,104,390 B2
(45) Date of Patent: Oct. 1, 2024

(54) MOLDING COMPONENTS, INCLUDING PLINTHS AND CORNER PIECES, KITS, AND SYSTEMS COMPRISING THE SAME, METHODS OF MAKING THEM AND METHODS OF ASSEMBLING THEM

(71) Applicant: Kyle LaTray, Oswego, NY (US)

(72) Inventor: Kyle LaTray, Oswego, NY (US)

( * ) Notice: Subject to any disclaimer, the term of this patent is extended or adjusted under 35 U.S.C. 154(b) by 319 days.

(21) Appl. No.: 17/645,788

(22) Filed: Dec. 23, 2021

(65) Prior Publication Data

US 2022/0205255 A1 Jun. 30, 2022

Related U.S. Application Data

(60) Provisional application No. 63/130,509, filed on Dec. 24, 2020.

(51) Int. Cl.
*E04F 19/04* (2006.01)

(52) U.S. Cl.
CPC ..... *E04F 19/0463* (2013.01); *E04F 19/0486* (2013.01)

(58) Field of Classification Search
CPC ..... E06B 2001/622; E06B 1/04; E06B 1/34; E06B 1/56; E06B 1/60; E04F 19/0459; E04F 19/0463; E04F 19/0468; E04F 19/0472; E04F 19/0481; E04F 19/0486; E04F 19/049; E04F 19/0495
USPC ..... 52/211, 212
See application file for complete search history.

(56) References Cited

U.S. PATENT DOCUMENTS

| | | | | |
|---|---|---|---|---|
| 493,404 | A | 3/1893 | House | |
| 3,778,945 | A | 12/1973 | Medow | |
| 5,794,399 | A | 8/1998 | Searer | |
| 6,047,507 | A | 4/2000 | Lappin et al. | |
| 6,155,011 | A * | 12/2000 | Robertson | E06B 1/705 52/212 |
| 6,212,835 | B1 | 4/2001 | Schiedegger et al. | |
| 6,381,915 | B1 | 5/2002 | Wood | |
| 6,807,783 | B2 * | 10/2004 | Lee | E06B 1/34 52/211 |
| 7,036,283 | B2 | 5/2006 | Halas | |
| 7,210,272 | B2 * | 5/2007 | Friday | E04F 19/0436 52/211 |
| 7,614,190 | B2 | 11/2009 | Cooper | |
| 7,743,564 | B2 | 6/2010 | Schiedegger et al. | |
| 2003/0101667 | A1 | 6/2003 | Yoder | |
| 2005/0198914 | A1 | 9/2005 | Lyons et al. | |
| 2009/0064609 | A1 | 3/2009 | Ouyang et al. | |
| 2009/0282775 | A1 | 11/2009 | Vaes | |

* cited by examiner

*Primary Examiner* — William V Gilbert
(74) *Attorney, Agent, or Firm* — Brown & Brown IP Law PLLC

(57) ABSTRACT

The present invention provides molding components, including plinths and corner pieces. Also, kits comprising combinations of molding components selected from among plinths, molding pieces, corner pieces and header pieces. Also, systems comprising combinations of molding components selected from among plinths, molding pieces, corner pieces and header pieces. Also, methods of making plinths, corner pieces, kits, systems and other combinations of components, and methods of assembling systems comprising combinations of components.

21 Claims, 17 Drawing Sheets

MOLDING COMPONENTS, INCLUDING PLINTHS AND CORNER PIECES, KITS, AND SYSTEMS COMPRISING THE SAME, METHODS OF MAKING THEM AND METHODS OF ASSEMBLING THEM

CROSS-REFERENCE TO RELATED APPLICATIONS

This application claims the benefit under 35 U.S.C. 119 section (e) of U.S. Provisional Patent Application No. 63/130,509, filed Dec. 24, 2020, the entirety of which is incorporated herein by reference.

This application claims priority of U.S. Provisional Patent Application No. 63/130,509, filed Dec. 24, 2020, the entirety of which is incorporated herein by reference.

FIELD OF THE INVENTION

The present invention is directed to components that can be used as molding around doors, windows, or other structures. The present invention is also directed to kits that comprise one or more of such components, systems that comprise one or more of such components, methods of making any of the components, kits and systems, and methods of installing any of the components and systems.

BACKGROUND

Various forms of trim for use around doors and windows and other structures have been provided. Such forms of trim can be used to extend around any desired portions of structures (e.g., doors and windows), e.g., around the left side of a door, the top of the door and the right side of the door, or around the left side of a window, the top or the window, the right side of the window (and optionally the bottom of the window), around any desired sides of a skylight, around any desired sides of a wall, around any desired sides of a decorative region, etc.

Such forms of trim include, for example, plinths, molding, rosettes, and headers. Typically such pieces of trim are installed by inserting one or more connectors (e.g., nails using a nail gun, or screws using an impact drill) through any one of the trim pieces to be installed (a first trim piece), then positioning another trim piece (a second trim piece) adjacent to the first trim piece with respective surfaces of the first trim piece and the second trim piece abutting each other, and then inserting one or more connectors through the second trim piece, and then similarly installing any other desired trim pieces.

BRIEF SUMMARY OF THE INVENTIVE SUBJECT MATTER

This section (i.e., "Brief Summary of the Inventive Subject Matter") presents a simplified summary of the invention in order to provide a basic understanding of some aspects of the invention. This summary is not an extensive overview of the invention. It is not intended to identify key/critical elements of the invention or to delineate the scope of the invention. Its purpose is to present some concepts of the invention in a simplified form as a prelude to the more detailed description that is presented later.

As noted above, the present invention is directed to components that can be used as molding around doors, windows, or other structures. The present invention is also directed to kits that comprise one or more of such components, systems that comprise one or more of such components, doors and windows on which systems that include components according to the present invention have been installed, buildings on which systems that include components according to the present invention have been installed, methods of making any of the components, kits and systems, and methods of installing any of the components and systems.

The present invention provides ways to simplify installing trim components, to facilitate more accurate installation of trim components, and to eliminate the need to insert connector elements that extend through portions of trim components that, upon being installed, are exposed.

Trim components can be installed indoors or outdoors (or hybrids of indoors and outdoors). With trim components that are installed outdoors, it can be extremely important (e.g., for avoiding the need for repairs over time and/or for increasing the length of time before which repairs are necessary) to minimize potential channels through which water can travel through trim components and/or between trim components, and/or around trim components. The present invention also provides ways to minimize potential channels through which water can travel through trim components, between trim components and/or around trim components.

In accordance with some aspects of the present invention, there are provided trim components that have substantially flat surfaces (referred to herein as "raised surfaces") that can be positioned on a planar surface (e.g., a planar surface that extends around a perimeter of a door, a window or any other structure), and that have regions recessed from the raised (substantially flat) surfaces that have topography that is slidably complementary to topography of one or more other trim elements (e.g., molding pieces or header pieces). For example, in some embodiments, a first trim component (e.g., a plinth or a corner piece) according to the present invention can be positioned vertically or horizontally (e.g., nailed to a flat vertical surface of a house) with its raised surfaces in contact with and parallel to an installation surface (e.g., a front face of the house), and a second trim component (e.g., a molding piece or a header piece) having a back surface and a contoured front surface can be positioned, with its back surface in contact with the installation surface, in any of a range of positions (e.g., the range of positions extending vertically or horizontally for a distance up to nearly as long as the vertical or horizontal distance of the first trim component, e.g., 80 percent as long, or 90 percent as long, or 95 percent as long) relative to the second trim component, the expression "slidably complementary" meaning that in any of the range of positions, the first trim element fits snugly to the second trim element, such that there is very little space at any location along the exposed interface between the first and second trim components. As a result, the first and second trim components (and optionally other components with analogous slidably complementary relationships) can be installed without having to make any cuts in either trim component (i.e., even though the sum of the lengths of the first and second trim components may be somewhat larger than the allotted space), or by making a cut in the second trim component, the cut, upon installation of the trim components, not being exposed. As a result, the end of the second trim component, or any cut in the second trim component, is not visible or exposed, thereby avoiding the possibility (or likelihood) of a somewhat imprecise fit, and/or cut, being visible and exposed to weather, etc. In addition, the slidably complementary relationship provides for more precise positioning of the components relative to one another (e.g., ensuring very close to a right angle).

In accordance with some aspects of the present invention, there are provided corner pieces that comprise corner piece structures and corner piece cover pieces, wherein the corner piece cover piece can be removably engaged to the corner piece structure. In some embodiments, the profile of the perimeter of the corner piece cover piece is substantially complementary to the profile of the surface of the corner piece structure that is adjacent to the perimeter of the corner piece cover piece (i.e., the corner piece cover piece fits snugly to the corner piece structure around the entire perimeter of the corner piece cover piece). With such components, the corner piece structure can be firmly pressed relative to a surface (e.g., a wall), the corner piece structure can then be attached to the surface, and the corner piece structure provides an exposed surface to which a corner piece cover piece can be removably engaged (and such that the corner piece cover piece covers the element, e.g., one or more nails or screws, by which the corner piece structure was attached to the surface).

In some of such aspects of the invention, the corner piece cover piece and the corner piece structure are removably engaged with each other by one or more protrusions that fit into one or more respective recesses, e.g., tightly fit or snap-fit. For example, in some embodiments, the corner piece cover piece has one or more protrusions that fit into one or more respective recesses in the corner piece structure; in some embodiments, the corner piece structure has one or more protrusions that fit into one or more respective recesses in the corner piece cover piece; in some embodiments, the corner piece cover piece has one or more protrusions that fit into one or more respective recesses in the corner piece structure, and the corner piece structure has one or more protrusions that fit into one or more respective recesses in the corner piece cover piece.

In some of such aspects of the invention, the corner piece cover piece and the cover piece structure are removably engaged magnetically. For example, in some embodiments, the corner piece cover piece has one or more cover piece magnets and the corner piece structure has one or more metal structures that are attracted to the cover piece magnets (upon the corner piece cover piece being properly aligned with the corner piece structure), and/or the corner piece structure has one or more corner piece magnets and the corner piece cover piece has one or more metal structures that are attracted to the corner piece structure magnets (upon the corner piece cover piece being properly aligned with the corner piece structure), and some embodiments are similar except that one or more metal structures are instead magnets (i.e., corner piece magnets engage corner piece cover piece magnets).

In some of such aspects of the invention, the corner piece cover piece and the corner piece structure are removably engaged by one or more protrusions that fit into one or more respective recesses (as discussed above), and are removably engaged magnetically (as discussed above).

In aspects of the invention that comprise a corner piece structure and a corner piece cover piece, for example, the corner piece structure can be installed (e.g., screwed or nailed to an installation surface), and then the corner piece cover piece can be engaged to the corner piece structure, such that the exposed surface of the corner piece cover piece does not have any holes or damage (e.g., nail holes through which water or other fluids might penetrate, or damage resulting from driving nails through it), and no connector elements are visible. In addition, if there is a desire to change the appearance of a corner piece (e.g., a rosette or a corner block), an existing corner piece cover piece can be disengaged from the corner piece structure (with a very small force, e.g., less than 5 Newtons) pulling the corner piece cover piece from the corner piece structure, and a new corner piece cover piece (with a different outer appearance) can be pressed into place on the cover piece structure.

Similarly, in accordance with some aspects of the present invention, there are provided plinths that comprise plinth structures and plinth cover pieces, wherein the plinth cover piece can be removably engaged to the plinth structure, to provide benefits analogous to those described above in relation to the corner pieces. In some embodiments, the profile of the perimeter of the plinth cover piece is substantially complementary to the profile of the surface of the plinth structure that is adjacent to the perimeter of the plinth cover piece (i.e., the plinth cover piece fits snugly to the plinth structure around the entire perimeter of the plinth cover piece). With such components, the plinth structure can be firmly pressed relative to a surface (e.g., a wall), the plinth structure can then be attached to the surface, and the plinth structure provides an exposed surface to which a plinth cover piece can be removably engaged (and such that the plinth cover piece covers the element, e.g., one or more nails or screws, by which the plinth structure was attached to the surface).

In accordance with some aspects of the present invention, there are provided corner pieces that comprise corner piece structures and corner piece cover pieces, wherein the corner piece cover piece and the corner piece structure are indexable relative to each other, by one or more protrusions that fit into one or more recesses. For example, in some embodiments, the corner piece cover piece has one or more indexing protrusions that fit into one or more respective indexing recesses in the corner piece structure; in some embodiments, the corner piece structure has one or more indexing protrusions that fit into one or more respective indexing recesses in the corner piece cover piece; in some embodiments, the corner piece cover piece has one or more indexing protrusions that fit into one or more respective indexing recesses in the corner piece structure, and the corner piece structure has one or more indexing protrusions that fit into one or more respective indexing recesses in the corner piece cover piece.

Any protrusion/recess combination that provides engagement can also provide (or assist in providing) indexing (and vice-versa, i.e., any protrusion/recess combination that provides indexing can also provide engaging).

In accordance with some aspects of the present invention, there are provided corner pieces that comprise corner piece structures and corner piece cover pieces, wherein the corner piece cover piece can be removably engaged to the corner piece structure, and wherein the corner piece cover piece and the corner piece structure comprise respective features that provide (or assist in providing) indexing.

Similarly, in accordance with some aspects of the present invention, there are provided plinths that comprise plinth structures and plinth cover pieces, wherein [1] the plinth cover piece can be removably engaged to the plinth structure, and/or [2] the plinth cover piece and/or the plinth structure comprise respective features (e.g., protrusion/recess features as described with regard to corner pieces) that provide indexing, to provide benefits analogous to those described above in relation to the corner pieces.

The inventive subject matter may be more fully understood with reference to the accompanying drawings and the following detailed description of the inventive subject matter.

BRIEF DESCRIPTION OF THE DRAWING FIGURES

FIG. 1 schematically depicts a front view of a portion of a front side of a house, showing an entry door and a system of components installed as trim for the entry door.

FIG. 2 schematically depicts an exploded side view of a plinth 11.

FIG. 3 schematically depicts a front view of a plinth structure 18.

FIG. 4 schematically depicts a rear view of the plinth structure 18.

FIG. 5 schematically depicts a front view of a plinth cover piece 19.

Figure 10:
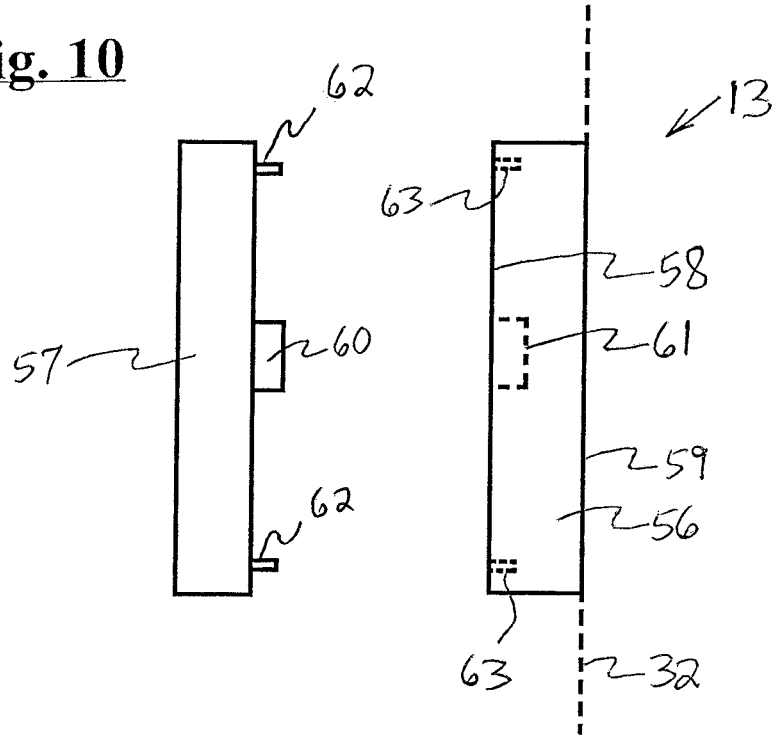

FIG. 10 schematically depicts an exploded side view of a first corner piece 13.

Figure 11:
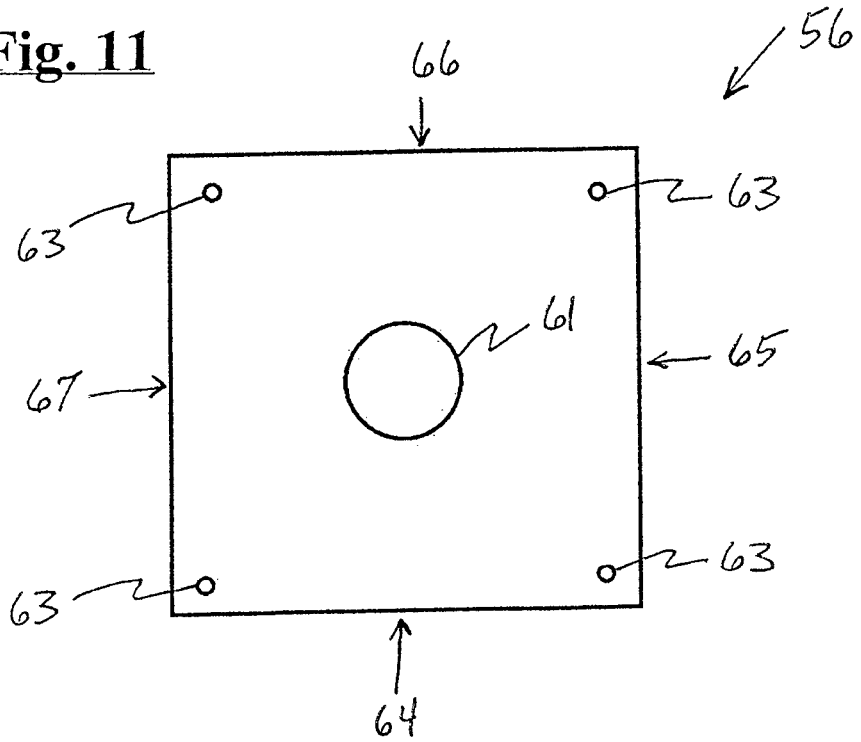

FIG. 11 schematically depicts a front view of a corner piece structure 56.

Figure 12:
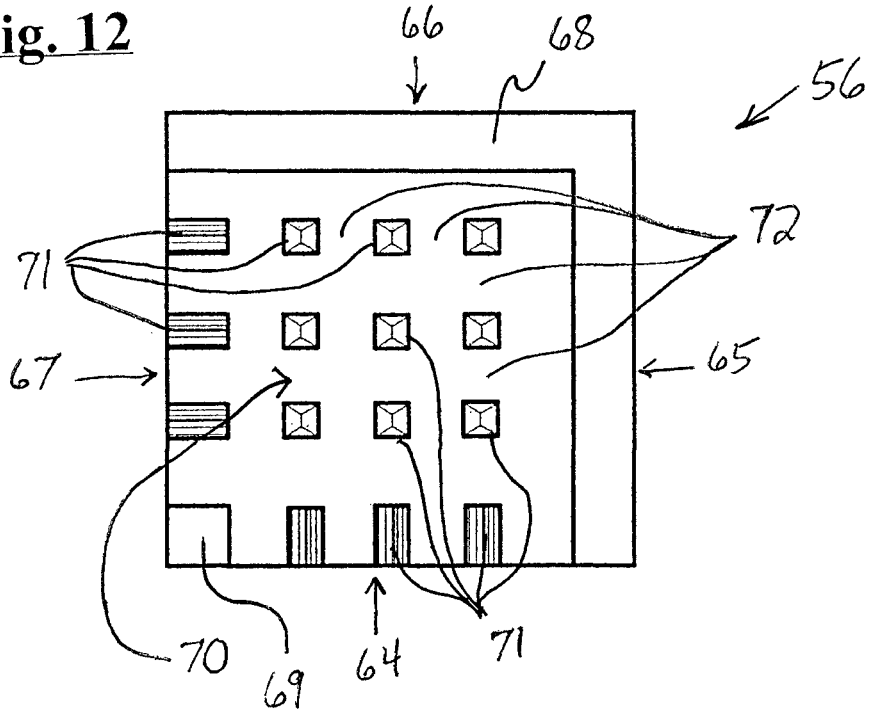

FIG. 12 schematically depicts a rear view of the corner piece structure 56.

Figure 13:
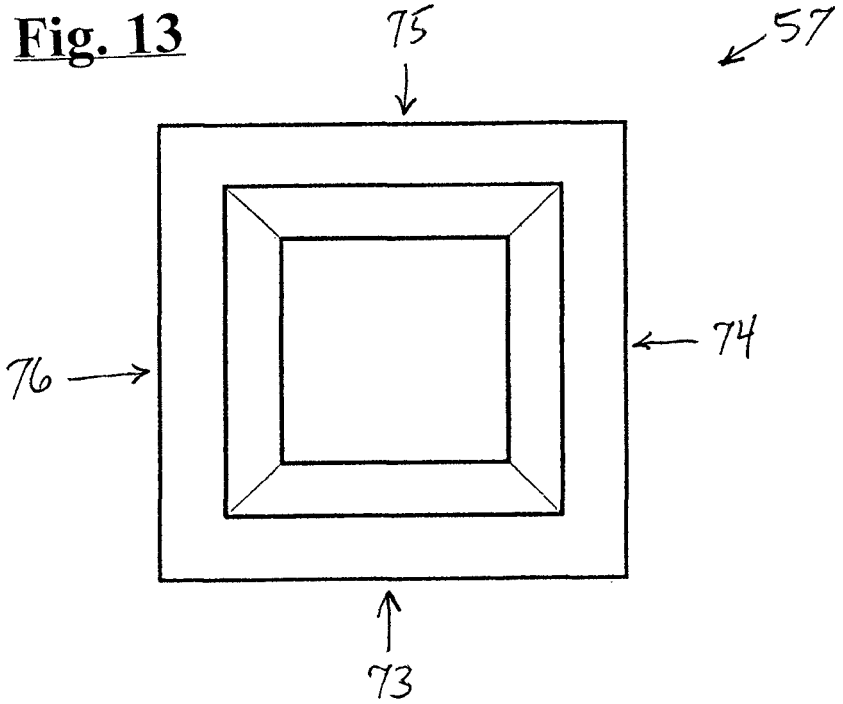

FIG. 13 schematically depicts a front view of a corner piece cover piece 57.

Figure 14:
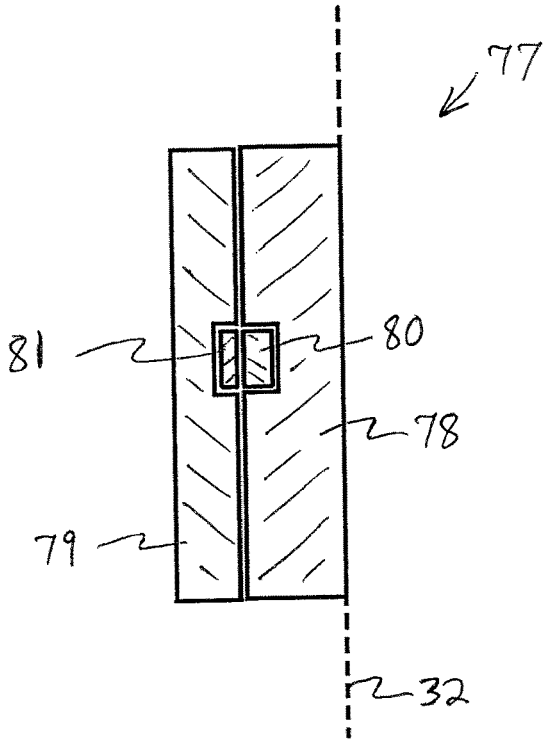

FIG. 14 is a schematic sectional view of an alternative embodiment of a corner piece 77.

Figure 15:
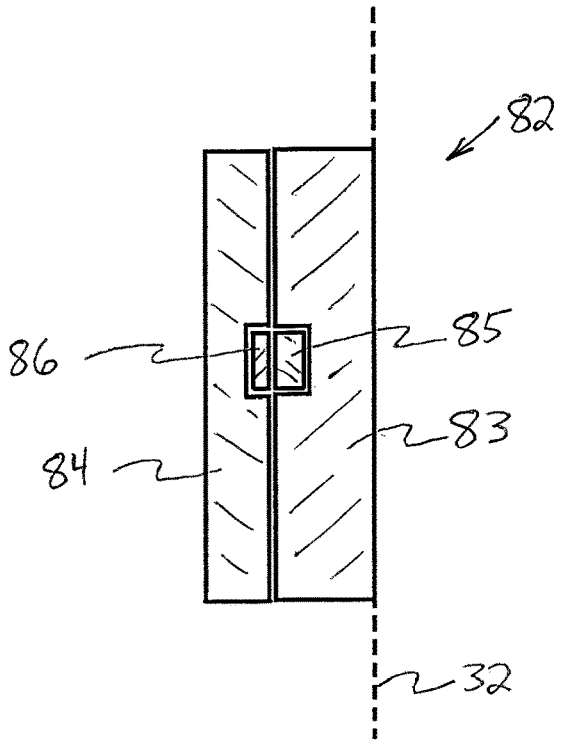

FIG. 15 is a schematic sectional view of an alternative embodiment of a corner piece 82.

Figure 16:
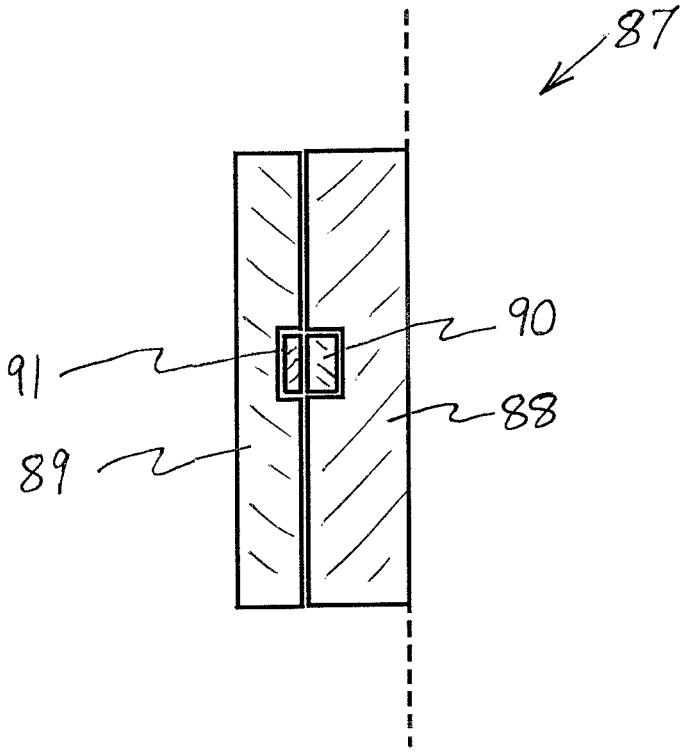

FIG. 16 is a schematic sectional view of an alternative embodiment of a corner piece 87.

Figure 1:
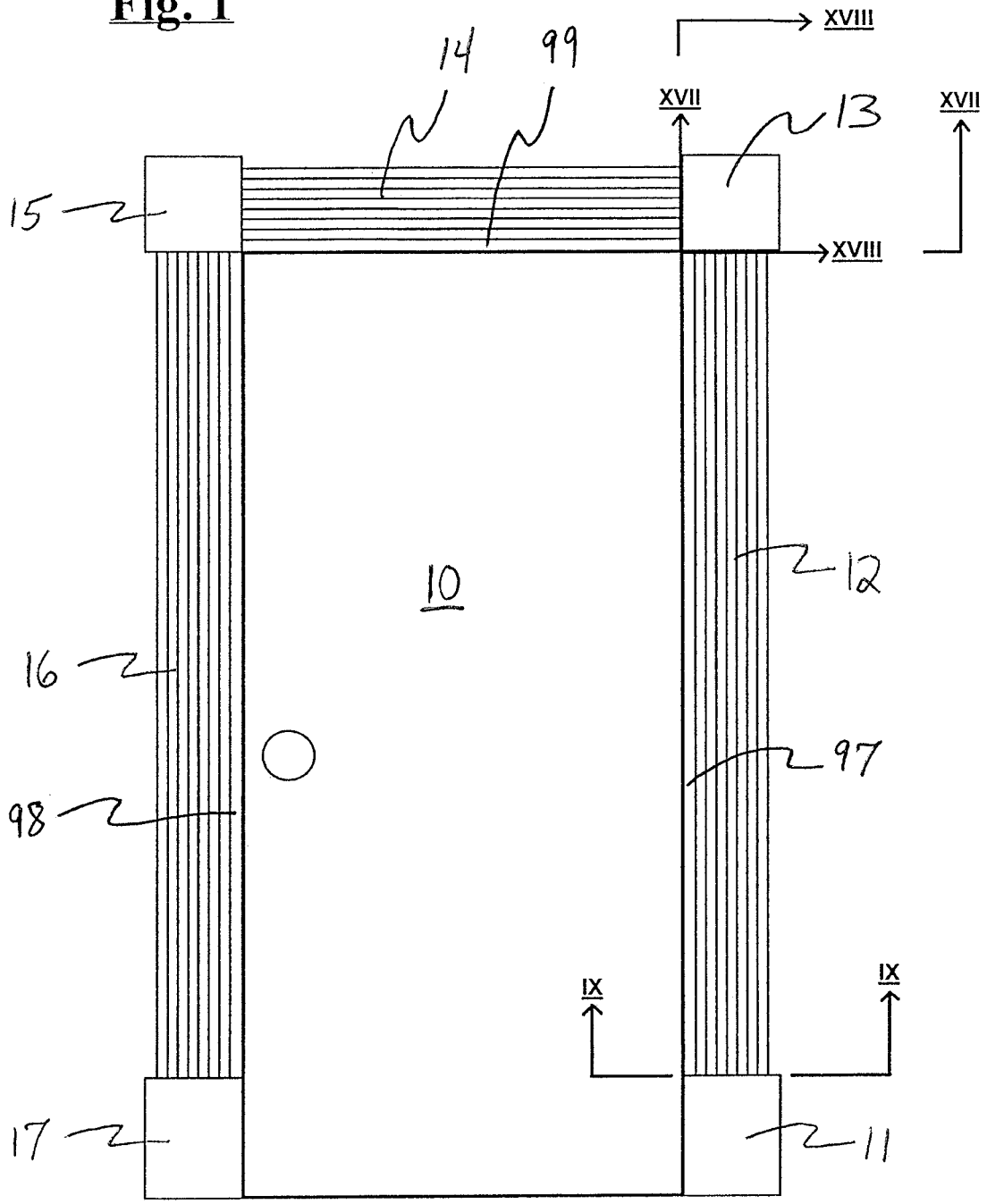
Figure 17:
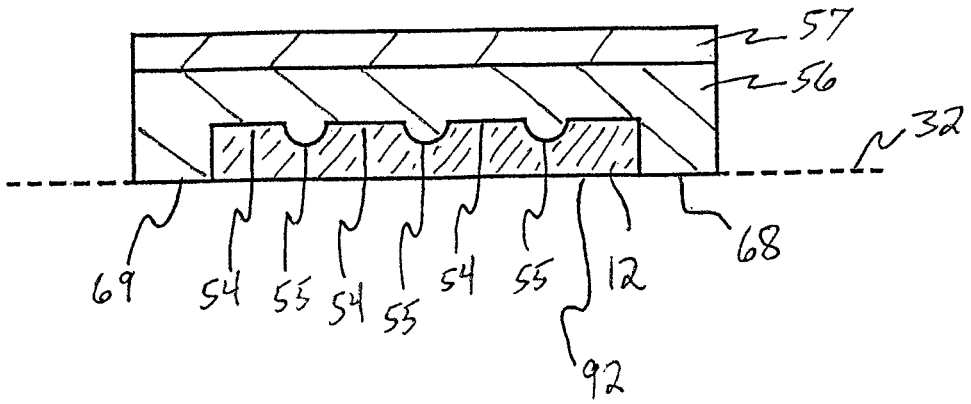

FIG. 17 is a schematic sectional view taken along the section XVII-XVII shown in FIG. 1.

Figure 18:
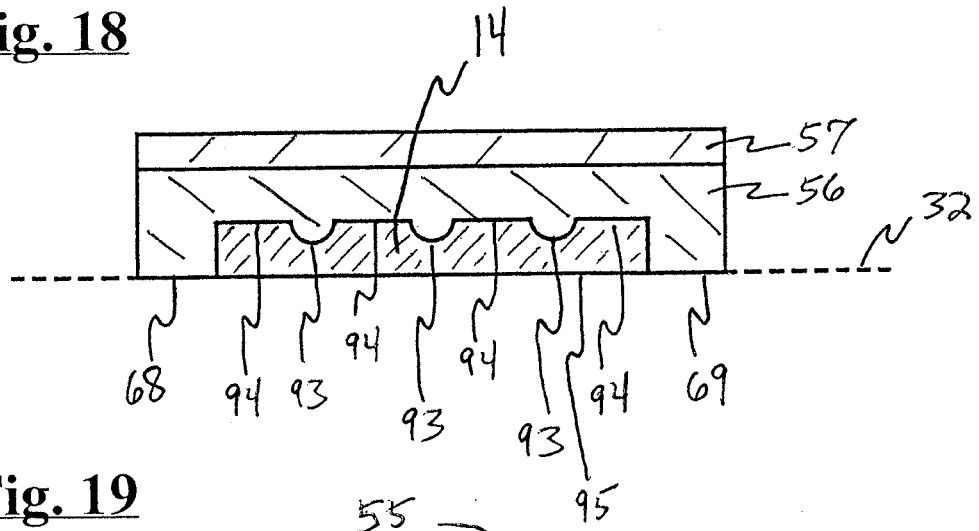

FIG. 18 is a schematic sectional view taken along the section XVIII-XVIII shown in FIG. 1.

Figure 19:
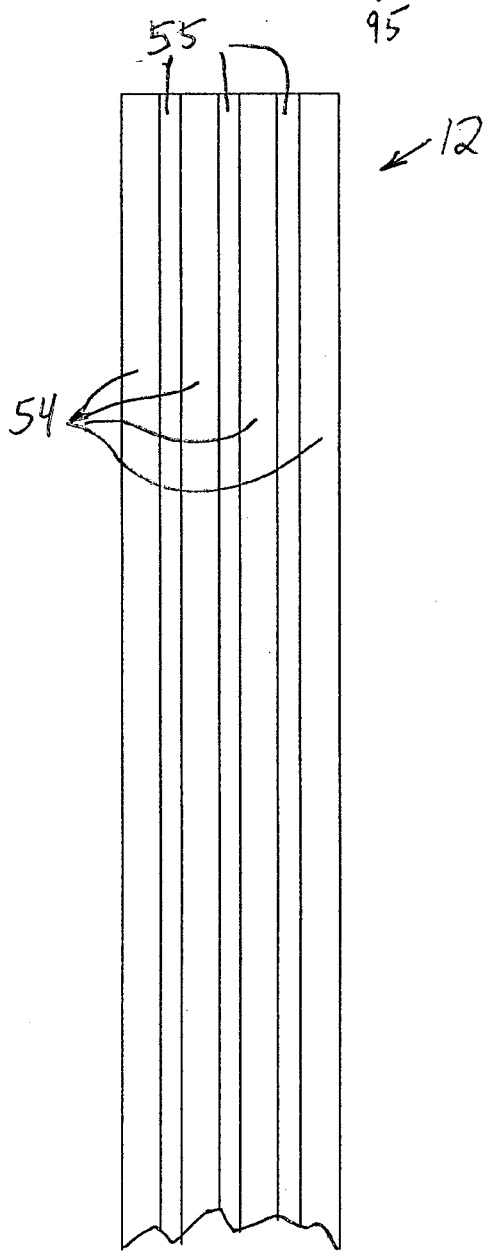

FIG. 19 is a front view of a first molding piece 12.

Figure 20:
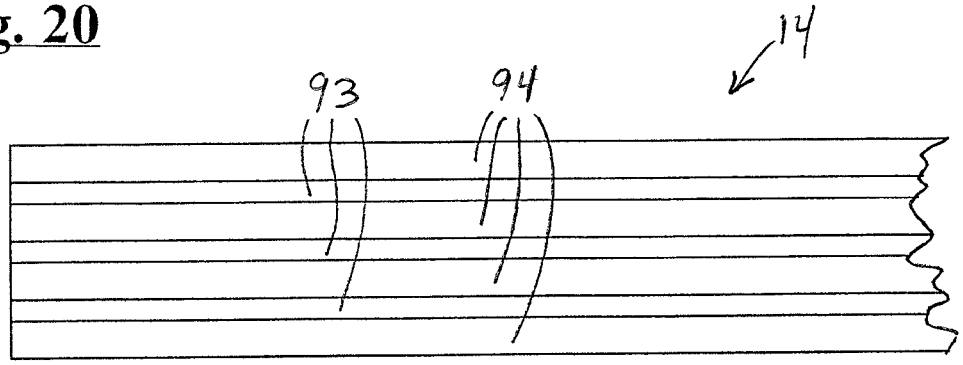

FIG. 20 is a front view of a header piece 14.

Figure 21:
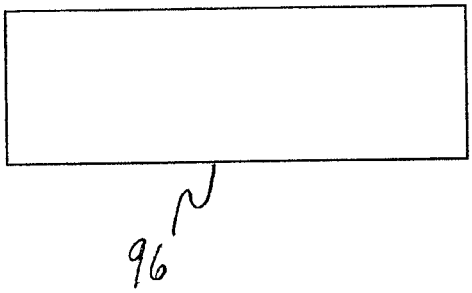

FIG. 21 is a schematic view of packaging 96.

Figure 22:
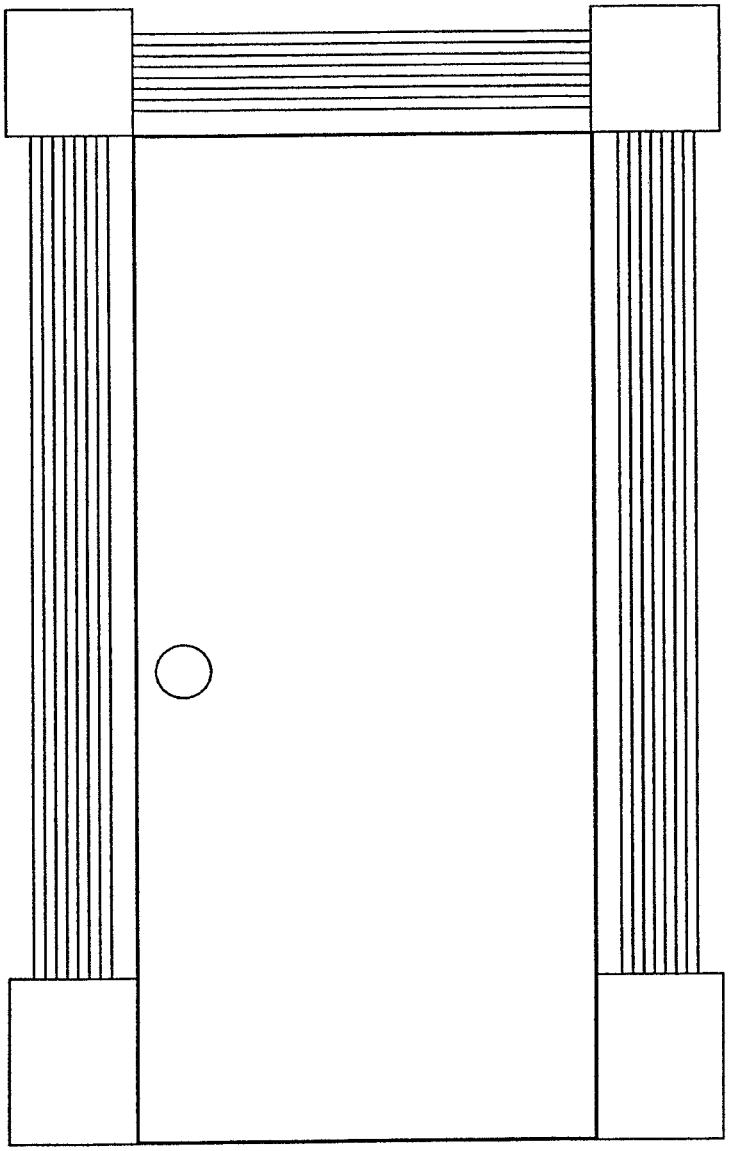

FIG. 22 schematically depicts a front view of a portion of a front side of a house, showing an entry door and a system of components installed as trim for the entry door.

Figure 23:
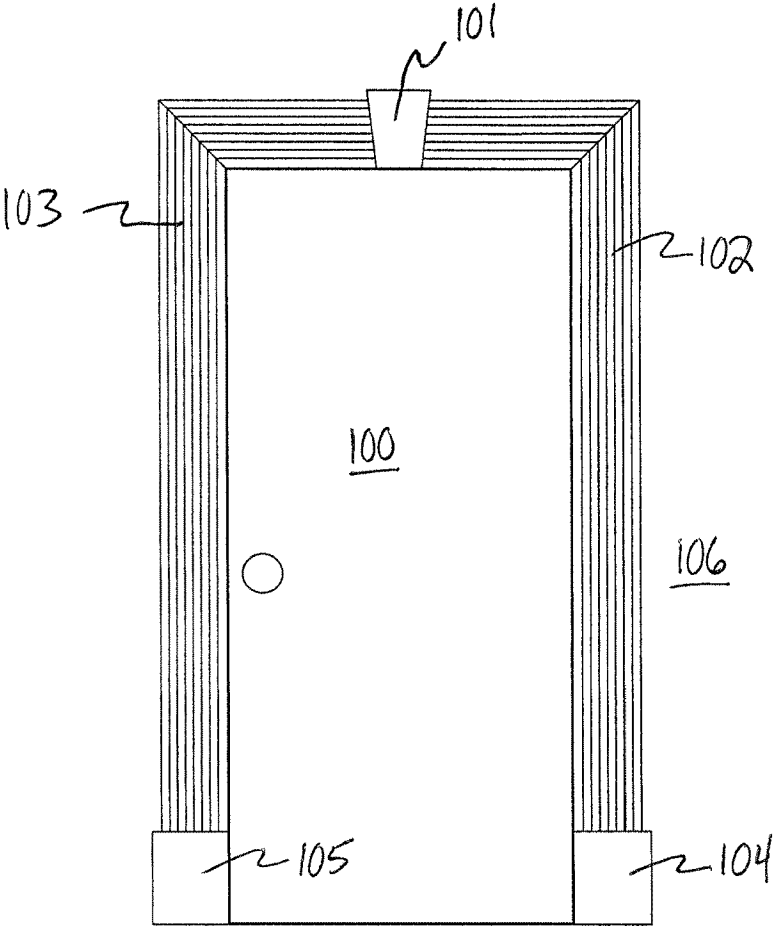

FIG. 23 schematically depicts a front view of a portion of a front side of a house, showing an entry door and a system of components installed as trim for the entry door.

Figure 24:
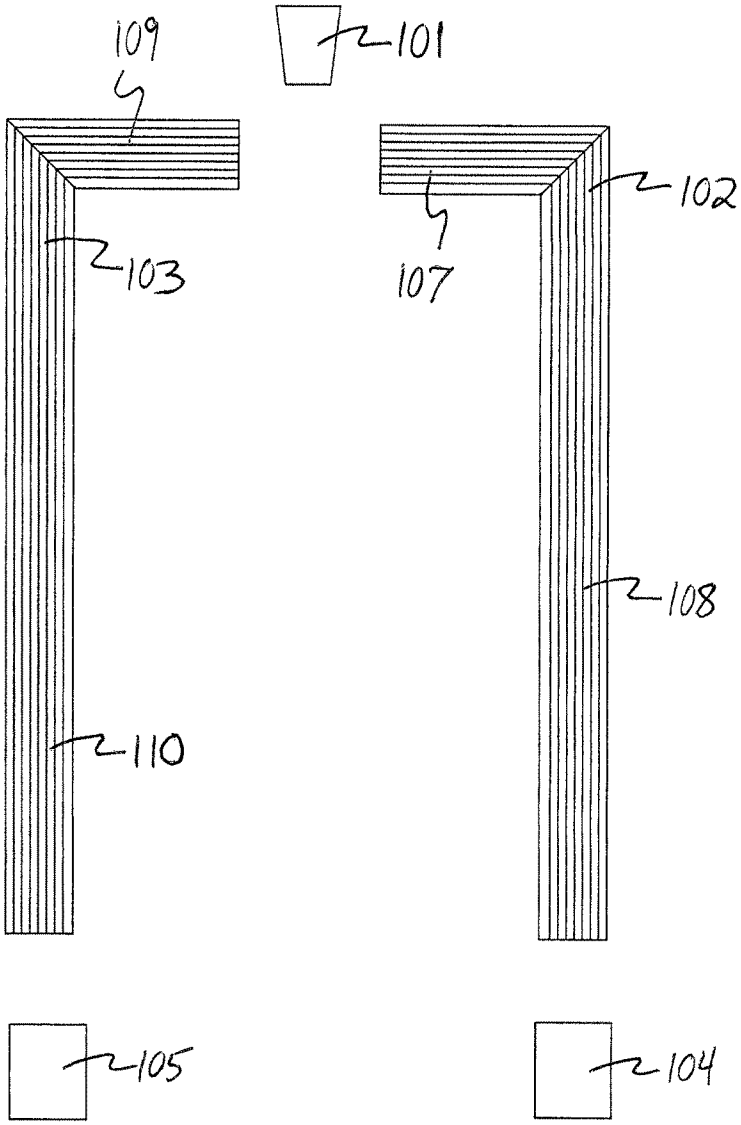

FIG. 24 is an exploded view of the system of components depicted in FIG. 23.

Figure 25:
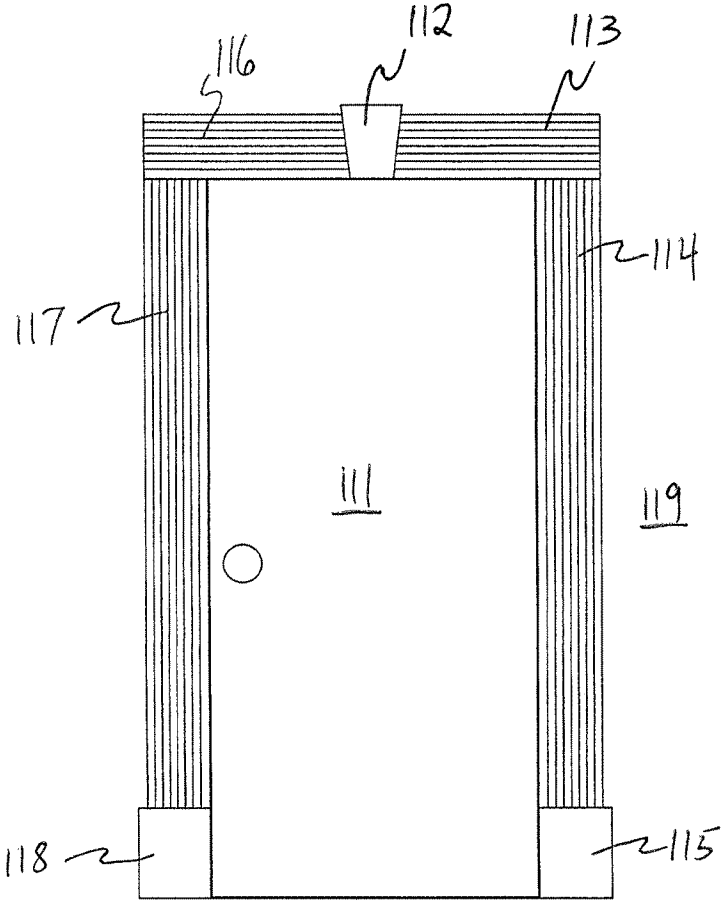

FIG. 25 schematically depicts a front view of a portion of a front side of a house, showing an entry door and a system of components installed as trim for the entry door.

Figure 26:
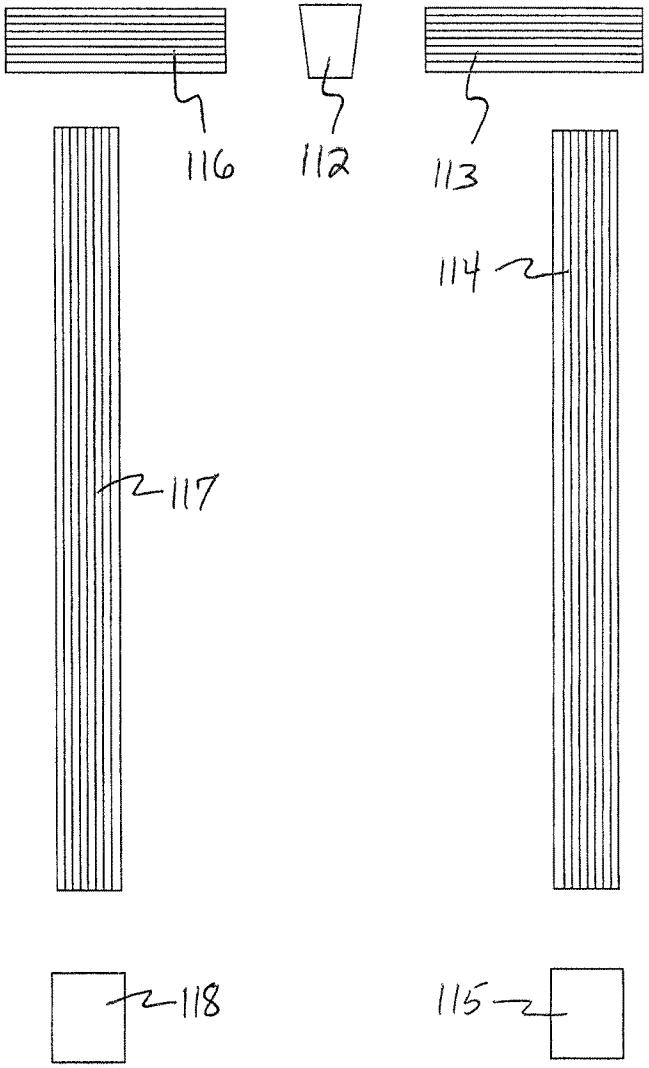

FIG. 26 is an exploded view of the system of components depicted in FIG. 25.

Figure 27:
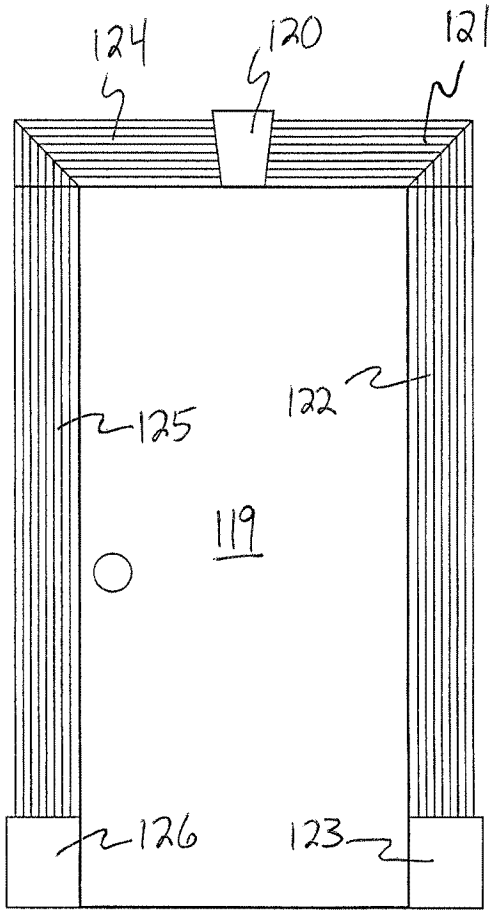

FIG. 27 schematically depicts a front view of a portion of a front side of a house, showing an entry door and a system of components installed as trim for the entry door.

Figure 28:
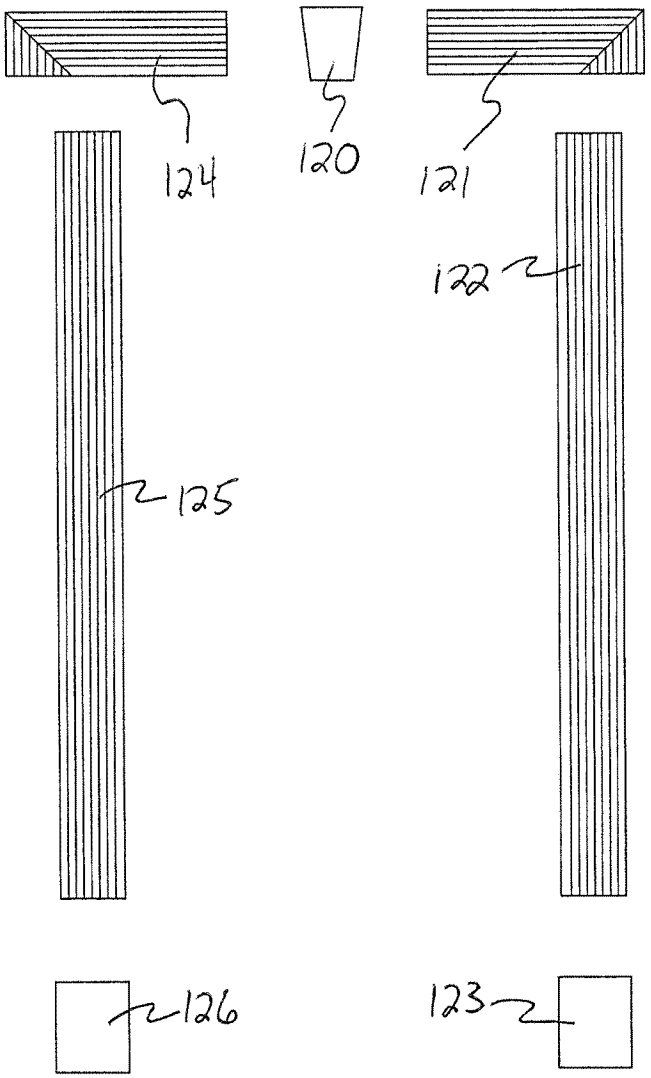

FIG. 28 is an exploded view of the system of components depicted in FIG. 27.

Figure 29:
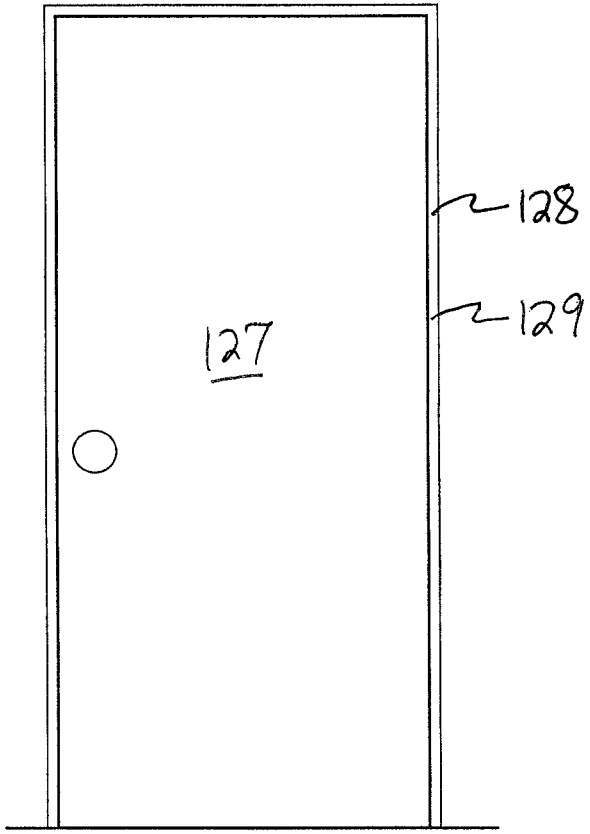

FIG. 29 is a front view of a portion of a commercial building, showing an entry door and a metal frame that forms the doorway.

Figure 30:
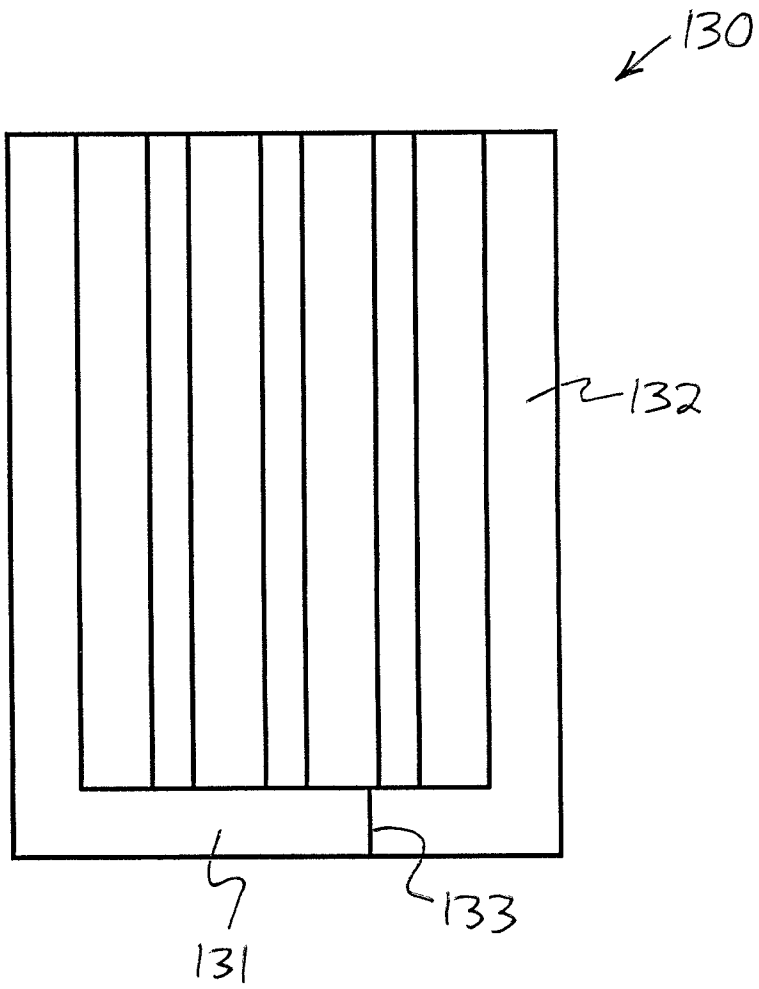

FIG. 30 schematically depicts a rear view of a plinth 134.

Figure 31:
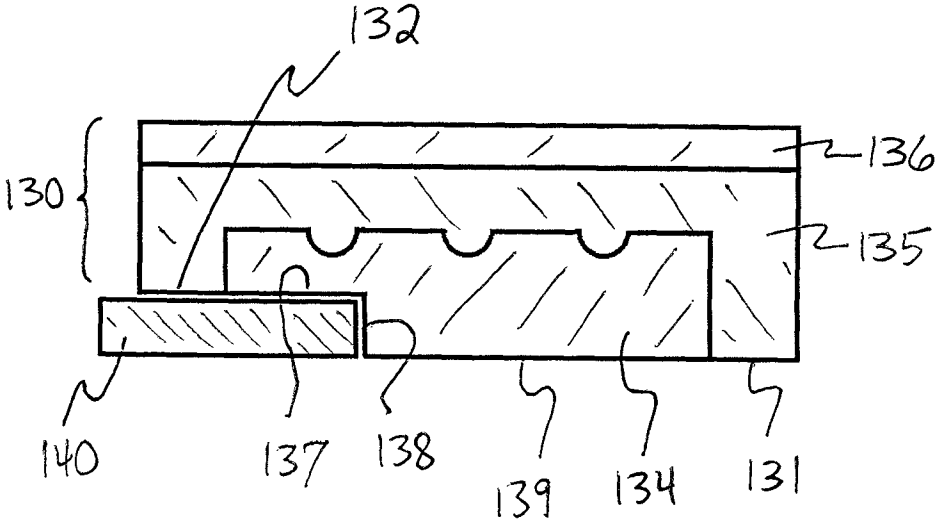

FIG. 31 is a schematic sectional view of a plinth and a molding piece taken along a section analogous to section IX-IX in FIG. 1.

Figure 32:
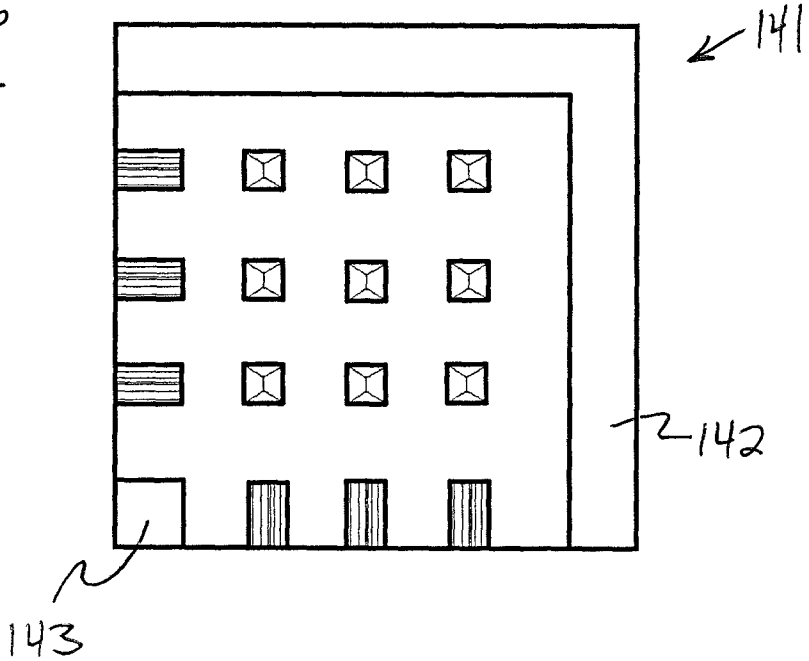

FIG. 32 schematically depicts a rear view of a corner piece structure.

DETAILED DESCRIPTION OF THE INVENTIVE SUBJECT MATTER

In one aspect of the present invention, there is provided a corner piece, comprising:

a corner piece structure having at least a corner piece structure front side, a corner piece structure rear side, a corner piece structure first edge, a corner piece structure second edge, a corner piece structure third edge and a corner piece structure fourth edge, the corner piece structure rear side comprising corner piece raised surfaces and at least a first corner piece recessed surface, the corner piece raised surfaces are each substantially flat and are each substantially co-planar with a first imaginary plane, the at least a first corner piece recessed surface is recessed from the first imaginary plane, the at least a first corner piece recessed surface comprising corner piece protrusions and corner piece valleys, each corner piece valley recessed relative to at least one adjacent corner piece protrusion, the first corner piece recessed surface configured such that:

(1) with the corner piece structure in a corner piece first position, a molding piece comprising molding piece protrusions aligned in a first direction and molding piece valleys aligned in the first direction, the first direction substantially parallel to the first imaginary plane, is capable of being positioned in a molding piece first position relative to the corner piece structure such that:

(a) every cross-section of the molding piece defined along imaginary planes that are each parallel to the corner piece structure first edge is of substantially a same shape;

(b) in the molding piece first position, a back side of the molding piece is substantially co-planar with the first imaginary plane, and at least some extremities of the molding piece protrusions are farther from the first imaginary plane than extremities of at least some adjacent corner piece protrusions are, and at least some extremities of the molding piece valleys are closer to the first imaginary plane than extremities of at least some adjacent corner piece valleys are;

(c) from the molding piece first position, the molding piece is capable of being freely slid, relative to the corner piece structure, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement, and (2) with the corner piece in the corner piece first position, a header piece comprising header piece protrusions aligned in a second direction and header piece valleys aligned in the second direction, the second direction substantially parallel to the first imaginary plane and substantially perpendicular to the first direction, is capable of being positioned in a header piece first position relative to the corner piece structure such that:

(a) every cross-section of the header piece defined along imaginary planes that are each parallel to the corner piece structure second edge is of substantially a same shape;

(b) in the header piece first position, a back side of the header piece is substantially co-planar with the first imaginary plane, and at least some extremities of the header piece protrusions are farther from the imaginary first plane than extremities of at least some adjacent corner piece protrusions are, and at least some extremities of the header piece valleys are closer to the first imaginary plane than extremities of at least some adjacent corner piece valleys are; and (c) from the header piece first position, the header piece is capable of being freely slid, relative to the corner piece, in a direction perpendicular to the corner piece structure second edge, such that at least some regions of the header piece protrusions pass at least some regions of the corner piece protrusions, with the back side of the header piece remaining substantially co-planar with the first imaginary plane during an entirety of such sliding movement.

In some embodiments in accordance with this aspect of the present invention, which can include or not include, as suitable, any of the other features described herein:

the corner piece further comprises a corner piece cover piece, the corner piece cover piece is removably attached to the corner piece structure, and the corner piece cover piece covers at least a portion of the corner piece structure front side.

In some of such embodiments:

the corner piece cover piece comprises at least a first corner piece cover piece magnet and the corner piece structure comprises at least a first corner piece metal structure, and the first corner piece metal structure is magnetically attracted to the first corner piece cover piece magnet, and/or the corner piece structure comprises at least a first corner piece magnet and the corner piece cover piece comprises at least a first corner piece cover piece metal structure, and the first corner piece cover piece metal structure is magnetically attracted to the first corner piece magnet, and/or the corner piece cover piece comprises at least a first corner piece cover piece magnet and the corner piece structure comprises at least a first corner piece magnet, and the first corner piece cover piece magnet is magnetically attracted to the first corner piece magnet.

In some of such embodiments:

the corner piece cover piece comprises at least a first corner piece cover piece protrusion and the corner piece structure comprises at least a first corner piece corner piece recess, and the first corner piece cover piece protrusion is releasably engaged in the first corner piece recess, and/or the corner piece structure comprises at least a first corner piece protuberance and the corner piece cover piece comprises at least a first corner piece cover piece recess, and the first corner piece protuberance is releasably engaged in the first corner piece cover piece recess.

In some of such embodiments:

the corner piece cover piece comprises a corner piece cover piece first edge, a corner piece cover piece second edge, a corner piece cover piece third edge and a corner piece cover piece edge fourth, the corner piece cover piece first edge is substantially parallel to the corner piece structure first edge, the corner piece cover piece second edge is substantially parallel to the corner piece structure second edge, the corner piece cover piece third edge is substantially parallel to the corner piece structure third edge, and the corner piece cover piece fourth edge is substantially parallel to the corner piece structure fourth edge.

In some embodiments in accordance with this aspect of the present invention, which can include or not include, as suitable, any of the other features described herein:

the corner piece raised surfaces comprise at least a first region, a second region, a third region and a fourth region, at least portion of the first region is located where the corner piece structure first edge meets the corner piece structure second edge, at least portion of the second region is located where the corner piece structure second edge meets the corner piece structure third edge, at least portion of the third region is located where the corner piece structure third edge meets the corner piece structure fourth edge, and at least portion of the fourth region is located where the corner piece structure fourth edge meets the corner piece structure first edge.

In some embodiments in accordance with this aspect of the present invention, which can include or not include, as suitable, any of the other features described herein:

the corner piece structure first edge is substantially parallel to the corner piece structure third edge, the corner piece structure second edge is substantially parallel to the corner piece structure fourth edge, the corner piece structure first edge and the corner piece structure third edge are each substantially perpendicular to each of the corner piece structure second edge and the corner piece structure fourth edge, the corner piece structure front side is substantially parallel to the corner piece structure rear side.

In some of such embodiments, the corner piece structure front side and the corner piece structure rear side are each substantially perpendicular to each of the corner piece structure first edge, the corner piece structure second edge, the corner piece structure third edge and the corner piece structure fourth edge.

In some of such embodiments:

a length of the corner piece structure first edge, a length of the corner piece structure second edge, a length of the corner piece structure third edge and a length of the corner piece structure fourth edge are each within a range of from a first length to a second length, the second length 10% longer than the first length. [i.e., equal to 1.1 times the first length]

In some embodiments in accordance with this aspect of the present invention, which can include or not include, as suitable, any of the other features described herein, the corner piece structure comprises wood.

In some embodiments in accordance with this aspect of the present invention, which can include or not include, as suitable, any of the other features described herein, the corner piece structure comprises composite material.

In another aspect of the present invention, there is provided a plinth, comprising:

a plinth structure having at least a plinth structure front side, a plinth structure rear side, a plinth structure first edge, a plinth structure second edge, a plinth structure third edge and a plinth structure fourth edge, the plinth structure rear side comprising at least one plinth raised surface and at least a first plinth recessed surface, each of the at least one plinth raised surface is substantially flat and is substantially in a first imaginary plane, the at least a first plinth recessed surface is recessed from the first imaginary plane, the at least a first plinth recessed surface comprising plinth protrusions and plinth valleys, each plinth valley recessed relative to at least one adjacent plinth protrusion, the first plinth recessed surface configured such that with the plinth structure in a plinth first position, a molding piece comprising molding piece protrusions aligned in a first direction and molding piece valleys aligned in the first direction, the first direction substantially parallel to the first imaginary plane, is capable of being positioned in a molding piece first position relative to the plinth structure such that:

(a) every cross-section of the molding piece defined along imaginary planes that are each parallel to the plinth structure first edge is of substantially a same shape;

(b) in the molding piece first position, a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are; and (c) from the molding piece first position, the molding piece is capable of being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement.

In some embodiments in accordance with this aspect of the present invention, which can include or not include, as suitable, any of the other features described herein:

the plinth further comprises a plinth cover piece, the plinth cover piece is removably attached to the plinth structure, and the plinth cover piece covers at least a portion of the plinth structure front side.

In some of such embodiments:

the plinth cover piece comprises at least a first plinth cover piece magnet and the plinth structure comprises at least a first plinth metal structure, and the first plinth metal structure is magnetically attracted to the first plinth cover piece magnet, and/or the plinth structure comprises at least a first plinth magnet and the plinth cover piece comprises at least a first plinth cover piece metal structure, and the first plinth cover piece metal structure is magnetically attracted to the first plinth magnet, and/or the plinth cover piece comprises at least a first plinth cover piece magnet and the plinth structure comprises at least a first plinth magnet, and the first plinth cover piece magnet is magnetically attracted to the first plinth magnet.

In some of such embodiments:

the plinth cover piece comprises at least a first plinth cover piece protrusion and the plinth structure comprises at least a first plinth recess, and the first plinth cover piece protrusion is releasably engaged in the first plinth recess, and/or the plinth structure comprises at least a plinth first protuberance and the plinth cover piece comprises at least a plinth cover piece first recess, and the plinth first protuberance is releasably engaged in the plinth cover piece first recess.

In some of such embodiments:

the plinth cover piece comprises a plinth cover piece first edge, a plinth cover piece second edge, a plinth cover piece third edge and a plinth cover piece fourth edge, the plinth cover piece first edge is substantially parallel to the plinth structure first edge, the plinth cover piece second edge is substantially parallel to the plinth structure second edge, the plinth cover piece third edge is substantially parallel to the plinth structure third edge, and the plinth cover piece fourth edge is substantially parallel to the plinth structure fourth edge.

In some embodiments in accordance with this aspect of the present invention, which can include or not include, as suitable, any of the other features described herein:

the at least one plinth raised surface comprises at least a first region, a second region, a third region and a fourth region, at least portion of the first region is located where the corner piece structure first edge meets the corner piece structure second edge, at least portion of the second region is located where the corner piece structure second edge meets the corner piece structure third edge, at least portion of the third region is located where the corner piece structure third edge meets the corner piece structure fourth edge, and at least portion of the fourth region is located where the corner piece structure fourth edge meets the corner piece structure first edge.

In some embodiments in accordance with this aspect of the present invention, which can include or not include, as suitable, any of the other features described herein:

the plinth structure first edge is substantially parallel to the plinth structure third edge, the plinth structure second edge is substantially parallel to the plinth structure fourth edge, the plinth structure first edge and the plinth structure third edge are each substantially perpendicular to each of the plinth structure second edge and the plinth structure fourth edge, and the plinth structure front side is substantially parallel to the plinth structure rear side.

In some of such embodiments, the plinth structure front side and the plinth structure rear side are each substantially perpendicular to each of the plinth structure first edge, the plinth structure second edge, the plinth structure third edge and the plinth structure fourth edge.

In some embodiments in accordance with this aspect of the present invention, which can include or not include, as suitable, any of the other features described herein, the plinth structure comprises wood.

In some embodiments in accordance with this aspect of the present invention, which can include or not include, as suitable, any of the other features described herein, the plinth structure comprises composite material.

In another aspect of the present invention, there is provided a kit comprising:

a plinth in accordance with the present invention, as described herein; and a molding piece comprising molding piece protrusions aligned in a first direction and molding piece valleys aligned in the first direction, the first direction substantially parallel to the first imaginary plane, wherein:

with the plinth structure in a first plinth position, the molding piece is capable of being positioned in a molding piece first position relative to the plinth structure such that:

(a) every cross-section of the molding piece defined along imaginary planes that are each parallel to the plinth structure first edge is of substantially a same shape;

(b) in the molding piece first position, a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are; and (c) from the molding piece first position, the molding piece is capable of being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement.

In some embodiments in accordance with this aspect of the present invention, which can include or not include, as suitable, any of the other features described herein:

the kit further comprises packaging, and the plinth and the molding piece are attached to the packaging.

In another aspect of the present invention, there is provided a kit comprising:

a corner piece in accordance with the present invention, as described herein; and a plinth structure, wherein:

the plinth structure has at least a plinth structure front side, a plinth structure rear side, a plinth structure first edge, a plinth structure second edge, a plinth structure third edge and a plinth structure fourth edge, the plinth structure rear side comprises at least one plinth raised surface and at least a first plinth recessed surface, each of the at least one plinth raised surface is substantially flat, the at least a first plinth recessed surface is recessed from the at least one plinth raised surface, the at least a first plinth recessed surface comprises plinth protrusions and plinth valleys, each plinth valley recessed relative to at least one adjacent plinth protrusion, the corner piece and the plinth are configured such that they and a molding piece that comprises aligned molding piece protrusions and aligned molding piece valleys can be positioned relative to each other, such that:

(a) the molding piece protrusions and the molding piece valleys are aligned in the first direction, (b) every cross-section of the molding piece defined along imaginary planes that are each parallel to the corner piece structure first edge is of substantially a same shape, (c) a back side of the molding piece is substantially co-planar with the first imaginary plane, and at least some extremities of the molding piece protrusions are farther from the imaginary first plane than extremities of at least some adjacent corner piece protrusions are, and at least some extremities of the molding piece valleys are closer to the first imaginary plane than extremities of at least some adjacent corner piece valleys are, (d) the molding piece is capable of being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement, (e) the plinth structure first edge is substantially parallel to the corner piece structure first edge, (f) each of the at least one plinth raised surfaces is substantially co-planar with the first imaginary plane, (g) extremities of at least some of the molding piece protrusions are farther from the imaginary first plane than extremities of at least some adjacent plinth protrusions are, (h) extremities of at least some of the molding piece valleys are closer to the first imaginary plane than extremities of at least some adjacent plinth valleys are, and (i) the molding piece is capable of being freely slid from the molding piece first position, in a direction perpendicular to the plinth structure first edge, such that at least some regions of the molding piece protrusions pass at least some regions of the plinth structure, with the back side of the molding piece remaining substantially co-planar with the first imaginary plane during such sliding movement.

In some embodiments in accordance with this aspect of the present invention, which can include or not include, as suitable, any of the other features described herein:

the kit further comprises packaging, and the plinth structure and the corner piece are attached to the packaging.

In another aspect of the present invention, there is provided a kit comprising:

a corner piece in accordance with the present invention, as described herein;

a molding piece; and a plinth structure, wherein:

the molding piece comprises molding piece protrusions aligned in a first direction and molding piece valleys aligned in the first direction, the first direction substantially parallel to the first imaginary plane, the corner piece is configured such that with the corner piece in a corner piece first position, the molding piece is capable of being positioned in a molding piece first position relative to the corner piece structure such that:

(a) the molding piece protrusions are aligned in the first direction and molding piece valleys are aligned in the first direction, (b) every cross-section of the molding piece defined along imaginary planes that are each parallel to the corner piece structure first edge is of substantially a same shape;

(c) in the molding piece first position, a back side of the molding piece is substantially co-planar with the first imaginary plane, and at least some extremities of the molding piece protrusions are farther from the imaginary first plane than extremities of at least some adjacent corner piece protrusions are, and at least some extremities of the molding piece valleys are closer to the first imaginary plane than extremities of at least some adjacent corner piece valleys are; and (d) from the molding piece first position, the molding piece is capable of being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement, the plinth structure has at least a plinth structure front side, a plinth structure rear side, a plinth structure first edge, a plinth structure second edge, a plinth structure third edge and a plinth structure fourth edge, the plinth structure rear side comprises at least one plinth raised surface and at least a first plinth recessed surface, each of the at least one plinth raised surfaces is substantially flat, the at least a first plinth recessed surface is recessed from the first imaginary plane, the at least a first plinth recessed surface comprises plinth protrusions and plinth valleys, each plinth valley recessed relative to at least one adjacent plinth protrusion, the plinth structure is configured such that with the molding piece in the molding piece first position, the plinth structure can be positioned in a plinth first position such that:

the plinth structure first edge is substantially parallel to the corner piece structure first edge, each of the at least one plinth raised surface is substantially co-planar with the first imaginary plane, extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are, and with the plinth structure in the plinth first position and the molding piece in the molding piece first position, the molding piece is capable of being freely slid from the molding piece first position, in a direction perpendicular to the plinth structure first edge, such that at least some regions of the molding piece protrusions pass at least some regions of the plinth structure, with the back side of the molding piece remaining substantially co-planar with the first imaginary plane during such sliding movement.

In some embodiments in accordance with this aspect of the present invention, which can include or not include, as suitable, any of the other features described herein:

the kit further comprises packaging, and the plinth structure, the molding piece and the corner piece are attached to the packaging.

In another aspect of the present invention, there is provided a kit that comprises a corner piece, a molding piece, and a plinth structure (as described above), wherein:

the kit further comprises a header piece, a second corner piece, a second molding piece and a second plinth structure, the header piece comprises header piece protrusions and header piece valleys, with the corner piece in the corner piece first position, the header piece is capable of being positioned in a header piece first position relative to the corner piece structure such that:

(a) the header piece protrusions are aligned in the second direction and the header piece valleys are aligned in the second direction;

(b) every cross-section of the header piece defined along imaginary planes that are each parallel to the corner piece structure second edge is of substantially a same shape;

(c) in the header piece first position, a back side of the header piece is substantially co-planar with the first imaginary plane, and at least some extremities of the header piece protrusions are farther from the imaginary first plane than extremities of at least some adjacent corner piece protrusions are, and at least some extremities of the header piece valleys are closer to the first imaginary plane than extremities of at least some adjacent corner piece valleys are; and (d) from the header piece first position, the header piece is capable of being freely slid, relative to the corner piece, in a direction perpendicular to the corner piece structure second edge, such that at least some regions of the header piece protrusions pass at least some regions of the corner piece protrusions, with the back side of the header piece remaining substantially co-planar with the first imaginary plane during an entirety of such sliding movement, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises second corner piece protrusions and second corner piece valleys, each second corner piece valley recessed relative to at least one adjacent second corner piece protrusion, the at least one second corner piece comprises a second corner piece first recessed surface, the second corner piece is configured such that with the molding piece in the molding piece first position and the corner piece in the corner piece first position, the second corner piece is capable of being positioned in a second corner piece first position such that:

(a) the second corner piece first recessed surface is recessed from the first imaginary plane, (b) the second corner piece structure first edge and the second corner piece structure third edge are each substantially parallel to the corner piece structure first edge and the corner piece structure third edge, (c) the second corner piece structure second edge and the second corner piece structure fourth edge are each substantially parallel to the corner piece structure second edge and the corner piece structure fourth edge, (d) each of the at least one second corner piece raised surface is substantially co-planar with the first imaginary plane, (e) at least some extremities of the header piece protrusions are farther from the imaginary first plane than extremities of at least some adjacent second corner piece protrusions are, and at least some extremities of the header piece valleys are closer to the first imaginary plane than extremities of at least some adjacent second corner piece valleys are; and (f) from the header piece first position, the header piece is capable of being freely slid, relative to the second corner piece structure, in a direction perpendicular to the second corner piece structure first edge, such that at least some regions of the header piece protrusions pass at least some regions of the second corner piece protrusions, with the back side of the header piece remaining substantially co-planar with the first imaginary plane during an entirety of such sliding movement, the second molding piece comprises second molding piece protrusions and second molding piece valleys, the second molding piece is configured such that with the second corner piece in the second corner piece first position, the second molding piece is capable of being positioned in a second molding piece first position such that:

(a) the second molding piece protrusions are aligned in the first direction and the second molding piece valleys are aligned in the first direction;

(b) every cross-section of the second molding piece defined along imaginary planes that are each parallel to the second corner piece structure first edge is of substantially a same shape;

(c) in the second molding piece first position, a back side of the second molding piece is substantially co-planar with the first imaginary plane, and at least some extremities of the second molding piece protrusions are farther from the imaginary first plane than extremities of at least some adjacent second corner piece protrusions are, and at least some extremities of the second molding piece valleys are closer to the first imaginary plane than extremities of at least some adjacent second corner piece valleys are; and (d) from the second molding piece first position, the second molding piece is capable of being freely slid, relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement, the second plinth structure has at least a second plinth structure front side, a second plinth structure rear side, a second plinth structure first edge, a second plinth structure second edge, a second plinth structure third edge and a second plinth structure fourth edge, the second plinth structure rear side comprises at least one second plinth raised surface and at least a one second plinth recessed surface, the at least one second plinth recessed surface comprising a second plinth first recessed surface, each of the at least one second plinth raised surface is substantially flat, the second plinth structure is configured such that with the second corner piece in the second corner piece first position and the second molding piece in the second molding piece first position, the second plinth structure is capable of being positioned in a second plinth first position such that:

(a) the second plinth first recessed surface is recessed from the first imaginary plane, (b) the second plinth first recessed surface comprises second plinth protrusions and second plinth valleys, each second plinth valley recessed relative to at least one adjacent second plinth protrusion, (c) the second plinth structure first edge is substantially parallel to the second corner piece structure first edge, (d) each of the at least one second plinth raised surface is substantially co-planar with the first imaginary plane, (e) extremities of at least some of the second molding piece protrusions are farther from the imaginary first plane than extremities of at least some adjacent second plinth protrusions are, (f) extremities of at least some of the second molding piece valleys are closer to the first imaginary plane than extremities of at least some adjacent second plinth valleys are, and (g) the second molding piece is capable of being freely slid from the second molding piece first position, in a direction perpendicular to the second plinth structure first edge, such that at least some regions of the second molding piece protrusions pass at least some regions of the second plinth structure, with the back side of the second molding piece remaining substantially co-planar with the first imaginary plane during such sliding movement.

In some embodiments in accordance with this aspect of the present invention, which can include or not include, as suitable, any of the other features described herein:

the kit further comprises packaging, and the plinth structure, the molding piece, the corner piece, the header piece, the second corner piece, the second molding piece and the second plinth structure are attached to the packaging.

In another aspect of the present invention, there is provided a kit that comprises a corner piece and a plinth structure (as described above), wherein:

the kit further comprises a second molding piece and a second plinth structure, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises second corner piece protrusions and second corner piece valleys, each second corner piece valley recessed relative to at least one adjacent second corner piece protrusion, the second plinth structure has at least a second plinth structure front side, a second plinth structure rear side, a second plinth structure first edge, a second plinth structure second edge, a second plinth structure third edge and a second plinth structure fourth edge, the second plinth structure rear side comprises at least one second plinth raised surface and at least a one second plinth recessed surface, the at least one second plinth recessed surface comprising a second plinth first recessed surface, each of the at least one second plinth raised surface is substantially flat, the first corner piece and the second corner piece are configured such that they and a header piece that comprises aligned header piece protrusions and aligned header piece valleys can be positioned relative to each other, such that:

(a) the header piece protrusions are aligned in the second direction and the header piece valleys are aligned in the second direction, (b) every cross-section of the header piece defined along imaginary planes that are each parallel to the corner piece structure second edge is of substantially a same shape, (c) a back side of the header piece is substantially co-planar with the first imaginary plane, and at least some extremities of the header piece protrusions are farther from the imaginary first plane than extremities of at least some adjacent corner piece protrusions are, and at least some extremities of the header piece valleys are closer to the first imaginary plane than extremities of at least some adjacent corner piece valleys are, (d) from the header piece first position, the header piece is capable of being freely slid, relative to the corner piece, in a direction perpendicular to the corner piece structure second edge, such that at least some regions of the header piece protrusions pass at least some regions of the corner piece protrusions, with the back side of the header piece remaining substantially co-planar with the first imaginary plane during an entirety of such sliding movement, (e) the second corner piece first recessed surface is recessed from the first imaginary plane, (f) the second corner piece structure first edge and the second corner piece structure third edge are each substantially parallel to the corner piece structure first edge and the corner piece structure third edge, (g) the second corner piece structure second edge and the second corner piece structure fourth edge are each substantially parallel to the corner piece structure second edge and the corner piece structure fourth edge, (h) each of the at least one second corner piece raised surface is substantially co-planar with the first imaginary plane, (i) at least some extremities of the header piece protrusions are farther from the imaginary first plane than extremities of at least some adjacent second corner piece protrusions are, and at least some extremities of the header piece valleys are closer to the first imaginary plane than extremities of at least some adjacent second corner piece valleys are, and (j) the header piece is capable of being freely slid, relative to the second corner piece structure, in a direction perpendicular to the second corner piece structure first edge, such that at least some regions of the header piece protrusions pass at least some regions of the second corner piece protrusions, with the back side of the header piece remaining substantially co-planar with the first imaginary plane during an entirety of such sliding movement, In some embodiments in accordance with this aspect of the present invention, which can include or not include, as suitable, any of the other features described herein:

the kit further comprises packaging, and the plinth, the corner piece, the second corner piece and the second plinth structure are attached to the packaging.

In another aspect of the present invention, there is provided a kit comprising:

a corner piece in accordance with the present invention, as described herein;

and a molding piece, wherein:

the molding piece comprises molding piece protrusions and molding piece valleys, the corner piece is configured such that with the corner piece in the corner piece first position, the molding piece is capable of being positioned in a molding piece first position relative to the corner piece structure such that:

(a) the molding piece protrusions are aligned in the first direction and the molding piece valleys are aligned in the first direction;

(b) every cross-section of the molding piece defined along imaginary planes that are each parallel to the corner piece structure first edge is of substantially a same shape;

(c) in the molding piece first position, a back side of the molding piece is substantially co-planar with the first imaginary plane, and at least some extremities of the molding piece protrusions are farther from the imaginary first plane than extremities of at least some adjacent corner piece protrusions are, and at least some extremities of the molding piece valleys are closer to the first imaginary plane than extremities of at least some adjacent corner piece valleys are; and (d) from the molding piece first position, the molding piece is capable of being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement.

In some embodiments in accordance with this aspect of the present invention, which can include or not include, as suitable, any of the other features described herein:

the kit further comprises packaging, and the corner piece and the molding piece are attached to the packaging.

In another aspect of the present invention, there is provided a kit that comprises a corner piece and a molding piece (as described above), wherein:

the kit further comprises a header piece, a second corner piece, and a second molding piece, the header piece comprises header piece protrusions and header piece valleys, with the corner piece in the corner piece first position, the header piece is capable of being positioned in a header piece first position relative to the corner piece structure such that:

(a) the header piece protrusions are aligned in the second direction and the header piece valleys are aligned in the second direction;

(b) every cross-section of the header piece defined along imaginary planes that are each parallel to the corner piece structure second edge is of substantially a same shape;

(c) in the header piece first position, a back side of the header piece is substantially co-planar with the first imaginary plane, and at least some extremities of the header piece protrusions are farther from the imaginary first plane than extremities of at least some adjacent corner piece protrusions are, and at least some extremities of the header piece valleys are closer to the first imaginary plane than extremities of at least some adjacent corner piece valleys are; and (d) from the header piece first position, the header piece is capable of being freely slid, relative to the corner piece, in a direction perpendicular to the corner piece structure second edge, such that at least some regions of the header piece protrusions pass at least some regions of the corner piece protrusions, with the back side of the header piece remaining substantially co-planar with the first imaginary plane during an entirety of such sliding movement, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises second corner piece protrusions and second corner piece valleys, each second corner piece valley recessed relative to at least one adjacent second corner piece protrusion, the at least one second corner piece comprises a second corner piece first recessed surface, the second corner piece is configured such that with the molding piece in the molding piece first position and the corner piece in the corner piece first position, the second corner piece is capable of being positioned in a second corner piece first position such that:

(a) the second corner piece first recessed surface is recessed from the first imaginary plane, (b) the second corner piece structure first edge and the second corner piece structure third edge are each substantially parallel to the corner piece structure first edge and the corner piece structure third edge, (c) the second corner piece structure second edge and the second corner piece structure fourth edge are each substantially parallel to the corner piece structure second edge and the corner piece structure fourth edge, (d) each of the at least one second corner piece raised surface is substantially co-planar with the first imaginary plane, (e) at least some extremities of the header piece protrusions are farther from the imaginary first plane than extremities of at least some adjacent second corner piece protrusions are, and at least some extremities of the header piece valleys are closer to the first imaginary plane than extremities of at least some adjacent second corner piece valleys are, and (f) from the molding piece first position, the molding piece is capable of being freely slid, relative to the second corner piece structure, in a direction perpendicular to the second corner piece structure first edge, such that at least some regions of the molding piece protrusions pass at least some regions of the second corner piece protrusions, with the back side of the molding piece remaining substantially co-planar with the first imaginary plane during an entirety of such sliding movement, the second molding piece comprises second molding piece protrusions and second molding piece valleys, the second molding piece is configured such that with the second corner piece in the second corner piece first position, the second molding piece is capable of being positioned in a second molding piece first position such that:

(a) the second molding piece protrusions are aligned in the first direction and the molding piece valleys are aligned in the first direction;

(b) every cross-section of the second molding piece defined along imaginary planes that are each parallel to the second corner piece structure first edge is of substantially a same shape;

(c) in the second molding piece first position, a back side of the molding piece is substantially co-planar with the first imaginary plane, and at least some extremities of the second molding piece protrusions are farther from the imaginary first plane than extremities of at least some adjacent second corner piece protrusions are, and at least some extremities of the second molding piece valleys are closer to the first imaginary plane than extremities of at least some adjacent second corner piece valleys are; and (d) from the second molding piece first position, the second molding piece is capable of being freely slid, relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement.

In some embodiments in accordance with this aspect of the present invention, which can include or not include, as suitable, any of the other features described herein:

the kit further comprises packaging, and the corner piece, the molding piece, the header piece, the second corner piece, and the second molding piece are attached to the packaging.

In another aspect of the present invention, there is provided a system comprising:

a plinth structure in accordance with the present invention, as described herein; and a molding piece, wherein:

the molding piece comprises molding piece protrusions aligned in a first direction and molding piece valleys aligned in the first direction, the first direction substantially parallel to the first imaginary plane, every cross-section of the molding piece defined along imaginary planes that are each parallel to the plinth structure first edge is of substantially a same shape, and a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are.

In some embodiments in accordance with this aspect of the present invention, which can include or not include, as suitable, any of the other features described herein, at least a portion of the plinth structure overlaps a portion of the molding piece in a dimension aligned with the first direction.

In some embodiments in accordance with this aspect of the present invention, which can include or not include, as suitable, any of the other features described herein, nothing in the plinth structure or the molding piece prevents the molding piece from being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement.

In another aspect of the present invention, there is provided a system comprising:

a corner piece in accordance with the present invention, as described herein;

a molding piece; and a plinth structure, wherein:

the molding piece comprises molding piece protrusions aligned in a first direction and molding piece valleys aligned in the first direction, the first direction substantially parallel to the first imaginary plane, the molding piece protrusions are aligned in the first direction and molding piece valleys are aligned in the first direction, every cross-section of the molding piece defined along imaginary planes that are each parallel to the corner piece structure first edge is of substantially a same shape, a back side of the molding piece is substantially co-planar with the first imaginary plane, and at least some extremities of the molding piece protrusions are farther from the imaginary first plane than extremities of at least some adjacent corner piece protrusions are, and at least some extremities of the molding piece valleys are closer to the first imaginary plane than extremities of at least some adjacent corner piece valleys are, the plinth structure has at least a plinth structure front side, a plinth structure rear side, a plinth structure first edge, a plinth structure second edge, a plinth structure third edge and a plinth structure fourth edge, the plinth structure rear side comprises at least one plinth raised surface and at least a first plinth recessed surface, each of the at least one plinth raised surface is substantially flat, the at least a first plinth recessed surface is recessed from the first imaginary plane, the at least a first plinth recessed surface comprises plinth protrusions and plinth valleys, each plinth valley recessed relative to at least one adjacent plinth protrusion, the plinth structure first edge is substantially parallel to the corner piece structure first edge, each of the at least one plinth raised surface is substantially co-planar with the first imaginary plane, extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are.

In some embodiments in accordance with this aspect of the present invention, which can include or not include, as suitable, any of the other features described herein:

at least a portion of the plinth structure overlaps a portion of the molding piece in a dimension aligned with the first direction; and at least a portion of the corner piece overlaps a portion of the molding piece in a dimension aligned with the first direction.

In some embodiments in accordance with this aspect of the present invention, which can include or not include, as suitable, any of the other features described herein:

nothing in the corner piece or the molding piece prevents the molding piece from being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement, and nothing in the plinth structure or the molding piece prevents the molding piece from being freely slid, relative to the plinth structure, in a direction perpendicular to the plinth structure first edge, such that at least some regions of the molding piece protrusions pass at least some regions of the plinth structure, with the back side of the molding piece remaining substantially co-planar with the first imaginary plane during such sliding movement.

In another aspect of the present invention, there is provided a system that comprises a corner piece in accordance with the present invention, as described herein; a molding piece; and a plinth structure (as described above), wherein:

the system further comprises a header piece, a second corner piece, a second molding piece and a second plinth structure, the header piece comprises header piece protrusions and header piece valleys, the header piece protrusions are aligned in the second direction and the header piece valleys are aligned in the second direction, every cross-section of the header piece defined along imaginary planes that are each parallel to the corner piece structure second edge is of substantially a same shape, a back side of the header piece is substantially co-planar with the first imaginary plane, and at least some extremities of the header piece protrusions are farther from the imaginary first plane than extremities of at least some adjacent corner piece protrusions are, and at least some extremities of the header piece valleys are closer to the first imaginary plane than extremities of at least some adjacent corner piece valleys are, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises second corner piece protrusions and second corner piece valleys, each second corner piece valley recessed relative to at least one adjacent second corner piece protrusion, the at least one second corner piece comprises a second corner piece first recessed surface, the second corner piece first recessed surface is recessed from the first imaginary plane, the second corner piece structure first edge and the second corner piece structure third edge are each substantially parallel to the corner piece structure first edge and the corner piece structure third edge, the second corner piece structure second edge and the second corner piece structure fourth edge are each substantially parallel to the corner piece structure second edge and the corner piece structure fourth edge, each of the at least one second corner piece raised surface is substantially co-planar with the first imaginary plane, at least some extremities of the header piece protrusions are farther from the imaginary first plane than extremities of at least some adjacent second corner piece protrusions are, and at least some extremities of the header piece valleys are closer to the first imaginary plane than extremities of at least some adjacent second corner piece valleys are, the second molding piece comprises second molding piece protrusions and second molding piece valleys, the second molding piece protrusions are aligned in the first direction and the molding piece valleys are aligned in the first direction, every cross-section of the second molding piece defined along imaginary planes that are each parallel to the second corner piece structure first edge is of substantially a same shape, a back side of the molding piece is substantially co-planar with the first imaginary plane, and at least some extremities of the second molding piece protrusions are farther from the imaginary first plane than extremities of at least some adjacent second corner piece protrusions are, and at least some extremities of the second molding piece valleys are closer to the first imaginary plane than extremities of at least some adjacent second corner piece valleys are, the second plinth structure has at least a second plinth structure front side, a second plinth structure rear side, a second plinth structure first edge, a second plinth structure second edge, a second plinth structure third edge and a second plinth structure fourth edge, the second plinth structure rear side comprises at least one second plinth raised surface and at least a one second plinth recessed surface, the at least one second plinth recessed surface comprising a second plinth first recessed surface, each of the at least one second plinth raised surface is substantially flat, the second plinth first recessed surface is recessed from the first imaginary plane, the second plinth first recessed surface comprises second plinth protrusions and second plinth valleys, each second plinth valley recessed relative to at least one adjacent second plinth protrusion, the second plinth structure first edge is substantially parallel to the second corner piece structure first edge, the second plinth structure first edge and the second plinth structure third edge are each substantially parallel to the second corner piece structure first edge and the second corner piece structure third edge, the second plinth structure second edge and the second plinth structure fourth edge are each substantially parallel to the second corner piece structure second edge and the second corner piece structure fourth edge, each of the at least one second plinth raised surface is substantially co-planar with the first imaginary plane, extremities of at least some of the second molding piece protrusions are farther from the imaginary first plane than extremities of at least some adjacent second plinth protrusions are, and extremities of at least some of the second molding piece valleys are closer to the first imaginary plane than extremities of at least some adjacent second plinth valleys are.

In some embodiments in accordance with this aspect of the present invention, which can include or not include, as suitable, any of the other features described herein:

at least a portion of the plinth structure overlaps a portion of the molding piece in a dimension aligned with the first direction, at least a portion of the corner piece overlaps a portion of the molding piece in a dimension aligned with the first direction, at least a portion of the corner piece overlaps a portion of the header piece in a dimension aligned with the second direction, at least a portion of the second corner piece overlaps a portion of the header piece in a dimension aligned with the second direction, at least a portion of the second corner piece overlaps a portion of the second molding piece in a dimension aligned with the first direction, at least a portion of the second plinth structure overlaps a portion of the second molding piece in a dimension aligned with the first direction.

In some embodiments in accordance with this aspect of the present invention, which can include or not include, as suitable, any of the other features described herein:

nothing in the corner piece or the molding piece prevents the molding piece from being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement, and nothing in the plinth structure or the molding piece prevents the molding piece from being freely slid, relative to the plinth structure, in a direction perpendicular to the plinth structure first edge, such that at least some regions of the molding piece protrusions pass at least some regions of the plinth structure, with the back side of the molding piece remaining substantially co-planar with the first imaginary plane during such sliding movement.

nothing in the corner piece or the header piece prevents the header piece from being freely slid, relative to the corner piece, in a direction perpendicular to the corner piece structure first edge, such that at least some regions of the header piece protrusions pass at least some regions of the corner piece protrusions, with the back side of the header piece remaining substantially co-planar with the first imaginary plane during an entirety of such sliding movement, nothing in the second corner piece or the header piece prevents the header piece from being freely slid, relative to the second corner piece, in a direction perpendicular to the second corner piece structure first edge, such that at least some regions of the header piece protrusions pass at least some regions of the second corner piece protrusions, with the back side of the header piece remaining substantially co-planar with the first imaginary plane during an entirety of such sliding movement, nothing in the second corner piece or the second molding piece prevents the second molding piece from being freely slid, relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement, and nothing in the second plinth structure or the second molding piece prevents the second molding piece from being freely slid, relative to the second plinth structure, in a direction perpendicular to the second plinth structure first edge, such that at least some regions of the second molding piece protrusions pass at least some regions of the second plinth structure, with the back side of the second molding piece remaining substantially co-planar with the first imaginary plane during such sliding movement.

In another aspect of the present invention, there is provided a system comprising:

a corner piece in accordance with the present invention, as described herein;

and a molding piece, wherein:

the molding piece comprises molding piece protrusions and molding piece valleys, the molding piece protrusions are aligned in the first direction and the molding piece valleys are aligned in the first direction, every cross-section of the molding piece defined along imaginary planes that are each parallel to the corner piece structure first edge is of substantially a same shape, a back side of the molding piece is substantially co-planar with the first imaginary plane, and at least some extremities of the molding piece protrusions are farther from the imaginary first plane than extremities of at least some adjacent corner piece protrusions are, and at least some extremities of the molding piece valleys are closer to the first imaginary plane than extremities of at least some adjacent corner piece valleys are.

In some embodiments in accordance with this aspect of the present invention, which can include or not include, as suitable, any of the other features described herein:

at least a portion of the corner piece overlaps a portion of the molding piece in a dimension aligned with the first direction.

In some embodiments in accordance with this aspect of the present invention, which can include or not include, as suitable, any of the other features described herein:

nothing in the corner piece or the molding piece prevents the molding piece from being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement.

In another aspect of the present invention, there is provided a system that comprises a corner piece in accordance with the present invention, as described herein, and a molding piece (as described above), wherein:

the system further comprises a header piece, a second corner piece, and a second molding piece, the header piece protrusions are aligned in the second direction and the header piece valleys are aligned in the second direction, every cross-section of the header piece is defined along imaginary planes that are each parallel to the corner piece structure second edge is of substantially a same shape, a back side of the header piece is substantially co-planar with the first imaginary plane, and at least some extremities of the header piece protrusions are farther from the imaginary first plane than extremities of at least some adjacent corner piece protrusions are, and at least some extremities of the header piece valleys are closer to the first imaginary plane than extremities of at least some adjacent corner piece valleys are, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises second corner piece protrusions and second corner piece valleys, each second corner piece valley recessed relative to at least one adjacent second corner piece protrusion, the at least one second corner piece comprises a second corner piece first recessed surface, the second corner piece first recessed surface is recessed from the first imaginary plane, the second corner piece structure first edge and the second corner piece structure third edge are each substantially parallel to the corner piece structure first edge and the corner piece structure third edge, the second corner piece structure second edge and the second corner piece structure fourth edge are each substantially parallel to the corner piece structure second edge and the corner piece structure fourth edge, each of the at least one second corner piece raised surface is substantially co-planar with the first imaginary plane, at least some extremities of the header piece protrusions are farther from the imaginary first plane than extremities of at least some adjacent second corner piece protrusions are, and at least some extremities of the header piece valleys are closer to the first imaginary plane than extremities of at least some adjacent second corner piece valleys are, the second molding piece comprises second molding piece protrusions and second molding piece valleys, the second molding piece protrusions are aligned in the first direction and the molding piece valleys are aligned in the first direction, every cross-section of the second molding piece defined along imaginary planes that are each parallel to the second corner piece structure first edge is of substantially a same shape, and a back side of the molding piece is substantially co-planar with the first imaginary plane, and at least some extremities of the second molding piece protrusions are farther from the imaginary first plane than extremities of at least some adjacent second corner piece protrusions are, and at least some extremities of the second molding piece valleys are closer to the first imaginary plane than extremities of at least some adjacent second corner piece valleys are.

In some embodiments in accordance with this aspect of the present invention, which can include or not include, as suitable, any of the other features described herein:

at least a portion of the corner piece overlaps a portion of the molding piece in a dimension aligned with the first direction, at least a portion of the corner piece overlaps a portion of the header piece in a dimension aligned with the second direction, at least a portion of the second corner piece overlaps a portion of the header piece in a dimension aligned with the second direction, and at least a portion of the second corner piece overlaps a portion of the second molding piece in a dimension aligned with the first direction.

In some embodiments in accordance with this aspect of the present invention, which can include or not include, as suitable, any of the other features described herein:

nothing in the corner piece or the molding piece prevents the molding piece from being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement.

nothing in the corner piece or the header piece prevents the header piece from being freely slid, relative to the corner piece, in a direction perpendicular to the corner piece structure second edge, such that at least some regions of the header piece protrusions pass at least some regions of the corner piece protrusions, with the back side of the header piece remaining substantially co-planar with the first imaginary plane during an entirety of such sliding movement, nothing in the second corner piece or the header piece prevents the header piece from being freely slid, relative to the second corner piece, in a direction perpendicular to the second corner piece structure second edge, such that at least some regions of the molding piece protrusions pass at least some regions of the second corner piece protrusions, with the back side of the molding piece remaining substantially co-planar with the first imaginary plane during an entirety of such sliding movement, nothing in the second corner piece or the second molding piece prevents the second molding piece from being freely slid, relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement.

In another aspect of the present invention, there is provided a system, comprising:

a header segment;

first and second corner-forming molding elements; and first and second plinths, the header segment having a header segment front side and a header segment rear side, the header segment rear side comprising at least one header segment raised surface and at least a first header segment recessed surface, the first header segment raised surface is substantially flat and is substantially co-planar with a first imaginary plane, the first header segment recessed surface is recessed from the first imaginary plane, the first header segment recessed surface comprises header segment protrusions and header segment valleys, each header segment valley recessed relative to at least one adjacent header segment protrusion, the first corner-forming molding element having a first portion and a second portion, the first portion comprising first portion protrusions aligned in a first direction and first portion valleys aligned in the first direction, the first direction substantially parallel to the first imaginary plane, the second portion comprising second portion protrusions aligned in a second direction and second portion valleys aligned in the second direction, the second direction substantially parallel to the first imaginary plane, the second direction substantially perpendicular to the first direction, every cross-section of the first portion defined along a first set of imaginary planes that are each perpendicular to the first imaginary plane is of substantially a same shape, every cross-section of the second portion defined along a second set of imaginary planes that are each perpendicular to the first imaginary plane is of substantially a same shape, a back side of the first corner-forming molding element is substantially co-planar with the first imaginary plane, the second corner-forming molding element having a third portion and a fourth portion, the third portion comprising third portion protrusions aligned in the first direction and third portion valleys aligned in the first direction, the fourth portion comprising fourth portion protrusions aligned in the second direction and fourth portion valleys aligned in the second direction, every cross-section of the third portion defined along a third set of imaginary planes that are each perpendicular to the first imaginary plane is of substantially a same shape, every cross-section of the fourth portion defined along the second set of imaginary planes is of substantially a same shape, a back side of the second corner-forming molding element is substantially co-planar with the first imaginary plane, the first plinth having a first plinth front side and a first plinth rear side, the first plinth rear side comprising a first plinth raised surface and a first plinth recessed surface, the first plinth raised surface is substantially flat and is substantially in the first imaginary plane, the first plinth recessed surface is recessed from the first imaginary plane, the first plinth recessed surface comprises first plinth protrusions and first plinth valleys, each first plinth valley recessed relative to at least one adjacent first plinth protrusion, the second plinth having a second plinth front side and a second plinth rear side, the second plinth rear side comprising a second plinth raised surface and a second plinth recessed surface, the second plinth raised surface is substantially flat and is substantially in the first imaginary plane, the second plinth recessed surface is recessed from the first imaginary plane, the second plinth recessed surface comprises second plinth protrusions and second plinth valleys, each second plinth valley recessed relative to at least one adjacent second plinth protrusion, the first portion is slidably complementary to the header segment, and extremities of at least some of the first portion protrusions are farther from the imaginary first plane than extremities of at least some adjacent header segment protrusions are, and extremities of at least some of the first portion valleys are closer to the first imaginary plane than extremities of at least some adjacent header segment valleys are, the second portion is slidably complementary to the first plinth, and extremities of at least some of the second portion protrusions are farther from the imaginary first plane than extremities of at least some adjacent first plinth protrusions are, and extremities of at least some of the second portion valleys are closer to the first imaginary plane than extremities of at least some adjacent first plinth valleys are, the third portion is slidably complementary to the header segment, and extremities of at least some of the third portion protrusions are farther from the imaginary first plane than extremities of at least some adjacent header segment protrusions are, and extremities of at least some of the third portion valleys are closer to the first imaginary plane than extremities of at least some adjacent header segment valleys are, the fourth portion is slidably complementary to the second plinth, and extremities of at least some of the fourth portion protrusions are farther from the imaginary first plane than extremities of at least some adjacent second plinth protrusions are, and extremities of at least some of the fourth portion valleys are closer to the first imaginary plane than extremities of at least some adjacent second plinth valleys are. The present invention also provides each of the components of a system according to this aspect, kits comprising the components of a system according to this aspect, methods of making such components, methods of making such kits, and methods of assembling such systems.

In some embodiments according to this aspect of the present invention, the header segment protrusions and header segment valleys extend from a first edge of the header segment to an opposite edge of the header segment, the first edge of the header segment spaced from the opposite edge of the header segment in the first direction.

In another aspect of the present invention, there is provided a system, comprising:

a header segment;

first and second header pieces;

first and second molding pieces; and first and second plinths, the header segment having a header segment front side and a header segment rear side, the header segment rear side comprising at least one header segment raised surface and at least a first header segment recessed surface, the first header segment raised surface is substantially flat and is substantially co-planar with a first imaginary plane, the first header segment recessed surface is recessed from the first imaginary plane, the first header segment recessed surface comprises header segment protrusions and header segment valleys, each header segment valley recessed relative to at least one adjacent header segment protrusion, the first header piece comprising first header piece protrusions aligned in a first direction and first header piece valleys aligned in the first direction, the first direction substantially parallel to the first imaginary plane, the second header piece comprising second header piece protrusions aligned in the first direction and second header piece valleys aligned in the first direction, the first molding piece comprising first molding piece protrusions aligned in a second direction and first molding piece valleys aligned in the second direction, the second direction substantially parallel to the first imaginary plane, the second direction substantially perpendicular to the first direction, the second molding piece comprising second molding piece protrusions aligned in the second direction and second molding piece valleys aligned in the second direction, every cross-section of the first header piece defined along a first set of imaginary planes that are each perpendicular to the first imaginary plane is of substantially a same shape, every cross-section of the second header piece defined along a second set of imaginary planes that are each perpendicular to the first imaginary plane is of substantially a same shape, every cross-section of the first molding piece defined along a third set of imaginary planes that are each perpendicular to the first imaginary plane is of substantially a same shape, every cross-section of the second molding piece defined along the third set of imaginary planes is of substantially a same shape, a back side of the first header piece is substantially co-planar with the first imaginary plane, a back side of the second header piece is substantially co-planar with the first imaginary plane, a back side of the first molding piece is substantially co-planar with the first imaginary plane, a back side of the second molding piece is substantially co-planar with the first imaginary plane, the first plinth having a first plinth front side and a first plinth rear side, the first plinth rear side comprising a first plinth raised surface and a first plinth recessed surface, the first plinth raised surface is substantially flat and is substantially in the first imaginary plane, the first plinth recessed surface is recessed from the first imaginary plane, the first plinth recessed surface comprises first plinth protrusions and first plinth valleys, each first plinth valley recessed relative to at least one adjacent first plinth protrusion, the second plinth having a second plinth front side and a second plinth rear side, the second plinth rear side comprising a second plinth raised surface and a second plinth recessed surface, the second plinth raised surface is substantially flat and is substantially in the first imaginary plane, the second plinth recessed surface is recessed from the first imaginary plane, the second plinth recessed surface comprises second plinth protrusions and second plinth valleys, each second plinth valley recessed relative to at least one adjacent second plinth protrusion, the first header piece is slidably complementary to the header segment, and extremities of at least some of the first header piece protrusions are farther from the imaginary first plane than extremities of at least some adjacent header segment protrusions are, and extremities of at least some of the first header piece valleys are closer to the first imaginary plane than extremities of at least some adjacent header segment valleys are, the second header piece is slidably complementary to the header segment, and extremities of at least some of the second header piece protrusions are farther from the imaginary first plane than extremities of at least some adjacent header segment protrusions are, and extremities of at least some of the second header piece valleys are closer to the first imaginary plane than extremities of at least some adjacent header segment valleys are, the first molding piece is slidably complementary to the first header piece, the second molding piece is slidably complementary to the second header piece, the first molding piece is slidably complementary to the first plinth, and extremities of at least some of the first molding piece protrusions are farther from the imaginary first plane than extremities of at least some adjacent first plinth protrusions are, and extremities of at least some of the first molding piece valleys are closer to the first imaginary plane than extremities of at least some adjacent first plinth valleys are, the second molding piece is slidably complementary to the second plinth, and extremities of at least some of the second molding piece protrusions are farther from the imaginary first plane than extremities of at least some adjacent second plinth protrusions are, and extremities of at least some of the second molding piece valleys are closer to the first imaginary plane than extremities of at least some adjacent second plinth valleys are. The present invention also provides each of the components of a system according to this aspect, kits comprising the components of a system according to this aspect, methods of making such components, methods of making such kits, and methods of assembling such systems.

In some embodiments according to this aspect of the present invention, the header segment protrusions and header segment valleys extend from a first edge of the header segment to an opposite edge of the header segment, the first edge of the header segment spaced from the opposite edge of the header segment in the first direction.

In another aspect of the present invention, there is provided a method of making a plinth in accordance with the present invention, as described herein, comprising removing material from a starting structure, and/or molding material, to render the plinth.

In another aspect of the present invention, there is provided a method of making a corner piece in accordance with the present invention, as described herein, comprising removing material from a starting structure, and/or molding material, to render the corner piece.

In another aspect of the present invention, there is provided a method of making a package comprising at least a plinth and a molding piece, the method comprising:

making at least a first plinth by removing material from a starting structure and/or by molding material, and engaging at least the first plinth and at least a first molding piece with packaging.

In another aspect of the present invention, there is provided a method of making a kit comprising at least a plinth and a corner piece, the method comprising:

making at least a first plinth by removing material from a first starting structure and/or by molding material, and making at least a first corner piece by removing material from a second starting structure and/or by molding material.

In some embodiments in accordance with this aspect of the present invention, which can include or not include, as suitable, any of the other features described herein, the method further comprises engaging at least the first plinth and at least the first corner piece with packaging.

In some embodiments in accordance with this aspect of the present invention, which can include or not include, as suitable, any of the other features described herein, the method further comprises engaging at least the first plinth, at least the first corner piece and at least a first molding piece with packaging.

In another aspect of the present invention, there is provided a method of making a kit comprising first and second plinths, and first and second corner pieces, the method comprising:

making at least first and second plinths by removing material from at least a first starting structure and/or by molding material, and making at least first and second corner pieces by removing material from at least a second starting structure and/or by molding material.

In some embodiments in accordance with this aspect of the present invention, which can include or not include, as suitable, any of the other features described herein, the method further comprises engaging at least the first plinth, the first corner piece, the second corner piece and the second plinth with packaging.

In some embodiments in accordance with this aspect of the present invention, which can include or not include, as suitable, any of the other features described herein, the method further comprises engaging at least the first plinth, a first molding piece, the first corner piece, a header piece, the second corner piece, a second molding piece and the second plinth with packaging.

In another aspect of the present invention, there is provided a method of making a kit comprising at least a corner piece and a molding piece, the method comprising:

making at least a first corner piece by removing material from a starting structure and/or by molding material, and engaging at least the first corner piece and at least a first molding piece with packaging.

In another aspect of the present invention, there is provided a method of making a kit comprising first and second corner pieces, the method comprising:

making at least first and second corner pieces by removing material from at least a second starting structure and/or by molding material.

In some embodiments in accordance with this aspect of the present invention, which can include or not include, as suitable, any of the other features described herein, the method further comprises engaging at least the first corner piece and the second corner piece with packaging.

In some embodiments in accordance with this aspect of the present invention, which can include or not include, as suitable, any of the other features described herein, the method further comprises engaging at least a first molding piece, the first corner piece, a header piece, the second corner piece and a second molding piece with packaging.

In another aspect of the present invention, there is provided a method comprising:

positioning a plinth in accordance with the present invention, as described herein, relative to a molding piece that comprises aligned molding piece protrusions and aligned molding piece valleys, such that:

the molding piece protrusions and the molding piece valleys are aligned in a first direction, the first direction substantially parallel to the first imaginary plane, every cross-section of the molding piece defined along imaginary planes that are each parallel to the plinth structure first edge is of substantially a same shape, a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are, the molding piece is capable of being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement.

In some embodiments in accordance with this aspect of the present invention, which can include or not include, as suitable, any of the other features described herein, the method further comprises sliding the molding piece relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement.

In some embodiments in accordance with this aspect of the present invention, which can include or not include, as suitable, any of the other features described herein, the method further comprises:

inserting at least one connector through the plinth structure, and inserting at least one connector through the molding piece.

In another aspect of the present invention, there is provided a method comprising:

positioning a corner piece in accordance with the present invention, as described herein, relative to a molding piece that comprises aligned molding piece protrusions and aligned molding piece valleys, such that:

the molding piece protrusions and the molding piece valleys are aligned in a first direction, the first direction substantially parallel to the first imaginary plane, every cross-section of the molding piece defined along imaginary planes that are each parallel to the plinth structure first edge is of substantially a same shape, a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are, the molding piece is capable of being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement.

In some embodiments in accordance with this aspect of the present invention, which can include or not include, as suitable, any of the other features described herein, the method further comprises sliding the molding piece relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement.

In some embodiments in accordance with this aspect of the present invention, which can include or not include, as suitable, any of the other features described herein, the method further comprises:

inserting at least one connector through the molding piece, and inserting at least one connector through the corner piece.

In another aspect of the present invention, there is provided a method comprising:

positioning a plinth in accordance with the present invention, as described herein, relative to a molding piece that comprises aligned molding piece protrusions and aligned molding piece valleys, such that:

the molding piece protrusions and the molding piece valleys are aligned in a first direction, the first direction substantially parallel to the first imaginary plane, every cross-section of the molding piece defined along imaginary planes that are each parallel to the plinth structure first edge is of substantially a same shape, a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are, the molding piece is capable of being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement; and positioning a corner piece structure in a first position relative to the molding piece, the corner piece structure having at least a corner piece structure front side, a corner piece structure rear side, a corner piece structure first edge, a corner piece structure second edge, a corner piece structure third edge and a corner piece structure fourth edge, the corner piece structure rear side comprising at least one corner piece raised surface and at least a first corner piece recessed surface, each of the at least one corner piece raised surface is substantially flat and are each substantially co-planar with a first imaginary plane, the at least a first corner piece recessed surface is recessed from the first imaginary plane, the at least a first corner piece recessed surface comprising corner piece protrusions and corner piece valleys, each corner piece valley recessed relative to at least one adjacent corner piece protrusion, with the corner piece structure in the first position relative to the molding piece:

the molding piece protrusions and the molding piece valleys are aligned in a first direction, the first direction substantially parallel to the first imaginary plane, every cross-section of the molding piece defined along imaginary planes that are each parallel to the plinth structure first edge is of substantially a same shape, a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are, the molding piece is capable of being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement.

In some embodiments in accordance with this aspect of the present invention, which can include or not include, as suitable, any of the other features described herein, the method further comprises at least one of:

sliding the molding piece relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement, and sliding the molding piece relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement.

In some embodiments in accordance with this aspect of the present invention, which can include or not include, as suitable, any of the other features described herein, the method further comprises:

inserting at least one connector through the plinth, inserting at least one connector through the molding piece, and inserting at least one connector through the corner piece.

In another aspect of the present invention, there is provided a method comprising:

positioning a plinth in accordance with the present invention, as described herein, relative to a molding piece that comprises aligned molding piece protrusions and aligned molding piece valleys, such that:

(a) the molding piece protrusions and the molding piece valleys are aligned in a first direction, the first direction substantially parallel to the first imaginary plane, (b) every cross-section of the molding piece defined along imaginary planes that are each parallel to the plinth structure first edge is of substantially a same shape, (c) a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are, and (d) the molding piece is capable of being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement;

positioning a corner piece structure in a first position relative to the molding piece, the corner piece structure having at least a corner piece structure front side, a corner piece structure rear side, a corner piece structure first edge, a corner piece structure second edge, a corner piece structure third edge and a corner piece structure fourth edge, the corner piece structure rear side comprising at least one corner piece raised surface and at least a first corner piece recessed surface, each of the at least one corner piece raised surface is substantially flat and are each substantially co-planar with a first imaginary plane, the at least a first corner piece recessed surface is recessed from the first imaginary plane, the at least a first corner piece recessed surface comprising corner piece protrusions and corner piece valleys, each corner piece valley recessed relative to at least one adjacent corner piece protrusion, with the corner piece structure in the first position relative to the molding piece:

(a) the molding piece protrusions and the molding piece valleys are aligned in a first direction, the first direction substantially parallel to the first imaginary plane, (b) every cross-section of the molding piece defined along imaginary planes that are each parallel to the plinth structure first edge is of substantially a same shape, (c) a back side of the molding piece is substantially co-planar with the first imaginary plane, and extremities of at least some of the molding piece protrusions are farther from the imaginary first plane than extremities of at least some adjacent plinth protrusions are, and extremities of at least some of the molding piece valleys are closer to the first imaginary plane than extremities of at least some adjacent plinth valleys are, and (d) the molding piece is capable of being freely slid, relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement;

positioning a header piece that comprises header piece protrusions and header piece valleys relative to the corner piece such that:

(a) the header piece protrusions are aligned in the second direction and the header piece valleys are aligned in the second direction;

(b) every cross-section of the header piece defined along imaginary planes that are each parallel to the corner piece structure second edge is of substantially a same shape;

(c) in the header piece first position, a back side of the header piece is substantially co-planar with the first imaginary plane, and at least some extremities of the header piece protrusions are farther from the imaginary first plane than extremities of at least some adjacent corner piece protrusions are, and at least some extremities of the header piece valleys are closer to the first imaginary plane than extremities of at least some adjacent corner piece valleys are; and (d) the header piece is capable of being freely slid, relative to the corner piece, in a direction perpendicular to the corner piece structure second edge, such that at least some regions of the header piece protrusions pass at least some regions of the corner piece protrusions, with the back side of the header piece remaining substantially co-planar with the first imaginary plane during an entirety of such sliding movement, positioning a second corner piece structure in a second position relative to the header piece, the second corner piece structure having at least a second corner piece structure front side, a second corner piece structure rear side, a second corner piece structure first edge, a second corner piece structure second edge, a second corner piece structure third edge and a second corner piece structure fourth edge, the second corner piece structure rear side comprising at least one second corner piece raised surface and at least a one second corner piece recessed surface, the at least a one second corner piece recessed surface comprises a second corner piece first recessed surface, each of the at least one second corner piece raised surface is substantially flat and are each substantially co-planar with a first imaginary plane, the second corner piece first recessed surface is recessed from the first imaginary plane, the second corner piece first recessed surface comprises second corner piece protrusions and second corner piece valleys, each second corner piece valley recessed relative to at least one adjacent second corner piece protrusion, with the second corner piece structure in the second position relative to the header piece:

(a) a back side of the header piece is substantially co-planar with the first imaginary plane, and extremities of at least some of the header piece protrusions are farther from the imaginary first plane than extremities of at least some adjacent second corner piece protrusions are, and extremities of at least some of the header piece valleys are closer to the first imaginary plane than extremities of at least some adjacent second corner piece valleys are, and (b) the header piece is capable of being freely slid, relative to the second corner piece, in a direction perpendicular to the second corner piece structure first edge, such that at least some regions of the header piece protrusions pass at least some regions of the corner piece protrusions, with the back side of the header piece remaining substantially co-planar with the first imaginary plane during an entirety of such sliding movement, positioning a second molding piece that comprises aligned second molding piece protrusions and aligned second molding piece valleys relative to the second corner piece such that:

(a) the second molding piece protrusions and the second molding piece valleys are aligned in the first direction, (b) every cross-section of the second molding piece defined along imaginary planes that are each parallel to the second corner piece structure first edge is of substantially a same shape, (c) a back side of the second molding piece is substantially co-planar with the first imaginary plane, and extremities of at least some of the second molding piece protrusions are farther from the imaginary first plane than extremities of at least some adjacent second corner piece protrusions are, and extremities of at least some of the second molding piece valleys are closer to the first imaginary plane than extremities of at least some adjacent second corner piece valleys are, and (d) the second molding piece is capable of being freely slid, relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement;

positioning a second plinth in a second plinth position relative to the second molding piece, the second plinth comprising a second plinth structure having at least a second plinth structure front side, a second plinth structure rear side, a second plinth structure first edge, a second plinth structure second edge, a second plinth structure third edge and a second plinth structure fourth edge, the second plinth structure rear side comprising at least one second plinth raised surface and at least a one second plinth recessed surface, the at least one second plinth recessed surface comprising a second plinth first recessed surface, each of the at least one second plinth raised surface is substantially flat and are each substantially in a first imaginary plane, the second plinth first recessed surface is recessed from the first imaginary plane, the second plinth first recessed surface comprising second plinth protrusions and second plinth valleys, each second plinth valley recessed relative to at least one adjacent second plinth protrusion, with the second plinth in the second plinth position relative to the second molding piece:

the second molding piece is capable of being freely slid, relative to the second plinth structure, in a direction perpendicular to the second plinth structure first edge, such that at least some regions of the second molding piece protrusions pass at least some regions of the second plinth protrusions, with the back side of the second molding piece remaining substantially co-planar with the first imaginary plane during an entirety of such sliding movement.

In some embodiments in accordance with this aspect of the present invention, which can include or not include, as suitable, any of the other features described herein, the method further comprises at least one of:

sliding the molding piece relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement, sliding the molding piece relative to the corner piece, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement, sliding the header piece relative to the corner piece, in a direction perpendicular to the corner piece structure second edge, such that at least some regions of the header piece protrusions pass at least some regions of the corner piece protrusions, with the back side of the header piece remaining substantially co-planar with the first imaginary plane during an entirety of such sliding movement, sliding the header piece relative to the second corner piece, in a direction perpendicular to the second corner piece structure second edge, such that at least some regions of the second header piece protrusions pass at least some regions of the second corner piece protrusions, with the back side of the second header piece remaining substantially co-planar with the first imaginary plane during an entirety of such sliding movement, sliding the second molding piece relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement, and sliding the second molding piece relative to the second plinth structure, in a direction perpendicular to the second plinth structure first edge, such that at least some regions of the second molding piece protrusions pass at least some regions of the second plinth protrusions, with the back side of the second molding piece remaining substantially co-planar with the first imaginary plane during an entirety of such sliding movement.

In some embodiments in accordance with this aspect of the present invention, which can include or not include, as suitable, any of the other features described herein, the method further comprises:

inserting at least one connector through the plinth, inserting at least one connector through the molding piece, inserting at least one connector through the corner piece, inserting at least one connector through the header piece, inserting at least one connector through the second corner piece, inserting at least one connector through the second molding piece, and inserting at least one connector through the second plinth.

The expression "adjacent" is used herein to refer to a spatial relationship between a first structure and a second structure. Where the structures that are described as being "adjacent" to one another are similar, no other similar structure is positioned between the first structure and the second structure. Where a second structure is described as being "adjacent" to a first structure that is not similar to the first structure, no other structure that is similar to the second structure is positioned between the first structure and the second structure.

The expression "substantially parallel," as used herein in relation to two lines, means that the two lines do not diverge from each other by more than 5 degrees (i.e., the lines could be made parallel by tilting one of the lines by 5 degrees or less), in some cases not more than 2 degrees, and in some cases not more than 1 degree. The expression "substantially parallel," as used herein in relation to a line and a plane, means that the line does not diverge from the plane by more than 5 degrees (i.e., the line and the plane could be made parallel by tilting the line or the plane by 5 degrees or less), in some cases 2 degrees or less, and in some cases 1 degree or less. The expression "substantially parallel," as used herein in relation to two planes, means that the two planes do not diverge from each other by more than 5 degrees (i.e., the planes could be made parallel by tilting one of the planes by 5 degrees or less), in some cases 2 degrees or less, and in some cases 1 degree or less.

The expression "substantially perpendicular," as used herein in relation to a plane and a line, means that the line could be made perpendicular to the plane by tilting the line or the plane by not more than 5 degrees, in some cases not more than 2 degrees, and in some cases not more than 1 degree. The expression "substantially perpendicular," as used herein in relation to two planes, means that the planes could be made perpendicular by tilting one of the planes by not more than 5 degrees, in some cases not more than 2 degrees, and in some cases not more than 1 degree.

The expression "substantially flat" or "substantially planar" or "substantially flat and are each substantially in a first imaginary plane" means that at least 90% of the points in the surface that is characterized as being substantially flat (or substantially planar, or substantially flat and are each substantially in a first imaginary plane) are located on one of or between a pair of planes that are parallel and which are spaced from each other by a distance of not more than 5% (in some cases not more than 2%, in some cases not more than 1%, in some cases not more than 0.5%, and in some cases not more than 0.1%) of the largest dimension of the surface.

The expression "substantially co-planar", as used herein, in connection with a first surface and a second surface, means that:

at least 90% (in some cases at least 95%, in some cases at least 97%, and in some cases at least 99%) of the points in the first surface are located on one first surface plane or between a pair of first surface planes which are parallel and which are spaced from each other by a distance of not more than 5% (in some cases not more than 2%, and in some cases not more than 1%) of the largest dimension of the first surface;

at least 90% (in some cases at least 95%, in some cases at least 97%, and in some cases at least 99%) of the points in the second surface are located on one second surface plane or between a pair of second surface planes which are parallel and which are spaced from each other by a distance of not more than 5% (in some cases not more than 2%, and in some cases not more than 1%) of the largest dimension of the second surface; and the first surface plane or planes define an angle (or angles) of not more than 5 degrees (in some cases not more than 2 degrees, and in some cases not more than 1 degree) relative to the second surface plane or planes.

As reflected above, in many cases, expressions are used herein that include geometric terms and relationships, and those terms and relationships refer to features that approximate idealized geometric features. For example, the expression "a direction perpendicular to the corner piece second edge" does not imply that the corner piece second edge must be perfectly planar or linear, but instead refers to a direction that is perpendicular to a near fit (or the nearest fit) of a plane or line along the corner piece second edge.

Where an expression is defined herein in terms of the meaning of the expression in the singular, the definition applies also to the plural (and vice-versa, i.e., for an expression defined herein in the plural, the definition applies also to the singular). Definitions of one form of an expression apply to the same expression in a different form of the word or words.

The expression "comprises" or "comprising," as used herein, is used in accordance with its well known usage, and means that the item that "comprises" the recited elements (or that is "comprising" the recited elements) includes at least the recited elements, and can optionally include any additional elements. For example, an item that "comprises a corner piece structure" includes at least one corner piece structure, and it can include nothing else, or it can include one or more additional corner piece structure and/or one or more additional structures that is/are not a corner piece structure. An item that "comprises first and second plinths" can comprise a third plinth (or any number of additional plinths).

The expression "substantially the same shape", when referring to a first shape and a second shape (or when referring to a plurality of shapes), means that the first shape could be made to be identical to the second shape by removing from the first shape a specific region or regions which in total comprise not more than about 5 percent (in some cases not more than about 2 percent, and in some cases not more than about 1 percent) of its volume (or area) and/or by adding a specific region or regions which in total comprise not more than about 5 percent (in some cases not more than about 2 percent, and in some cases not more than about 1 percent) of its volume (or area). The expression "every cross-section of the molding piece defined along imaginary planes that are each parallel to the corner piece first edge is of substantially a same shape," as used herein, therefore means that each cross-sectional area in each imaginary plane could be made identical to a particular shape by removing not more than about 5 percent (in some cases not more than about 2 percent, and in some cases not more than about 1 percent) of its area and/or by adding area(s) totaling not more than about 5 percent (in some cases not more than about 2 percent, and in some cases not more than about 1 percent) of its area. Accordingly, recitation of a molding piece in which every cross-section of the molding piece defined along imaginary planes that are each parallel to the corner piece first edge is of substantially a same shape, would be satisfied by, for example, a piece of wooden molding that is 72-86 inches long×4-8 inches wide, in which ridges and valleys, curves and/or sharp edges, extend in parallel along the long dimension, e.g., made by pushing an elongated piece of wood linearly while milling a constant cross-section, or by extruding composite material through a die of the desired cross-section.

The shape of such cross-sections of molding pieces can be any desired shape. Likewise, the shape of cross-sections of header pieces can be any desired shape. Representative examples of shapes include those within families of patterns referred to as "colonial", "mission", "Federal", "Greek Revival", "Early American", "Georgian", etc.

The expression "capable of being freely slid," as used herein, means that the component that is capable of being freely slid relative to another component can be slid (i.e., moved such that each portion of the component moves in substantially the same direction, at substantially the same rate, over substantially the same distance) without having to break anything and without applying a large force, e.g., not exceeding 5 Newtons (in some cases not exceeding 2 Newtons, and in some cases not exceeding 1 Newton).

The expression "removable", as used herein, means that the element (e.g., a corner piece cover piece or a plinth cover piece) that is described as being removable can be removed (e.g., from a corner piece structure or a plinth structure) without severing any material or removing any component, e.g., by applying a small force (e.g., not exceeding 5 Newtons (in some cases not exceeding 2 Newtons, and in some cases not exceeding 1 Newton), e.g., by disengaging magnets (e.g., where one of a corner piece cover piece and a corner piece structure has one or more magnets and the other has one or more metal structures, or both have magnets) or by overcoming a tight fit (e.g., or one component has one or more protrusions that fit tightly into recesses in another component, etc.).

The expression "removably engaged" (e.g., in the expression "the first corner piece cover piece protrusion is removably engaged with the first corner piece recess") means that a first structure (i.e., a structure that is referred to as being removably engaged with a second structure) is inhibited from moving relative to a second structure, but a relatively force (e.g., a force of 50 Newtons or less, 25 Newtons or less, 10 Newtons or less, 5 Newtons or less, 2 Newtons or less, or 1 Newton or less) can be applied to the first structure relative to the second structure to remove the first structure from the second structure without severing, cracking or breaking any portion or portions of the first structure or the second structure.

A "protrusion" as described herein can generally be of any desired or suitable shape, e.g., it can be a generally cylindrical shape, a generally cylindrical shape with a rounded top, a generally conical shape, a generally conical shape with a rounded top, a dome shape, a ridge shape with a flat top, a ridge shape with a rounded top, a raised square shape, a raised square shape with two curved or sloped sides, a raised square shape with four curved or sloped sides, a raised rectangular shape, a raised rectangular shape with two curved or sloped sides, a raised rectangular shape with four curved or sloped sides, etc. An "extremity" of a protrusion is generally a portion of the protrusion that is the farthest in the direction of the protrusion, e.g., the farthest from an imaginary plane (or surface) away from which the protrusion extends.

A "valley" as described herein can generally be of any desired or suitable shape, e.g., it can be any non-raised region (or raised to a lesser degree than adjacent regions), e.g., it can be an isolated region or a groove, and it is adjacent to one or more protrusions of any shape or shapes, i.e., in at least some directions, the nearest significant change in topography, e.g., distance from an imaginary plane, is a protrusion or part of a protrusion. An "extremity" of a valley is generally a portion of the valley that is the farthest in the direction opposite from one or more protrusions, e.g., the closest to an imaginary plane (or surface) spaced from the protrusions, and away from which the protrusions extend.

The term "edge" is used herein to refer to a portion of a structure as would be viewed from one of six orthogonal views. In some instances, an "edge" would be a portion of a structure as would be view from an orthogonal view other than two major surfaces of the structure. Accordingly, in some cases, an edge is a substantially flat surface, while in others, an edge can be contoured, bumpy, non-rectilinear, etc. In some instances, a structure has two major surfaces, and four edges that each extend from one major surface to the other (the two major surfaces and the four edges making up six orthogonal views).

The expression "direction," as used herein, means something that geometrically corresponds to a ray. Two different rays that are parallel define the same "direction", e.g., a series of ridges that are parallel to each other each extend in the same direction (as well as in an opposite direction). For example, with respect to the embodiment depicted in FIG. 1, the expression "molding piece protrusions and molding piece valleys aligned in a first direction" means that the molding piece protrusions and the molding piece valleys are aligned in a first direction, e.g., they each extend vertically in an upward direction (and the also extend vertically in a downward direction, i.e., an opposite direction).

The expression "at least some," as used herein, encompasses only a single one (e.g., "at least some extremities of the molding piece protrusions" can refer to a plurality of extremities of the molding piece protrusions or to a single extremity of a molding piece protrusion).

Recitation that there is a "first" of something (e.g., "a first corner piece cover piece magnet") does not mean that there is necessarily a "second" of such an item.

As noted above, in some embodiments of the present invention, there are provided components (e.g., plinths and corner pieces), kits that comprise components, and systems that comprise components.

The components can be made of any suitable material or combinations of materials. For example, representative materials that can be used include wood (e.g., pine, cedar, oak, cherry, ash, poplar, etc.), composite (e.g., composite wood, reinforced plastics, such as fiberglass, ceramic matrix composites, metal matrix composites), plastic, metal, etc. In some embodiments, the components are substantially stiff, but in some cases, one or more components can be flexible.

The components can be of generally any desired size. In some embodiments, the components are configured to be used in systems for trimming doors, and so their size is selected based on the size of the door (e.g., 36" wide×80" tall, 32" wide×80" tall, 30" wide×80" tall, 24" wide×80" tall, or, in the case of double entry doors, sliding doors, double hung closet doors, etc., the size can be considerably different from the size of a standard entry door). In some embodiments, the components are configured to be used in systems for trimming windows, and so their size is likewise based on the size of the window(s), which can be any of a wide range of sizes. In any situation, the width of trim can be selected based on the space available, to cover gaps in framing, etc., and representative typical widths include 4 inches, 6 inches, 8 inches, etc.

In view of the above, representative (non-limiting) examples of dimensions of plinths include widths of 4 inches, 5 inches, 6 inches, 7 inches, 8 inches, 9 inches and 10 inches, and lengths of 4 inches, 5 inches, 6 inches, 7 inches, 8 inches, 9 inches and 10 inches.

In view of the above, representative (non-limiting) examples of dimensions of corner pieces include widths of 4 inches, 5 inches, 6 inches, 7 inches, 8 inches, 9 inches and 10 inches, and lengths of 4 inches, 5 inches, 6 inches, 7 inches, 8 inches, 9 inches and 10 inches. In some kits and systems, the width of the corner piece(s) is similar to the width of the plinth(s).

In view of the above, representative (non-limiting) examples of dimensions of molding pieces include widths of 4 inches, 5 inches, 6 inches, 7 inches, 8 inches, 9 inches and 10 inches, and lengths of 62 inches, 66 inches, 70 inches, 74 inches, 78 inches, 80 inches, 82 inches, 84 inches, 86 inches and 88 inches.

In view of the above, representative (non-limiting) examples of dimensions of header pieces include widths of 4 inches, 5 inches, 6 inches, 7 inches, 8 inches, 9 inches and 10 inches, and lengths of 24 inches, 30 inches, 32 inches, 36 inches, 40 inches, 44 inches, 48 inches, 52 inches, 56 inches, 60 inches, 64 inches, 68 inches, 72 inches, 76 inches, 80 inches, etc.

In some kits and systems, the length of a molding piece (or molding pieces) is selected such that (or the molding piece is cut such that) the sum of the length of the molding piece plus the length of the plinth plus the length of the corner piece is longer than the height of the item (e.g., a door) to be trimmed, but the amount that the length of the molding piece exceeds the height of the item to be trimmed is less than the sum of [1] the length that the plinth can overlap the molding piece and [2] the length that the corner piece can overlap the molding piece.

In some kits and systems, the length of a header piece is selected such that (or the header piece is cut such that) the sum of the length of the header piece plus the length of the two corner pieces is longer than the width of the item (e.g., a door) to be trimmed, but the amount that the length of the header piece exceeds the width of the item to be trimmed is less than the sum of [1] the length that the header piece can overlap the right corner piece and [2] the length that the header piece can overlap the left corner piece.

In accordance with an aspect of the present invention, by providing kits or systems in which components that are slidably complementary to one another can overlap to a large extent (e.g., 80 percent, 90 percent or 95 percent of the distance from one edge or one of the components to an opposite edge of that component), the components can accommodate doors, windows or other structures of a wider dimensional range (e.g., where each of two corner pieces are eight inches wide, and are slidably complementary relative to a header piece for a distance of seven inches across their respective widths, the system can accommodate doors that differ in width by fourteen inches (and likewise with respect to plinths and/or header segments. Such arrangements where the components are slidably complementary to a large extent also provides for more precise positioning of the components relative to one another.

In some situations, a region of a molding piece that is overlapped by a corner piece, and a region of a header piece that is overlapped by the same corner piece are configured such that they do not interfere with one another's placement (e.g., in some cases, the header piece is dimensioned, or is cut during installation, such that it does not protrude into the region overlapped by the corner piece beyond an imaginary plane defined by a door-facing edge of the molding piece; or the molding piece is dimensioned, or is cut during installation, such that it does not protrude into the region overlapped by the corner piece beyond an imaginary plane defined by a door-facing edge of the header piece; or the header piece and the molding piece are shaped, chamfered or otherwise cut so that they do not interfere with each other spatially.

As noted above, the present invention includes kits, systems and methods in which two or more components have respective regions whose topographies are slidably complementary. For example, as described above, in aspects of the present invention:

- a plinth structure is capable of being positioned such that it at least partially overlaps a molding piece, with at least a portion of a plinth recessed surface (or surfaces) slidably complementary to molding piece protrusions and molding piece valleys aligned in a first direction,
- a corner piece is capable of being positioned such that it at least partially overlaps a molding piece, with at least a portion of a corner piece recessed surface (or surfaces) slidably complementary to molding piece protrusions and molding piece valleys aligned in the first direction, and/or
- a corner piece is capable of being positioned such that it at least partially overlaps a header piece, with at least a portion of a corner piece recessed surface (or surfaces) slidably complementary to header piece protrusions and header piece valleys aligned in a direction perpendicular to the first direction.

As also noted above, the expression "slidably complementary" means that in any of a range of positions (to which a component can be slid), the elements snugly to each other (particularly an edge of a plinth, i.e., the upper edge upon being installed, or an edge of a corner piece, i.e., the lower edge relative to a molding piece upon being installed and a side edge facing another corner piece relative to a header piece upon being installed), such that there is very little space at any location along the exposed interface between the first and second trim components.

Representative examples of components that are slidably complementary include a plinth structure/molding piece combination, a corner piece/molding piece combination, or a corner piece/header piece combination in which the components are configured such that they are capable of being positioned such that in a cross-section in an imaginary plane defined by an edge of the corner piece, at least 90% (in some cases at least 95%, in some cases at least 97%, and in some cases at least 99%) of the points on the corner piece or the plinth are within 5 mm (in some cases within 4 mm, in some cases within 3 mm, in some cases within 2 mm, and in some cases within 1 mm) of at least one point on the molding piece or the header piece.

In some aspects of the present invention, there are provided kits that comprise packaging and methods of packaging. In relation to those aspects, any suitable or desired packaging can be provided. For example, packaging can cover any portion or portions of the components, e.g., packaging can comprise a strap or a loop (e.g., of plastic, twine, cardboard, etc.) the wraps around components; or packaging can cover four orthogonal sides of a plurality of components (i.e., two or more components); or packaging can cover four orthogonal sides of the components plus portions (e.g., perimeters) of the two other orthogonal sides of the components; or packaging can be a band engaged with or attached to the components (e.g., a substantially flat band that engages or is attached to respective single sides of the components, e.g., with adhesive, screws, staples, etc.), or such a band that is curled up after being attached to the components or as it is being attached to the components; or packaging can completely surround or substantially completely surround the components (e.g., plastic, cardboard, etc.).

Embodiments in accordance with the present inventive subject matter are described herein in detail in order to provide exact features of representative embodiments that are within the overall scope of the present inventive subject matter. The present inventive subject matter is not limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

FIG. 1 schematically depicts a front view of a portion of a front side of a house, showing an entry door 10 and a system of components installed as trim for the entry door 10. The system of components comprises a first plinth 11, a first molding piece 12, a first corner piece 13, a header piece 14, a second corner piece 15, a second molding piece 16 and a second plinth 17. In FIG. 1, the first molding piece 12 is centered relative to the first plinth 11 and the first corner piece 13 (with a region 97 showing between the first molding piece 12 and the right edge of the door 10). Similarly, the second molding piece 16 is centered relative to the second plinth 17 and the second corner piece 15 (with a region 98 showing between the second molding piece 16 and the left edge of the door 10), and the header piece 14 is centered relative to the first corner piece 13 and the second corner piece 15 (with a region 99 showing between the header piece 14 and the top edge of the door 10). FIG. 22 is similar to FIG. 1, except that the regions between the molding pieces and the edges of the doors are wider, and the region between the header piece and the top edge of the door is wider, as a result of there being a larger difference between the width of the molding pieces and the width of the plinths and the corner pieces.

Figure 2:
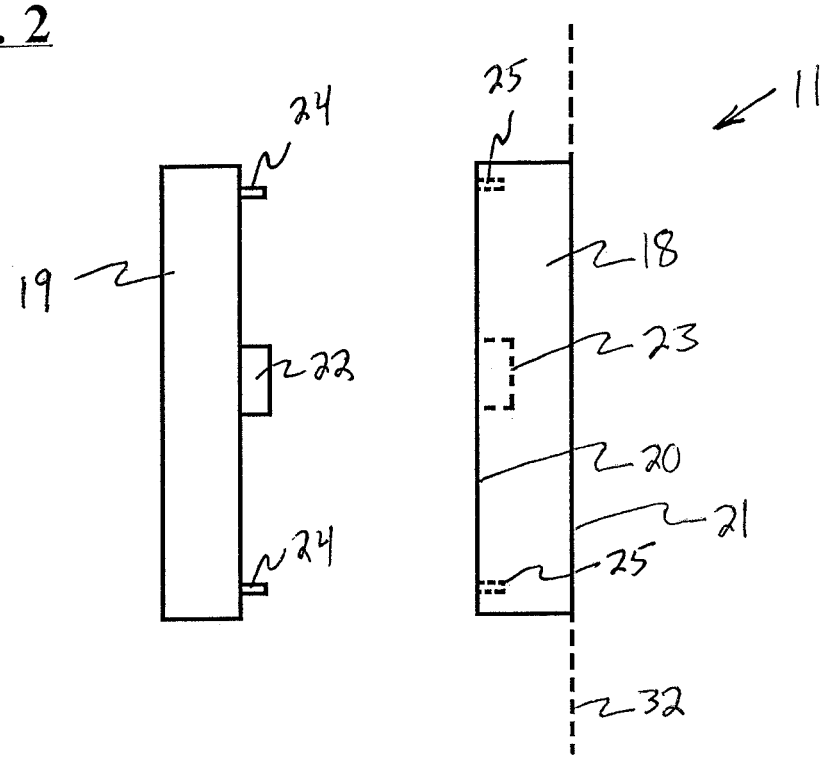

FIG. 2 schematically depicts an exploded side view of the first plinth 11. The first plinth 11 comprises a plinth structure 18 and a plinth cover piece 19. The plinth structure 18 comprises a plinth structure front side 20 and a plinth structure rear side 21.

The plinth cover piece 19 is removably engageable with the plinth structure 18, and it covers at least a portion (in this case, the entirety) of the plinth structure front side 20. In some other embodiments, the plinth cover piece covers less than all of the plinth structure front side, e.g., there can be provided a reveal of a substantially square annular shape around a perimeter of the plinth structure. The plinth structure front side 20 is substantially parallel to the plinth structure rear side 21 (in other embodiments, the respective sides can be of any topography, e.g., they can be complementary to provide (or enhance) indexing.

The plinth cover piece 19 comprises a plinth cover piece protrusion 22 that fits tightly in a plinth structure recess 23 (shown in dotted lines) in the plinth structure 18. The plinth cover piece protrusion 22 and the plinth structure recess 23 are configured such that the plinth cover piece protrusion 22 fits tightly in the plinth structure recess 23, such that the plinth cover piece 19 engages the plinth structure 18 and is held in place relative to the plinth structure 18.

The plinth cover piece 19 also comprises a plurality of additional plinth cover piece protrusions 24, and the plinth structure 18 comprises a plurality of additional plinth structure recesses 25 (shown in dotted lines). The plinth cover piece protrusions 24 and the plinth structure recesses 25 are configured and positioned such that with the plinth cover piece 19 engaged with the plinth structure 18, with the plinth cover piece 19 properly aligned with the plinth structure 18 (e.g., their respective analogous sides are substantially parallel) each of the plinth cover piece protrusions 24 is in a respective plinth structure recess 25, thereby providing indexing. In the embodiment shown in FIG. 2, each of the plinth cover piece protrusions 24 is near one of the four corners of the plinth cover piece 19.

The present invention encompasses embodiments that are similar to the embodiment shown in FIG. 2, except that protrusion/recess structures are of different sizes and/or positioning; and/or in which any of the protrusion/recess structures are modified such that the protrusion is on the plinth structure 18 and the recess is in the plinth cover piece 19; and/or where one or more protrusion/recess structure holds the plinth cover piece in place and also provides indexing (e.g., an arrangement that is similar to FIG. 2, except that it does not include the plinth cover piece protrusion 22 and the plinth structure recess 23, and in which the plinth cover piece protrusions 24 fit tightly in the plinth structure recesses 25.

Figure 3:
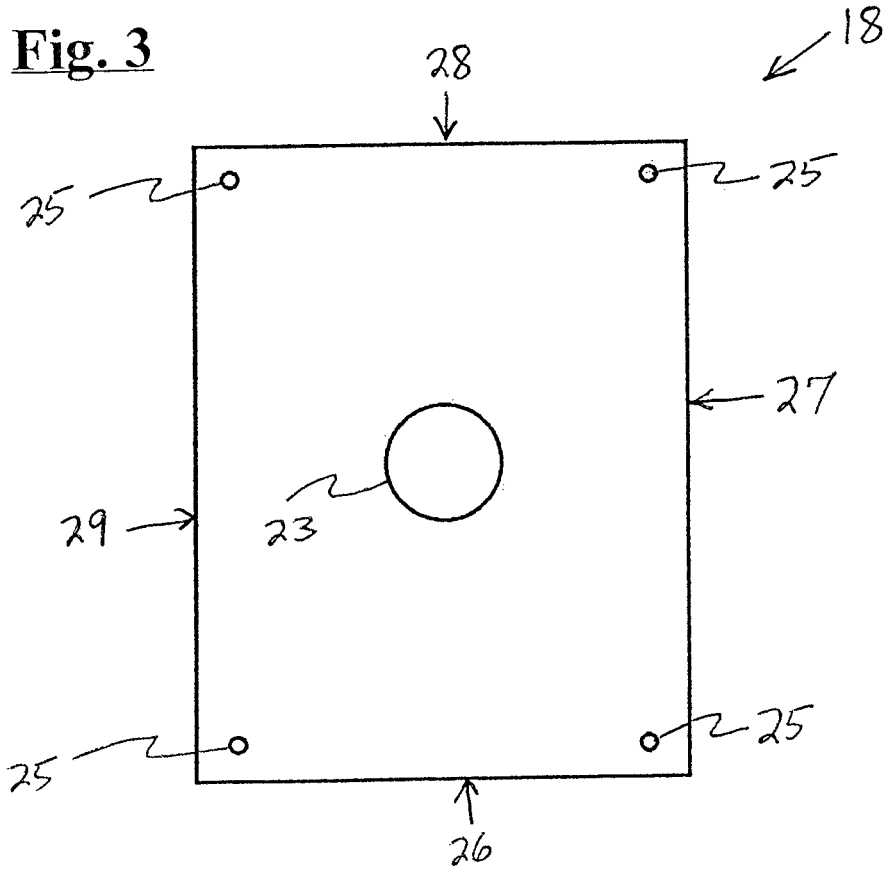

FIG. 3 schematically depicts a front view of the plinth structure 18. The plinth structure 18 comprises a plinth structure first edge 26, a plinth structure second edge 27, a plinth structure third edge 28 and a plinth structure fourth edge 29. As shown in FIG. 3, the plinth structure first edge 26 is substantially parallel to the plinth structure third edge 28, the plinth structure second edge 27 is substantially parallel to the plinth structure fourth edge 29, the plinth structure first edge 26 and the plinth structure third edge 28 are each substantially perpendicular to each of the plinth structure second edge 27 and the plinth structure fourth edge 29. FIG. 3 shows the plinth structure recesses 25 and the plinth structure recess 23.

Figure 4:
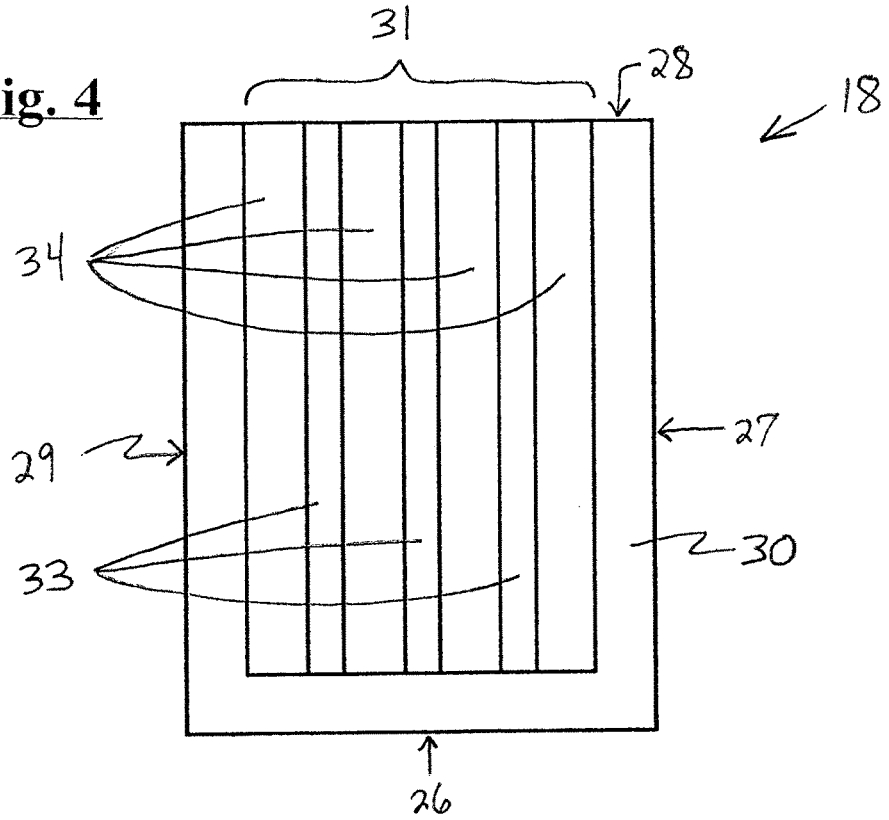

FIG. 4 schematically depicts a rear view of the plinth structure 18. As shown in FIG. 4, the plinth structure rear side 21 comprises a plinth raised surface 30 and a plinth recessed surface 31. The plinth raised surface 30 is substantially flat and is substantially in a first imaginary plane 32 (see FIG. 2). The plinth raised surface 30 comprises three sides of a rectangular annulus, and includes a portion located where the plinth structure first edge 26 meets the plinth structure second edge 27, a portion located where the plinth structure second edge 27 meets the plinth structure third edge 28, a portion located where the plinth structure third edge 28 meets the plinth structure fourth edge 29, and a portion where the plinth structure fourth edge 29 meets the plinth structure first edge 26.

The plinth structure front side 20 and the plinth structure rear side 21 are each substantially perpendicular to each of the plinth structure first edge 26, the plinth structure second edge 27, the plinth structure third edge 28 and the plinth structure fourth edge 29.

The plinth recessed surface 31 is recessed from the first imaginary plane 32. The plinth recessed surface 31 comprises plinth protrusions 33 and plinth valleys 34, each plinth valley 34 recessed relative to at least one adjacent plinth protrusion 33.

Figure 5:
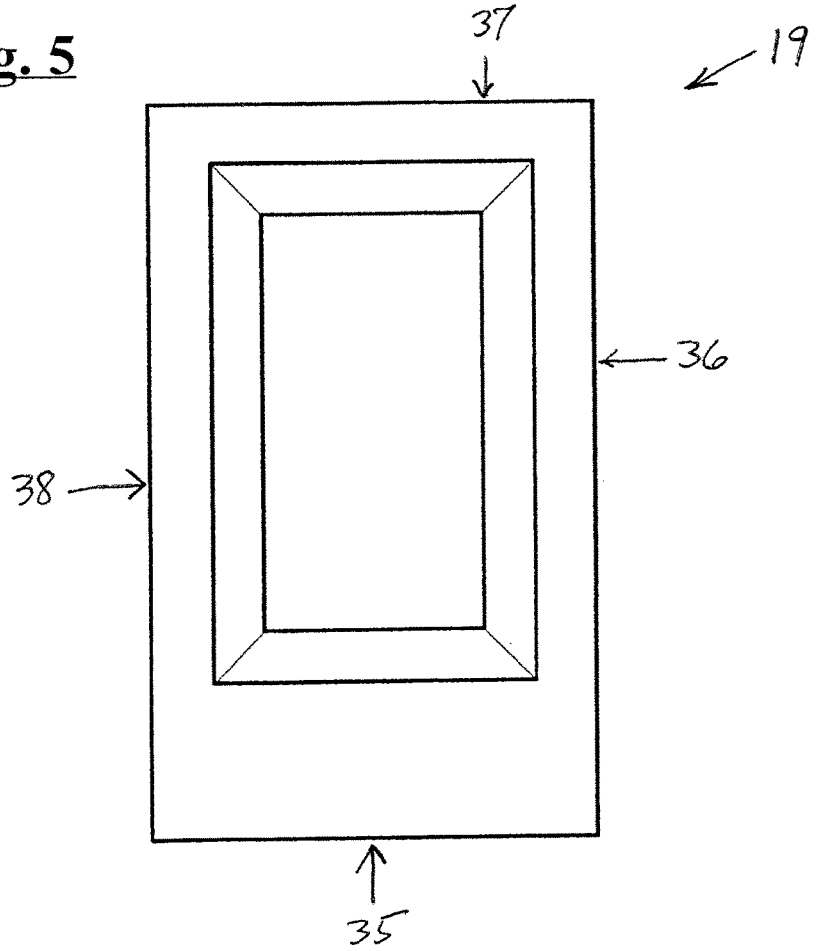

FIG. 5 schematically depicts a front view of the plinth cover piece 19. The plinth cover piece 19 comprises a plinth cover piece first edge 35, a plinth cover piece second edge 36, a plinth cover piece third edge 37 and a plinth cover piece fourth edge 38. The plinth cover piece first edge 35 is substantially parallel to the plinth structure first edge 26; the plinth cover piece second edge 36 is substantially parallel to the plinth structure second edge 27; the plinth cover piece third edge 37 is substantially parallel to the plinth structure third edge 28, and the plinth cover piece fourth edge 38 is substantially parallel to the plinth structure fourth edge 29. FIG. 5 shows a design on the front surface of the plinth cover piece 19. Any other desired design can be provided on the front surface of the plinth cover piece 19 (e.g., such design can comprise raised regions and recessed regions defined by linear borders, curved borders, jagged border, etc., and/or borders that include curved portions, linear portions, and/or jagged portions, etc.).

Figure 6:
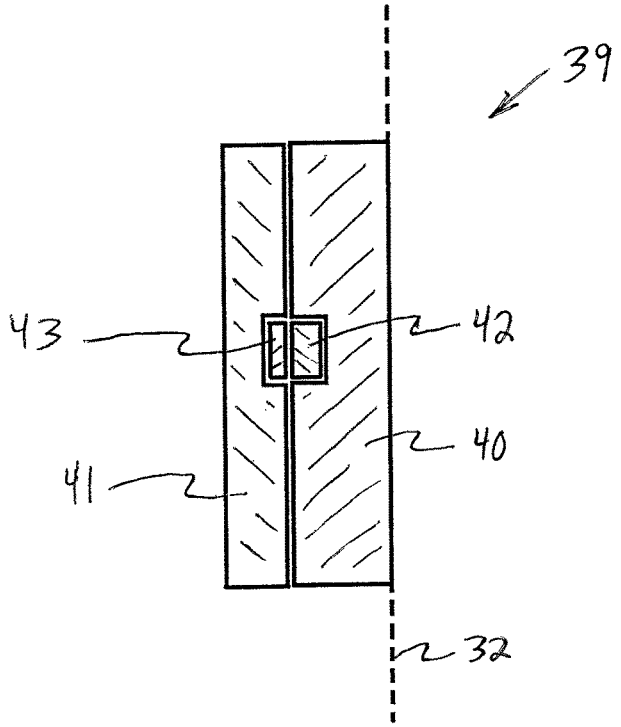
FIG. 6 is a schematic sectional view of an alternative embodiment of a plinth 39.

FIG. 6 is a schematic sectional view of an alternative embodiment of a plinth 39. The plinth 39 comprises a plinth structure 40 and a plinth cover piece 41. The plinth structure 40 comprises a plinth magnet 42, and the plinth cover piece 41 comprises a cover piece metal structure 43 that is magnetically attracted to the plinth magnet 42.

Figure 7:
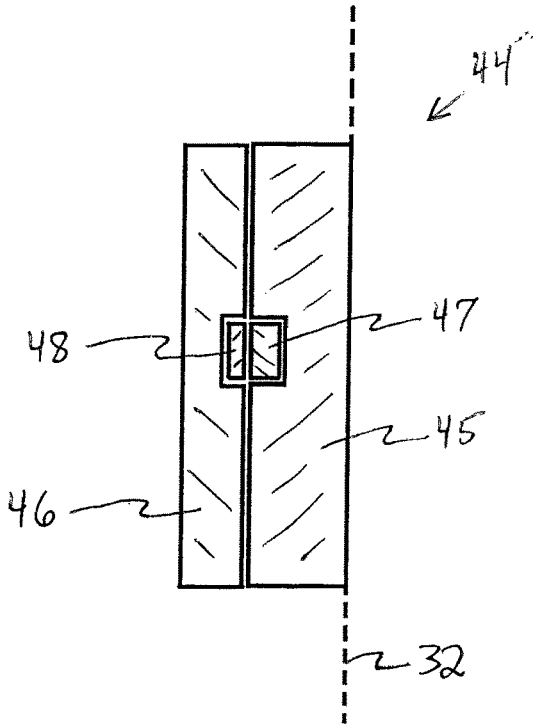
FIG. 7 is a schematic sectional view of an alternative embodiment of a plinth 44.

FIG. 7 is a schematic sectional view of an alternative embodiment of a plinth 44. The plinth 44 comprises a plinth structure 45 and a plinth cover piece 46. The plinth structure 45 comprises a plinth metal structure 47, and the plinth cover piece 46 comprises a cover piece magnet 48 to which the plinth metal structure 47 is magnetically attracted.

Figure 8:
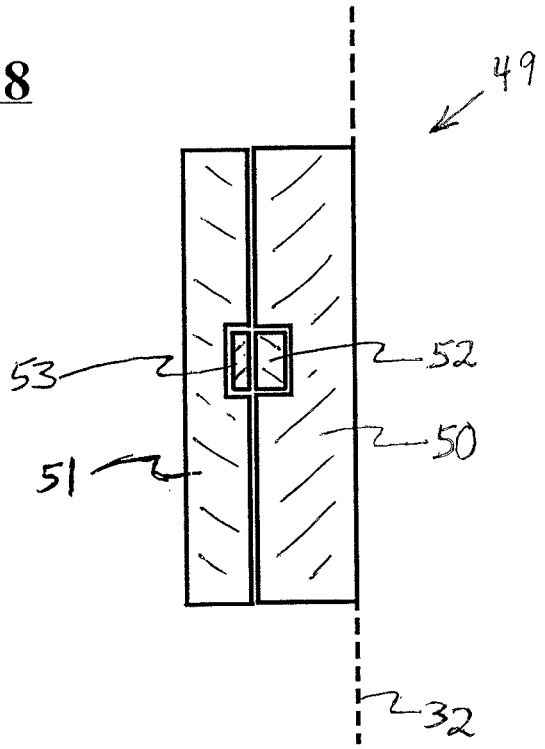
FIG. 8 is a schematic sectional view of an alternative embodiment of a plinth 49.

FIG. 8 is a schematic sectional view of an alternative embodiment of a plinth 49. The plinth 49 comprises a plinth structure 50 and a plinth cover piece 51. The plinth structure 50 comprises a plinth magnet 52, and the plinth cover piece 51 comprises a cover piece magnet 53 to which the plinth magnet 52 is magnetically attracted.

In any embodiment that comprises one or more magnets, the plinth cover piece can comprise a magnet or a metal structure that protrudes from the plinth cover piece and is received in a recess in the plinth structure, and/or the plinth structure can comprise a magnet or a metal structure that protrudes from the plinth structure and is received in a recess in the plinth cover piece.

Figure 9:
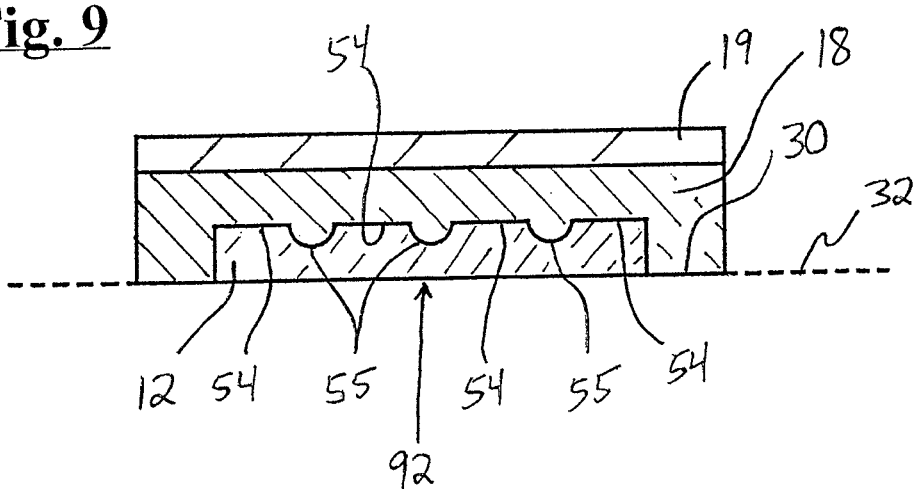
FIG. 9 is a schematic sectional view taken along the section IX-IX shown in FIG. 1.

FIG. 9 is a schematic sectional view taken along the section IX-IX shown in FIG. 1. Referring to FIG. 9, the molding piece 12 comprises molding piece protrusions 54 that are aligned in a vertical direction (i.e., vertical in FIG. 1), and molding piece valleys 55 that are also aligned in the vertical direction. A back side 92 of the molding piece 12 is substantially co-planar with the imaginary plane 32 (and also with the raised surface 30 of the plinth structure 18). The imaginary plane 32 is co-planar with the surface of the house to which the trim is attached. Extremities of at least some of the molding piece protrusions 54 are farther from the imaginary first plane 32 than extremities of at least some adjacent plinth protrusions 33 are, and extremities of at least some of the molding piece valleys 55 are closer to the first imaginary plane than extremities of at least some adjacent plinth valleys 34 are.

FIG. 10 schematically depicts an exploded side view of the first corner piece 13. The first corner piece comprises a corner piece structure 56 and a corner piece cover piece 57. The corner piece structure 56 comprises a corner piece structure front side 58 and a corner piece structure rear side 59. The corner piece cover piece 57 is removably engageable with the corner piece structure 56, and it covers at least a portion (in this case, the entirety) of the corner piece structure front side 58. In other cases, the corner piece cover piece covers less than all of the corner piece structure front side, e.g., there can be provided a reveal of a substantially square annular shape around a perimeter of the corner piece structure. The corner piece structure front side 58 is substantially parallel to the corner piece structure rear side 59.

The corner piece cover piece 57 comprises a corner piece cover piece protrusion 60 that fits tightly in a corner piece structure recess 61 (shown in dotted lines) in the corner piece structure 56. The corner piece cover piece protrusion 60 and the corner piece structure recess 61 are configured such that the corner piece cover piece protrusion 60 fits tightly in the corner piece structure recess 61, such that the corner piece cover piece 57 engages the corner piece structure 56 and is held in place relative to the corner piece structure 56.

The corner piece cover piece 57 also comprises a plurality of additional corner piece cover piece protrusions 62, and the corner piece structure 56 comprises a plurality of additional corner piece structure recesses 63 (shown in dotted lines). The corner piece cover piece protrusions 62 and the corner piece structure recesses 63 are configured and positioned such that with the corner piece cover piece 57 engaged with the corner piece structure 56, with the corner piece cover piece 57 properly aligned with the corner piece structure 56 (e.g., their respective analogous sides are substantially parallel) each of the corner piece cover piece protrusions 62 is in a respective corner piece structure recess 63, thereby providing indexing. In the embodiment shown in FIG. 10, each of the corner piece cover piece protrusions 62 is near one of the four corners of the corner piece cover piece 57.

The present invention encompasses embodiments that are similar to the embodiment shown in FIG. 10, except that protrusion/recess structures are of different sizes and/or positioning; and/or in which any of the protrusion/recess structures are modified such that the protrusion is on the corner piece structure 56 and the recess is in the corner piece cover piece 57; and/or where one or more protrusion/recess structure holds the corner piece cover piece in place and also provides indexing (e.g., an arrangement that is similar to FIG. 10, except that it does not include the corner piece cover piece protrusion 60 and the corner piece structure recess 61, and in which the corner piece cover piece protrusions 62 fit tightly in the corner piece structure recesses 63.

FIG. 11 schematically depicts a front view of the corner piece structure 56. The corner piece structure 56 comprises a corner piece structure first edge 64, a corner piece structure second edge 65, a corner piece structure third edge 66 and a corner piece structure fourth edge 67. As shown in FIG. 11, the corner piece structure first edge 64 is substantially parallel to the corner piece structure third edge 66, the corner piece structure second edge 65 is substantially parallel to the corner piece structure fourth edge 67, the corner piece structure first edge 64 and the corner piece structure third edge 66 are each substantially perpendicular to each of the corner piece structure second edge 65 and the corner piece structure fourth edge 67.

FIG. 12 schematically depicts a rear view of the corner piece structure 56. As shown in FIG. 12, the corner piece structure rear side 59 comprises corner piece raised surfaces 68 and 69, and a corner piece recessed surface 70. The corner piece raised surfaces 68 and 69 are substantially flat and are substantially in the first imaginary plane 32. The raised surface 68 includes a portion located where the corner piece structure third edge 66 meets the corner piece structure fourth edge 67, a portion where the corner piece structure fourth edge 67 meets the corner piece structure third edge 66, and a portion located where the corner piece structure first edge 64 meets the corner piece structure second edge 65. The raised surface 69 includes a portion located where the corner piece structure second edge 65 meets the corner piece structure first edge 64.

The corner piece structure front side 58 and the corner piece structure rear side 59 are each substantially perpendicular to each of the corner piece structure first edge 64, the corner piece structure second edge 65, the corner piece structure third edge 66 and the corner piece structure fourth edge 67.

The corner piece recessed surface 70 is recessed from the first imaginary plane 32. The corner piece recessed surface 70 comprises corner piece protrusions 71 and corner piece valleys 72, each corner piece valley 72 recessed relative to at least one adjacent corner piece protrusion 71.

FIG. 13 schematically depicts a front view of the corner piece cover piece 57. The corner piece cover piece 57 comprises a corner piece cover piece first edge 73, a corner piece cover piece second edge 74, a corner piece cover piece third edge 75 and a corner piece cover piece fourth edge 76. The corner piece cover piece first edge 73 is substantially parallel to the corner piece structure first edge 64; the corner piece cover piece second edge 74 is substantially parallel to the corner piece structure second edge 65; the corner piece cover piece third edge 75 is substantially parallel to the corner piece structure third edge 66, and the corner piece cover piece fourth edge 76 is substantially parallel to the corner piece structure fourth edge 67. FIG. 13 shows a design on the front surface of the corner piece cover piece 57. Any other desired design can be provided on the front surface of the corner piece cover piece 57 (e.g., such design can comprise raised regions and recessed regions defined by linear borders, curved borders, jagged border, etc., and/or borders that include curved portions, linear portions, and/or jagged portions, etc.

FIG. 14 is a schematic sectional view of an alternative embodiment of a corner piece 77. The corner piece 77 comprises a corner piece structure 78 and a corner piece cover piece 79. The corner piece structure 78 comprises a corner piece magnet 80, and the corner piece cover piece 79 comprises a cover piece metal structure 81 that is magnetically attracted to the corner piece magnet 80.

FIG. 15 is a schematic sectional view of an alternative embodiment of a corner piece 82. The corner piece 82 comprises a corner piece structure 83 and a corner piece cover piece 84. The corner piece structure 83 comprises a corner piece metal structure 85, and the corner piece cover piece 84 comprises a cover piece magnet 86 to which the corner piece metal structure 85 is magnetically attracted.

FIG. 16 is a schematic sectional view of an alternative embodiment of a corner piece 87. The corner piece 87 comprises a corner piece structure 88 and a corner piece cover piece 89. The corner piece structure 88 comprises a corner piece magnet 90, and the corner piece cover piece 89 comprises a cover piece magnet 91 to which the corner piece magnet 90 is magnetically attracted.

In any embodiment that comprises one or more magnets, the corner piece cover piece can comprise a magnet or a metal structure that protrudes from the corner piece cover piece and is received in a recess in the corner piece structure, and/or the corner piece structure can comprise a magnet or a metal structure that protrudes from the corner piece structure and is received in a recess in the corner piece cover piece.

FIG. 17 is a schematic sectional view taken along the section XVII-XVII shown in FIG. 1. FIG. 17 shows the molding piece 12, the molding piece protrusions 54 that are aligned in a vertical direction (i.e., vertical in FIG. 1), the molding piece valleys 55 that are also aligned in the vertical direction, and the back side 92 of the molding piece 12, the back side 92 being substantially co-planar with the imaginary plane 32 (and also with the raised surfaces 68 and 69 of the corner piece structure 92). The imaginary plane 32 is co-planar with the surface of the house to which the trim is attached. Extremities of at least some of the molding piece protrusions 54 are farther from the imaginary first plane 32 than extremities of at least some adjacent corner piece protrusions 71 are, and extremities of at least some of the molding piece valleys 55 are closer to the first imaginary plane than extremities of at least some adjacent corner piece valleys 72 are.

FIG. 18 is a schematic sectional view taken along the section XVIII-XVIII shown in FIG. 1. Referring to FIG. 18, the header piece 14 comprises header piece protrusions 94 that are aligned in a horizontal direction (i.e., horizontal in FIG. 1), and header piece valleys 93 that are also aligned in the horizontal direction. A back side 95 of the header piece 14 is substantially co-planar with the imaginary plane 32 (and also with the raised surfaces 68 and 69 of the corner piece structure 56). As noted above, the imaginary plane 32 is co-planar with the surface of the house to which the trim is attached. Extremities of at least some of the header piece protrusions 94 are farther from the imaginary first plane 32 than extremities of at least some adjacent corner piece protrusions 71 are, and extremities of at least some of the header piece valleys 93 are closer to the first imaginary plane than extremities of at least some adjacent corner piece valleys 72 are.

FIG. 19 is a front view of the first molding piece 12, showing the molding piece protrusions 54 that are aligned in the vertical direction, and the molding piece valleys 55 that are also aligned in the vertical direction.

FIG. 20 is a front view of the header piece 14, showing the header piece protrusions 94 that are aligned in the horizontal direction, and the header piece valleys 93 that are also aligned in the horizontal direction.

FIG. 21 is a schematic view of packaging 96, in which one or more components in accordance with the present invention enclosed.

The second plinth 17 is similar to the first plinth 11, and the second molding piece 16 is similar to the first molding piece 12.

The second corner piece 15 is a mirror image of the first corner piece 13.

By providing a kit or a system that comprises a first plinth structure, a first molding piece, a first corner piece structure, a header piece, a second corner piece structure, a second molding piece and a second plinth structure, in which (as in the embodiment depicted in FIG. 1):

- the first molding piece is slidably complementary to the first plinth structure,
- the header piece is slidably complementary to the first corner piece structure and to the second corner piece structure, and
- the second molding piece is slidably complementary to the second plinth structure, as described above, the system:

provides a large range of widths about which the system can be used as trim (i.e., by sliding the corner piece structures relative to the header piece), without the need to make any cuts, provides a large range of heights about which the system can be used as trim (i.e., by sliding the trim elements relative to the plinth structures), without the need to make any cuts, and hides from view and from exposure (e.g., rain) the ends of the molding pieces and the ends of the header piece, without the need for a header segment.

The ability for a system or kit to accommodate doors (and other structures) of a wide range of widths and heights without the need to make any cuts (and which hides ends of molding pieces and ends of header pieces from view and from exposure) is particularly pronounce where a first component (e.g., a molding piece or a header piece) is slidable complementarily relative to a second component (e.g., a corner piece structure or a plinth structure) for a distance that is a large percentage of the dimension of the second component in the direction of sliding.

FIG. 23 schematically depicts a front view of a portion of a front side of a house, showing an entry door 100 and a system of components installed as trim for the entry door 100. FIG. 24 is an exploded view of the components in the system depicted in FIG. 23. The system of components comprises a header segment 101, a first corner-forming molding element 102, a second corner-forming molding element 103, a first plinth 104 and a second plinth 105.

The header segment 101 has a header segment front side and a header segment rear side. The header segment rear side comprises at least one header segment raised surface and at least a first header segment recessed surface. The first header segment raised surface is substantially flat and is substantially co-planar with a first imaginary plane (which is defined by the wall 106). The first header segment recessed surface is recessed from the first imaginary plane. The first header segment recessed surface comprises header segment protrusions and header segment valleys, each header segment valley recessed relative to at least one adjacent header segment protrusion.

The first corner-forming molding element 102 has a first portion 107 and a second portion 108 (which are held together in relation to each other). The first portion 107 comprises first portion protrusions aligned in a first direction and first portion valleys aligned in the first direction, the first direction substantially horizontal in the orientation depicted in FIGS. 23 and 24, and parallel to the first imaginary plane. The second portion 108 comprises second portion protrusions aligned in a second direction and second portion valleys aligned in the second direction, the second direction substantially parallel to the first imaginary plane, the second direction substantially perpendicular to the first direction, and the second direction substantially vertical in the orientation depicted in FIGS. 23 and 24.

Every cross-section of the first portion 107 defined along a first set of imaginary planes that are each vertical and perpendicular to the first imaginary plane is of substantially the same shape.

Every cross-section of the second portion 108 defined along a second set of imaginary planes that are each horizontal and perpendicular to the first imaginary plane is of substantially the same shape.

A back side of the first corner-forming molding element 102 is substantially co-planar with the first imaginary plane.

The second corner-forming molding element 103 has a third portion 109 and a fourth portion 110. The third portion 109 comprises third portion protrusions aligned in the first direction and third portion valleys aligned in the first direction. The fourth portion 110 comprises fourth portion protrusions aligned in the second direction and fourth portion valleys aligned in the second direction, Every cross-section of the third portion 109 defined along a third set of imaginary planes that are each vertical and perpendicular to the first imaginary plane is of substantially the same shape.

Every cross-section of the fourth portion 110 defined along the second set of imaginary planes is of substantially the same shape, A back side of the second corner-forming molding element 103 is substantially co-planar with the first imaginary plane.

The first plinth 104 has a first plinth front side and a first plinth rear side. The first plinth rear side comprises a first plinth raised surface and a first plinth recessed surface. The first plinth raised surface is substantially flat and is substantially in the first imaginary plane. The first plinth recessed surface is recessed from the first imaginary plane. The first plinth recessed surface comprises first plinth protrusions and first plinth valleys, each first plinth valley recessed relative to at least one adjacent first plinth protrusion.

The second plinth 105 has a second plinth front side and a second plinth rear side. The second plinth rear side comprises a second plinth raised surface and a second plinth recessed surface. The second plinth raised surface is substantially flat and is substantially in the first imaginary plane. The second plinth recessed surface is recessed from the first imaginary plane. The second plinth recessed surface comprises second plinth protrusions and second plinth valleys, each second plinth valley recessed relative to at least one adjacent second plinth protrusion.

The first portion 107 is slidably complementary to the header segment 101, and extremities of at least some of the first portion protrusions are farther from the imaginary first plane than extremities of at least some adjacent header segment protrusions are, and extremities of at least some of the first portion valleys are closer to the first imaginary plane than extremities of at least some adjacent header segment valleys are.

The second portion 108 is slidably complementary to the first plinth 104, and extremities of at least some of the second portion protrusions are farther from the imaginary first plane than extremities of at least some adjacent first plinth protrusions are, and extremities of at least some of the second portion valleys are closer to the first imaginary plane than extremities of at least some adjacent first plinth valleys are.

The third portion 109 is slidably complementary to the header segment 101, and extremities of at least some of the third portion protrusions are farther from the imaginary first plane than extremities of at least some adjacent header segment protrusions are, and extremities of at least some of the third portion valleys are closer to the first imaginary plane than extremities of at least some adjacent header segment valleys are.

The fourth portion 110 is slidably complementary to the second plinth 105, and extremities of at least some of the fourth portion protrusions are farther from the imaginary first plane than extremities of at least some adjacent second plinth protrusions are, and extremities of at least some of the fourth portion valleys are closer to the first imaginary plane than extremities of at least some adjacent second plinth valleys are.

In this embodiment, the header segment protrusions and header segment valleys extend from a first edge of the header segment 101 to an opposite edge of the header segment 101 (i.e., from one of the non-horizontal edges of the header segment 101 to the other non-horizontal edge of the header segment 101), and the first edge of the header segment is spaced from the opposite edge of the header segment in the first direction.

FIG. 25 schematically depicts a front view of a portion of a front side of a house, showing an entry door 111 and a system of components installed as trim for the entry door 111. FIG. 26 is an exploded view of the components in the system depicted in FIG. 25. The system of components comprises a header segment 112, a first header piece 113, a first molding piece 114, a first plinth 115, a second header piece 116, a second molding piece 117 and a second plinth 118.

The header segment 112 has a header segment front side and a header segment rear side. The header segment rear side comprising at least one header segment raised surface and at least a first header segment recessed surface. The first header segment raised surface is substantially flat and is substantially co-planar with a first imaginary plane (defined by the wall 119. The first header segment recessed surface is recessed from the first imaginary plane. The first header segment recessed surface comprises header segment protrusions and header segment valleys, each header segment valley recessed relative to at least one adjacent header segment protrusion, The first header piece 113 comprises first header piece protrusions aligned in a first direction and first header piece valleys aligned in the first direction, the first direction substantially horizontal in the orientation depicted in FIGS. 25 and 26, and parallel to the first imaginary plane.

The second header piece 116 comprises second header piece protrusions aligned in the first direction and second header piece valleys aligned in the first direction.

The first molding piece 114 comprises first molding piece protrusions aligned in a second direction and first molding piece valleys aligned in the second direction, the second direction substantially parallel to the first imaginary plane, the second direction substantially vertical in the orientation depicted in FIGS. 25 and 26, and perpendicular to the first direction.

The second molding piece 117 comprises second molding piece protrusions aligned in the second direction and second molding piece valleys aligned in the second direction, Every cross-section of the first header piece 113 defined along a first set of imaginary planes that are each vertical and perpendicular to the first imaginary plane is of substantially the same shape.

Every cross-section of the second header piece 114 defined along a second set of imaginary planes that are each vertical and perpendicular to the first imaginary plane is of substantially the same shape.

Every cross-section of the first molding piece 114 defined along a third set of imaginary planes that are each horizontal and perpendicular to the first imaginary plane is of substantially the same shape.

Every cross-section of the second molding piece 117 defined along the third set of imaginary planes is of substantially the same shape.

A back side of the first header piece 113 is substantially co-planar with the first imaginary plane.

A back side of the second header piece 114 is substantially co-planar with the first imaginary plane.

A back side of the first molding piece 114 is substantially co-planar with the first imaginary plane.

A back side of the second molding piece 117 is substantially co-planar with the first imaginary plane.

The first plinth 115 has a first plinth front side and a first plinth rear side. The first plinth rear side comprises a first plinth raised surface and a first plinth recessed surface. The first plinth raised surface is substantially flat and is substantially in the first imaginary plane. The first plinth recessed surface is recessed from the first imaginary plane. The first plinth recessed surface comprises first plinth protrusions and first plinth valleys, each first plinth valley recessed relative to at least one adjacent first plinth protrusion.

The second plinth 118 has a second plinth front side and a second plinth rear side. The second plinth rear side comprises a second plinth raised surface and a second plinth recessed surface. The second plinth raised surface is substantially flat and is substantially in the first imaginary plane. The second plinth recessed surface is recessed from the first imaginary plane. The second plinth recessed surface comprises second plinth protrusions and second plinth valleys, each second plinth valley recessed relative to at least one adjacent second plinth protrusion.

The first header piece 113 is slidably complementary to the header segment 112, and extremities of at least some of the first header piece protrusions are farther from the imaginary first plane than extremities of at least some adjacent header segment protrusions are, and extremities of at least some of the first header piece valleys are closer to the first imaginary plane than extremities of at least some adjacent header segment valleys are.

The second header piece 116 is slidably complementary to the header segment 112, and extremities of at least some of the second header piece protrusions are farther from the imaginary first plane than extremities of at least some adjacent header segment protrusions are, and extremities of at least some of the second header piece valleys are closer to the first imaginary plane than extremities of at least some adjacent header segment valleys are.

The first molding piece 114 is slidably complementary to the first header piece 113.

The second molding piece 117 is slidably complementary to the second header piece 116.

The first molding piece 114 is slidably complementary to the first plinth 115, and extremities of at least some of the first molding piece protrusions are farther from the imaginary first plane than extremities of at least some adjacent first plinth protrusions are, and extremities of at least some of the first molding piece valleys are closer to the first imaginary plane than extremities of at least some adjacent first plinth valleys are.

The second molding piece 117 is slidably complementary to the second plinth 118, and extremities of at least some of the second molding piece protrusions are farther from the imaginary first plane than extremities of at least some adjacent second plinth protrusions are, and extremities of at least some of the second molding piece valleys are closer to the first imaginary plane than extremities of at least some adjacent second plinth valleys are.

In this embodiment, the header segment protrusions and header segment valleys extend from a first edge of the header segment 112 to an opposite edge of the header segment 112 (i.e., from one of the non-horizontal edges of the header segment 112 to the other non-horizontal edge of the header segment 112), and the first edge of the header segment is spaced from the opposite edge of the header segment in the first direction.

FIG. 27 schematically depicts a front view of a portion of a front side of a house, showing an entry door 119 and a system of components installed as trim for the entry door 119. FIG. 28 is an exploded view of the components in the system depicted in FIG. 27. The system of components comprises a header segment 120, a first header piece 121, a first molding piece 122, a first plinth 123, a second header piece 124, a second molding piece 125 and a second plinth 126. The system depicted in FIGS. 27 and 28 is similar to the system depicted in FIGS. 25 and 26, except that the respective front faces of the header pieces differ. In particular, in the system depicted in FIGS. 27 and 28, the front faces of the header pieces 121 and 124 have protrusions and valleys that meet at a diagonal seam, providing the appearance of a mitred corner.

In many instances, doorways (and other structures) are defined by a frame that extends around the door (or other structure). For example, FIG. 29 depicts a door 127 hinge-mounted to a metal frame 128. In many instances, e.g., in commercial buildings, doorways are defined by a metal frame that extends around the door (or other structure). In the arrangement depicted in FIG. 29, as in many commercial buildings, the front surface 129 of the metal frame 128 (i.e., the surface facing the viewer) protrudes about ½ inch from the wall 128 (i.e., the front surface 129 is ½ inch closer to the viewer than the wall 128 is. The present invention also provides any of the components described above (and kits, systems and methods involving such components), in which the component have been modified to accommodate a frame, by providing two or more frame-accommodating surfaces. For example, FIG. 30 schematically depicts a rear view of a plinth 130. The plinth 130 comprises a raised surface 131 and two frame-accommodating surfaces 132 and 133. The frame-accommodating surface 132 is substantially parallel to the plane of the drawing and to the raised surface 131, and the frame-accommodating surface 133 is substantially vertical and perpendicular to the plane of the drawing, and it extends from the raised surface 131 to the frame-accommodating surface 132. The raised surface 131 is about ½ inch closer to the viewer than the frame-accommodating surface 132 is.

FIG. 31 is a schematic sectional view of the plinth 130, a molding piece 134 and a metal frame 140, taken along a section analogous to section IX-IX in FIG. 1. The plinth 130 comprises a plinth structure 135 and a plinth cover piece 136. The molding piece 134 comprises two frame-accommodating surfaces 137 and 138, and a back surface 139. The frame-accommodating surface 137 is substantially parallel to the plane of the drawing and it is substantially co-planar to the frame-accommodating surface 132 of the plinth structure 135. The frame-accommodating surface 138 is substantially vertical and perpendicular to the plane of the drawing, and it extends from the back surface 139 to the frame-accommodating surface 137. The raised surface 131 and the back surface 139 are about ½ inch lower (in the orientation depicted in FIG. 31) than the frame-accommodating surface 132 and the frame-accommodating surface 137 are. The metal frame 140 is partially accommodated in the space defined by the frame-accommodating surfaces 132, 137 and 138. In other embodiments, a metal frame is substantially completely accommodated in the space defined by the frame-accommodating surfaces.

FIG. 32 schematically depicts a rear view of a corner piece structure 141. The corner piece structure 141 is similar to the corner piece structure 56, except that in the corner piece structure 141, the rear side comprises a raised surface 142 and a frame-accommodating surface 143, the frame-accommodating surface 143 is substantially parallel to the raised surface 142, and the frame-accommodating surface 143 is recessed relative to the raised surface 142 (i.e., the raised surface 142 is closer to the viewer in the orientation depicted in FIG. 32). In some embodiments, the raised surface 142 is about ½ inch closer to the viewer than the frame-accommodating surface 143 is, in the orientation depicted in FIG. 32.

Many alterations and modifications may be made by those having ordinary skill in the art, given the benefit of the present disclosure, without departing from the spirit and scope of the inventive subject matter.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

The invention claimed is:

1. A system comprising:

a first corner piece;

a first molding piece; and a first plinth structure, wherein:

the first corner piece comprises a first corner piece structure having at least a first corner piece structure front side, a first corner piece structure rear side, a first corner piece structure first edge, a first corner piece structure second edge, a first corner piece structure third edge and a first corner piece structure fourth edge, the first corner piece structure rear side comprises a plurality of first corner piece raised surfaces and at least a first corner piece first recessed surface, the first corner piece raised surfaces are each substantially flat and are each substantially co-planar with a first imaginary plane, the at least a first corner piece first recessed surface is recessed from the first imaginary plane, the at least a first corner piece first recessed surface comprises a plurality of first corner piece protrusions and a plurality of first corner piece valleys, each of the first corner piece valleys recessed relative to at least one of the first corner piece protrusions, each of the first corner piece protrusions comprising a respective extremity of the first corner piece protrusions, each of the first corner piece valleys comprising a respective extremity of the first corner piece valley, each of the at least a first corner piece first recessed surface is configured such that:

(1) with the first corner piece structure in a first corner piece first position, a molding piece comprising a plurality of molding piece protrusions and a plurality of molding piece valleys, each of the molding piece protrusions comprising a respective extremity of the molding piece protrusion, each of the molding piece protrusions aligned in a first direction, each of the molding piece valleys comprising a respective extremity of the molding piece valley, each of the molding piece valleys aligned in the first direction, the first direction substantially parallel to the first imaginary plane, is capable of being positioned in a molding piece first position relative to the first corner piece structure such that:

(a) every cross-section of the molding piece defined along imaginary planes that are each parallel to the first corner piece structure first edge is of substantially a same molding piece cross-sectional shape;

(b) in the molding piece first position, a back side of the molding piece is substantially co-planar with the first imaginary plane, and at least some of the extremities of the molding piece protrusions are farther from the first imaginary plane than the extremities of at least some of the corner piece protrusions are, and at least some of the extremities of the molding piece valleys are closer to the first imaginary plane than the extremities of at least some of the first corner piece valleys are;

(c) from the molding piece first position, the molding piece is capable of being freely slid, relative to the corner piece structure, in a direction perpendicular to the first corner piece structure first edge, such that at least some regions of the molding piece protrusions pass at least some regions of the first corner piece protrusions, with the back side of the molding piece remaining substantially co-planar with the first imaginary plane during an entirety of such sliding movement, and (2) with the first corner piece in the first corner piece first position, a header piece comprising a plurality of header piece protrusions and a plurality of header piece valleys, each of the header piece protrusions comprising a respective extremity of the header piece protrusion, each of the header piece protrusion aligned in a second direction, each of the header piece valleys comprising a respective extremity of the header piece valley, each of the header piece valleys aligned in the second direction, the second direction substantially parallel to the first imaginary plane and substantially perpendicular to the first direction, is capable of being positioned in a header piece first position relative to the first corner piece structure such that:

(a) every cross-section of the header piece defined along imaginary planes that are each parallel to the first corner piece structure second edge is of substantially a same header piece cross-sectional shape;

(b) in the header piece first position, a back side of the header piece is substantially co-planar with the first imaginary plane, and at least some of the extremities of the header piece protrusions are farther from the imaginary first plane than the extremities of at least some of the first corner piece protrusions are, and at least some of the extremities of the header piece valleys are closer to the first imaginary plane than the extremities of at least some of the first corner piece valleys are; and (c) from the header piece first position, the header piece is capable of being freely slid, relative to the first corner piece structure, in a direction perpendicular to the first corner piece structure second edge, such that at least some regions of the header piece protrusions pass at least some regions of the first corner piece protrusions, with the back side of the header piece remaining substantially co-planar with the first imaginary plane during an entirety of such sliding movement, the first molding piece comprises a plurality of first molding piece protrusions aligned in a first direction and a plurality of first molding piece valleys aligned in the first direction, each of the first molding piece protrusions comprising a respective extremity of the first molding piece protrusion, each of the first molding piece valleys comprising a respective extremity of the first molding piece valley, the first direction substantially parallel to the first imaginary plane, the first molding piece protrusions are aligned in the first direction and the first molding piece valleys are aligned in the first direction, every cross-section of the first molding piece defined along imaginary planes that are each parallel to the first corner piece structure first edge is of substantially a same first molding piece cross-sectional shape, a back side of the first molding piece is substantially co-planar with the first imaginary plane, and at least some of the extremities of the first molding piece protrusions are farther from the imaginary first plane than the extremities of at least some of the first corner piece protrusions are, and at least some of the extremities of the first molding piece valleys are closer to the first imaginary plane than the extremities of at least some of the first corner piece valleys are, the first plinth structure has at least a first plinth structure front side, a first plinth structure rear side, a first plinth structure first edge, a first plinth structure second edge, a first plinth structure third edge and a first plinth structure fourth edge, the first plinth structure rear side comprises at least one first plinth raised surface and at least a first plinth first recessed surface, each of the at least one first plinth raised surface is substantially flat, the at least a first plinth first recessed surface is recessed from the first imaginary plane, the at least a first plinth first recessed surface comprises a plurality of first plinth protrusions and a plurality of first plinth valleys, each of the first plinth valleys recessed relative to at least one of the first plinth protrusions, the first plinth structure first edge is substantially parallel to the first corner piece structure first edge, each of the at least one first plinth raised surface is substantially co-planar with the first imaginary plane, the extremities of at least some of the first molding piece protrusions are farther from the imaginary first plane than the extremities of at least some of the first plinth protrusions are, and the extremities of at least some of the first molding piece valleys are closer to the first imaginary plane than the extremities of at least some of the first plinth valleys are.

2. The system as recited in claim 1, wherein:

at least a portion of the first plinth structure overlaps a portion of the first molding piece in a dimension aligned with the first direction; and at least a portion of the first corner piece overlaps a portion of the first molding piece in a dimension aligned with the first direction.

3. The system as recited in claim 1, wherein:

nothing in the first corner piece or the first molding piece prevents the first molding piece from being freely slid, relative to the first corner piece, in a direction perpendicular to the first corner piece structure first edge, such that at least some regions of the first molding piece protrusions pass at least some regions of the first corner piece protrusions, with the back side of the first molding piece remaining substantially co-planar with the first imaginary plane during an entirety of such sliding movement, and nothing in the first plinth structure or the first molding piece prevents the first molding piece from being freely slid, relative to the first plinth structure, in a direction perpendicular to the first plinth structure first edge, such that at least some regions of the first molding piece protrusions pass at least some regions of the first plinth structure, with the back side of the first molding piece remaining substantially co-planar with the first imaginary plane during such sliding movement.

4. A system as recited in claim 1, wherein:

the system further comprises a header piece, a second corner piece, a second molding piece and a second plinth structure, the header piece comprises a plurality of header piece protrusions and a plurality of header piece valleys, each of the header piece protrusions comprising a respective extremity of the header piece protrusion, each of the header piece valleys comprising a respective extremity of the header piece valley, the header piece protrusions are aligned in the second direction and the header piece valleys are aligned in the second direction, every cross-section of the header piece defined along imaginary planes that are each parallel to the first corner piece structure second edge is of substantially a same header piece cross-sectional shape, a back side of the header piece is substantially co-planar with the first imaginary plane, and at least some of the extremities of the header piece protrusions are farther from the imaginary first plane than the extremities of at least some of the first corner piece protrusions are, and at least some of the extremities of the first header piece valleys are closer to the first imaginary plane than the extremities of at least some of the first corner piece valleys are, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises a plurality of second corner piece protrusions and a plurality of second corner piece valleys, each of the second corner piece protrusions comprising a respective extremity of the second corner piece protrusion, each of the second corner piece valleys comprising a respective extremity of the second corner piece valley, each of the second corner piece valleys recessed relative to at least one of the second corner piece protrusions, the at least one second corner piece recessed surface comprises a second corner piece first recessed surface, the second corner piece first recessed surface is recessed from the first imaginary plane, the second corner piece structure first edge and the second corner piece structure third edge are each substantially parallel to the first corner piece structure first edge and the first corner piece structure third edge, the second corner piece structure second edge and the second corner piece structure fourth edge are each substantially parallel to the first corner piece structure second edge and the first corner piece structure fourth edge, each of the at least one second corner piece raised surface is substantially co-planar with the first imaginary plane, at least some of the extremities of the header piece protrusions are farther from the imaginary first plane than the extremities of at least some of the second corner piece protrusions are, and at least some of the extremities of the header piece valleys are closer to the first imaginary plane than the extremities of at least some of the second corner piece valleys are, the second molding piece comprises a plurality of second molding piece protrusions and a plurality of second molding piece valleys, each of the second molding piece protrusions comprising a respective extremity of the second molding piece protrusion, each of the second molding piece valleys comprising a respective extremity of the second molding piece valley, the second molding piece protrusions are aligned in the first direction and the molding piece valleys are aligned in the first direction, every cross-section of the second molding piece defined along imaginary planes that are each parallel to the second corner piece structure first edge is of substantially a same second molding piece cross-sectional shape, a back side of the second molding piece is substantially co-planar with the first imaginary plane, and at least some of the extremities of the second molding piece protrusions are farther from the imaginary first plane than the extremities of at least some of the second corner piece protrusions are, and at least some of the extremities of the second molding piece valleys are closer to the first imaginary plane than the extremities of at least some of the second corner piece valleys are, the second plinth structure has at least a second plinth structure front side, a second plinth structure rear side, a second plinth structure first edge, a second plinth structure second edge, a second plinth structure third edge and a second plinth structure fourth edge, the second plinth structure rear side comprises at least one second plinth raised surface and at least a one second plinth recessed surface, the at least one second plinth recessed surface comprising a second plinth first recessed surface, each of the at least one second plinth raised surface is substantially flat, the second plinth first recessed surface is recessed from the first imaginary plane, the second plinth first recessed surface comprises a plurality of second plinth protrusions and a plurality of second plinth valleys, each of the second plinth protrusions comprising a respective extremity of the second plinth protrusion, each of the second plinth valleys comprising a respective extremity of the second plinth valley, each of the second plinth valleys recessed relative to at least one of the second plinth protrusions, the second plinth structure first edge is substantially parallel to the second corner piece structure first edge, the second plinth structure first edge and the second plinth structure third edge are each substantially parallel to the second corner piece structure first edge and the second corner piece structure third edge, the second plinth structure second edge and the second plinth structure fourth edge are each substantially parallel to the second corner piece structure second edge and the second corner piece structure fourth edge, each of the at least one second plinth raised surface is substantially co-planar with the first imaginary plane, the extremities of at least some of the second molding piece protrusions are farther from the imaginary first plane than the extremities of at least some of the second plinth protrusions are, and the extremities of at least some of the second molding piece valleys are closer to the first imaginary plane than the extremities of at least some of the second plinth valleys are.

5. The system as recited in claim 4, wherein:

at least a portion of the first plinth structure overlaps a portion of the first molding piece in a dimension aligned with the first direction, at least a portion of the first corner piece overlaps a portion of the first molding piece in a dimension aligned with the first direction, at least a portion of the first corner piece overlaps a portion of the first header piece in a dimension aligned with the second direction, at least a portion of the second corner piece overlaps a portion of the header piece in a dimension aligned with the second direction, at least a portion of the second corner piece overlaps a portion of the second molding piece in a dimension aligned with the first direction, and at least a portion of the second plinth structure overlaps a portion of the second molding piece in a dimension aligned with the first direction.

6. The system as recited in claim 4, wherein:

nothing in the first corner piece or the first molding piece prevents the first molding piece from being freely slid, relative to the first corner piece, in a direction perpendicular to the first corner piece structure first edge, such that at least some regions of the first molding piece protrusions pass at least some regions of the first corner piece protrusions, with the back side of the first molding piece remaining substantially co-planar with the first imaginary plane during an entirety of such sliding movement, and nothing in the first plinth structure or the first molding piece prevents the first molding piece from being freely slid, relative to the first plinth structure, in a direction perpendicular to the first plinth structure first edge, such that at least some regions of the first molding piece protrusions pass at least some regions of the first plinth structure, with the back side of the first molding piece remaining substantially co-planar with the first imaginary plane during such sliding movement, nothing in the first corner piece or the first header piece prevents the first header piece from being freely slid, relative to the first corner piece, in a direction perpendicular to the first corner piece structure first edge, such that at least some regions of the first header piece protrusions pass at least some regions of the first corner piece protrusions, with the back side of the first header piece remaining substantially co-planar with the first imaginary plane during an entirety of such sliding movement, nothing in the second corner piece or the header piece prevents the header piece from being freely slid, relative to the second corner piece, in a direction perpendicular to the second corner piece structure first edge, such that at least some regions of the header piece protrusions pass at least some regions of the second corner piece protrusions, with the back side of the header piece remaining substantially co-planar with the first imaginary plane during an entirety of such sliding movement, nothing in the second corner piece or the second molding piece prevents the second molding piece from being freely slid, relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement, and nothing in the second plinth structure or the second molding piece prevents the second molding piece from being freely slid, relative to the second plinth structure, in a direction perpendicular to the second plinth structure first edge, such that at least some regions of the second molding piece protrusions pass at least some regions of the second plinth structure, with the back side of the second molding piece remaining substantially co-planar with the first imaginary plane during such sliding movement.

7. A kit comprising:

a first corner piece;

a first molding piece; and a first plinth structure, wherein:

the first corner piece comprises a first corner piece structure having at least a first corner piece structure front side, a first corner piece structure rear side, a first corner piece structure first edge, a first corner piece structure second edge, a first corner piece structure third edge and a first corner piece structure fourth edge, the first corner piece structure rear side comprises a plurality of first corner piece raised surfaces and at least a first corner piece first recessed surface, the first corner piece raised surfaces are each substantially flat and are each substantially co-planar with a first imaginary plane, the at least a first corner piece first recessed surface is recessed from the first imaginary plane, the at least a first corner piece first recessed surface comprises a plurality of first corner piece protrusions and a plurality of first corner piece valleys, each of the first corner piece valleys recessed relative to at least one of the first corner piece protrusions, each of the first corner piece protrusions comprising a respective extremity of the first corner piece protrusions, each of the first corner piece valleys comprising a respective extremity of the first corner piece valley, each of the at least a first corner piece first recessed surface is configured such that:

(1) with the first corner piece structure in a first corner piece first position, a first molding piece comprising a plurality of first molding piece protrusions and a plurality of first molding piece valleys, each of the first molding piece protrusions comprising a respective extremity of the first molding piece protrusion, each of the first molding piece protrusions aligned in a first direction, each of the first molding piece valleys comprising a respective extremity of the first molding piece valley, each of the first molding piece valleys aligned in the first direction, the first direction substantially parallel to the first imaginary plane, is capable of being positioned in a first molding piece first position relative to the first corner piece structure such that:

(a) every cross-section of the first molding piece defined along imaginary planes that are each parallel to the first corner piece structure first edge is of substantially a same first molding piece cross-sectional shape;

(b) in the molding piece first position, a back side of the first molding piece is substantially co-planar with the first imaginary plane, and at least some of the extremities of the first molding piece protrusions are farther from the first imaginary plane than the extremities of at least some of the first corner piece protrusions are, and at least some of the extremities of the first molding piece valleys are closer to the first imaginary plane than the extremities of at least some of the first corner piece valleys are;

(c) from the first molding piece first position, the first molding piece is capable of being freely slid, relative to the first corner piece structure, in a direction perpendicular to the first corner piece structure first edge, such that at least some regions of the first molding piece protrusions pass at least some regions of the first corner piece protrusions, with the back side of the first molding piece remaining substantially co-planar with the first imaginary plane during an entirety of such sliding movement, and (2) with the first corner piece in the first corner piece first position, a header piece comprising a plurality of header piece protrusions and a plurality of header piece valleys, each of the header piece protrusions comprising a respective extremity of the header piece protrusion, each of the header piece protrusion aligned in a second direction, each of the header piece valleys comprising a respective extremity of the header piece valley, each of the header piece valleys aligned in the second direction, the second direction substantially parallel to the first imaginary plane and substantially perpendicular to the first direction, is capable of being positioned in a header piece first position relative to the first corner piece structure such that:

(a) every cross-section of the header piece defined along imaginary planes that are each parallel to the first corner piece structure second edge is of substantially a same header piece cross-sectional shape;

(b) in the header piece first position, a back side of the header piece is substantially co-planar with the first imaginary plane, and at least some of the extremities of the header piece protrusions are farther from the imaginary first plane than the extremities of at least some of the corner piece protrusions are, and at least some of the extremities of the header piece valleys are closer to the first imaginary plane than the extremities of at least some of the corner piece valleys are; and (c) from the header piece first position, the header piece is capable of being freely slid, relative to the first corner piece structure, in a direction perpendicular to the first corner piece structure second edge, such that at least some regions of the header piece protrusions pass at least some regions of the first corner piece protrusions, with the back side of the header piece remaining substantially co-planar with the first imaginary plane during an entirety of such sliding movement, the first molding piece comprises a plurality of first molding piece protrusions aligned in a first direction and a plurality of first molding piece valleys aligned in the first direction, the first direction substantially parallel to the first imaginary plane, each of the first molding piece protrusions comprising a respective extremity of the first piece protrusion, each of the first piece valleys comprising a respective extremity of the first molding piece valley, the first corner piece is configured such that with the first corner piece in a first corner piece first position, the first molding piece is capable of being positioned in a first molding piece first position relative to the first corner piece structure such that:

(a) the first molding piece protrusions are aligned in the first direction and the first molding piece valleys are aligned in the first direction, (b) every cross-section of the first molding piece defined along imaginary planes that are each parallel to the corner piece structure first edge is of substantially a same first molding piece cross-sectional shape;

(c) in the first molding piece first position, a back side of the first molding piece is substantially co-planar with the first imaginary plane, and at least some of the extremities of the first molding piece protrusions are farther from the imaginary first plane than the extremities of at least some of the first corner piece protrusions are, and at least some of the extremities of the first molding piece valleys are closer to the first imaginary plane than the extremities of at least some of the first corner piece valleys are; and (d) from the first molding piece first position, the first molding piece is capable of being freely slid, relative to the first corner piece, in a direction perpendicular to the first corner piece structure first edge, such that at least some regions of the first molding piece protrusions pass at least some regions of the first corner piece protrusions, with the back side of the first molding piece remaining substantially co-planar with the first imaginary plane during an entirety of such sliding movement, the first plinth structure has at least a first plinth structure front side, a first plinth structure rear side, a first plinth structure first edge, a first plinth structure second edge, a first plinth structure third edge and a first plinth structure fourth edge, the first plinth structure rear side comprises at least one first plinth raised surface and at least a first plinth first recessed surface, each of the at least one first plinth raised surfaces is substantially flat, the at least a first plinth first recessed surface is recessed from the first imaginary plane, the at least a first plinth first recessed surface comprises a plurality of first plinth protrusions and a plurality of first plinth valleys, each first plinth valley recessed relative to at least one of the first plinth protrusions, each of the first plinth protrusions comprising a respective extremity of the first plinth protrusion, each of the first plinth valleys comprising a respective extremity of the first plinth valley, the first plinth structure is configured such that with the first molding piece in the first molding piece first position, the first plinth structure can be positioned in a first plinth first position such that:

the first plinth structure first edge is substantially parallel to the first corner piece structure first edge, each of the at least one first plinth raised surface is substantially co-planar with the first imaginary plane, the extremities of at least some of the first molding piece protrusions are farther from the imaginary first plane than the extremities of at least some of the first plinth protrusions are, and the extremities of at least some of the first molding piece valleys are closer to the first imaginary plane than the extremities of at least some of the first plinth valleys are, and with the first plinth structure in the first plinth first position and the first molding piece in the first molding piece first position, the first molding piece is capable of being freely slid from the first molding piece first position, in a direction perpendicular to the first plinth structure first edge, such that at least some regions of the first molding piece protrusions pass at least some regions of the first plinth structure, with the back side of the first molding piece remaining substantially co-planar with the first imaginary plane during such sliding movement.

8. The kit as recited in claim 7, wherein:

the kit further comprises packaging, and the first plinth structure, the first molding piece and the corner piece are attached to the packaging.

9. A kit as recited in claim 7, wherein:

the kit further comprises a header piece, a second corner piece, a second molding piece and a second plinth structure, the header piece comprises a plurality of header piece protrusions and a plurality of header piece valleys, each of the header piece protrusions comprising a respective extremity of the header piece protrusion, each of the header piece valleys comprising a respective extremity of the header piece valley, with the first corner piece in the first corner piece first position, the header piece is capable of being positioned in a header piece first position relative to the first corner piece structure such that:

(a) the header piece protrusions are aligned in the second direction and the header piece valleys are aligned in the second direction;

(b) every cross-section of the header piece defined along imaginary planes that are each parallel to the corner piece structure second edge is of substantially a same header piece cross-sectional shape;

(c) in the header piece first position, a back side of the header piece is substantially co-planar with the first imaginary plane, and at least some of the extremities of the header piece protrusions are farther from the imaginary first plane than the extremities of at least some of the first corner piece protrusions are, and at least some of the extremities of the header piece valleys are closer to the first imaginary plane than the extremities of at least some of the first corner piece valleys are; and (d) from the header piece first position, the header piece is capable of being freely slid, relative to the first corner piece, in a direction perpendicular to the first corner piece structure second edge, such that at least some regions of the header piece protrusions pass at least some regions of the first corner piece protrusions, with the back side of the header piece remaining substantially co-planar with the first imaginary plane during an entirety of such sliding movement, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises a plurality of second corner piece protrusions and a plurality of second corner piece valleys, each of the second molding piece protrusions comprising a respective extremity of the second molding piece protrusion, each of the second molding piece valleys comprising a respective extremity of the second molding piece valley, each of the second corner piece valleys recessed relative to at least one of the second corner piece protrusions, the at least one second corner piece comprises a second corner piece first recessed surface, the second corner piece is configured such that with the second molding piece in the second molding piece first position and the second corner piece in the second corner piece first position, the second corner piece is capable of being positioned in a second corner piece first position such that:

(a) the second corner piece first recessed surface is recessed from the first imaginary plane, (b) the second corner piece structure first edge and the second corner piece structure third edge are each substantially parallel to the first corner piece structure first edge and the first corner piece structure third edge, (c) the second corner piece structure second edge and the second corner piece structure fourth edge are each substantially parallel to the first corner piece structure second edge and the first corner piece structure fourth edge, (d) each of the at least one second corner piece raised surface is substantially co-planar with the first imaginary plane, (e) at least some of the extremities of the header piece protrusions are farther from the imaginary first plane than the extremities of at least some of the second corner piece protrusions are, and at least some of the extremities of the header piece valleys are closer to the first imaginary plane than the extremities of at least some of the second corner piece valleys are; and (f) from the header piece first position, the header piece is capable of being freely slid, relative to the second corner piece structure, in a direction perpendicular to the second corner piece structure first edge, such that at least some regions of the header piece protrusions pass at least some regions of the second corner piece protrusions, with the back side of the header piece remaining substantially co-planar with the first imaginary plane during an entirety of such sliding movement, the second molding piece comprises a plurality of second molding piece protrusions and a plurality of second molding piece valleys, each of the second molding piece protrusions comprising a respective extremity of the second molding piece protrusion, each of the second molding piece valleys comprising a respective extremity of the second molding piece valley, the second molding piece is configured such that with the second corner piece in the second corner piece first position, the second molding piece is capable of being positioned in a second molding piece first position such that:

(a) the second molding piece protrusions are aligned in the first direction and the second molding piece valleys are aligned in the first direction;

(b) every cross-section of the second molding piece defined along imaginary planes that are each parallel to the second corner piece structure first edge is of substantially a same second molding piece shape;

(c) in the second molding piece first position, a back side of the second molding piece is substantially co-planar with the first imaginary plane, and at least some of the extremities of the second molding piece protrusions are farther from the imaginary first plane than the extremities of at least some of the second corner piece protrusions are, and at least some of the extremities of the second molding piece valleys are closer to the first imaginary plane than the extremities of at least some of the second corner piece valleys are; and (d) from the second molding piece first position, the second molding piece is capable of being freely slid, relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement, the second plinth structure has at least a second plinth structure front side, a second plinth structure rear side, a second plinth structure first edge, a second plinth structure second edge, a second plinth structure third edge and a second plinth structure fourth edge, the second plinth structure rear side comprises at least one second plinth raised surface and at least one second plinth recessed surface, the at least one second plinth recessed surface comprising a second plinth first recessed surface, each of the at least one second plinth raised surface is substantially flat, the second plinth structure is configured such that with the second corner piece in the second corner piece first position and the second molding piece in the second molding piece first position, the second plinth structure is capable of being positioned in a second plinth first position such that:

(a) the second plinth first recessed surface is recessed from the first imaginary plane, (b) the second plinth first recessed surface comprises a plurality of second plinth protrusions and a plurality of second plinth valleys, each of the second plinth protrusions comprising a respective extremity of the second plinth protrusion, each of the second plinth valleys comprising a respective extremity of the second plinth valley, each second plinth valley recessed relative to at least one of the second plinth protrusion, (c) the second plinth structure first edge is substantially parallel to the second corner piece structure first edge, (d) each of the at least one second plinth raised surface is substantially co-planar with the first imaginary plane, (e) the extremities of at least some of the second molding piece protrusions are farther from the imaginary first plane than the extremities of at least some of the second plinth protrusions are, (f) the extremities of at least some of the second molding piece valleys are closer to the first imaginary plane than the extremities of at least some of the second plinth valleys are, and (g) the second molding piece is capable of being freely slid from the second molding piece first position, in a direction perpendicular to the second plinth structure first edge, such that at least some regions of the second molding piece protrusions pass at least some regions of the second plinth structure, with the back side of the second molding piece remaining substantially co-planar with the first imaginary plane during an entirety of such sliding movement.

10. A kit comprising:

a first corner piece; and a first plinth structure, wherein:

the first corner piece comprises a first corner piece structure having at least a first corner piece structure front side, a first corner piece structure rear side, a first corner piece structure first edge, a first corner piece structure second edge, a first corner piece structure third edge and a first corner piece structure fourth edge, the first corner piece structure rear side comprises a plurality of first corner piece raised surfaces and at least a first corner piece first recessed surface, the first corner piece raised surfaces are each substantially flat and are each substantially co-planar with a first imaginary plane, the at least a first corner piece first recessed surface is recessed from the first imaginary plane, the at least a first corner piece first recessed surface comprises a plurality of first corner piece protrusions and a plurality of first corner piece valleys, each of the first corner piece valleys recessed relative to at least one of the first corner piece protrusions, each of the first corner piece protrusions comprising a respective extremity of the first corner piece protrusions, each of the first corner piece valleys comprising a respective extremity of the first corner piece valley, each of the at least a first corner piece first recessed surface is configured such that:

(1) with the first corner piece structure in a first corner piece first position, a molding piece comprising a plurality of molding piece protrusions and a plurality of molding piece valleys, each of the molding piece protrusions comprising a respective extremity of the molding piece protrusion, each of the molding piece protrusions aligned in a first direction, each of the molding piece valleys comprising a respective extremity of the molding piece valley, each of the molding piece valleys aligned in the first direction, the first direction substantially parallel to the first imaginary plane, is capable of being positioned in a molding piece first position relative to the first corner piece structure such that:

(a) every cross-section of the molding piece defined along imaginary planes that are each parallel to the first corner piece structure first edge is of substantially a same molding piece cross-sectional shape;

(b) in the molding piece first position, a back side of the molding piece is substantially co-planar with the first imaginary plane, and at least some of the extremities of the molding piece protrusions are farther from the first imaginary plane than the extremities of at least some of the corner piece protrusions are, and at least some of the extremities of the molding piece valleys are closer to the first imaginary plane than the extremities of at least some of the first corner piece valleys are;

(c) from the molding piece first position, the molding piece is capable of being freely slid, relative to the corner piece structure, in a direction perpendicular to the first corner piece structure first edge, such that at least some regions of the molding piece protrusions pass at least some regions of the first corner piece protrusions, with the back side of the molding piece remaining substantially co-planar with the first imaginary plane during an entirety of such sliding movement, and (2) with the first corner piece in the first corner piece first position, a header piece comprising a plurality of header piece protrusions and a plurality of header piece valleys, each of the header piece protrusions comprising a respective extremity of the header piece protrusion, each of the header piece protrusion aligned in a second direction, each of the header piece valleys comprising a respective extremity of the header piece valley, each of the header piece valleys aligned in the second direction, the second direction substantially parallel to the first imaginary plane and substantially perpendicular to the first direction, is capable of being positioned in a header piece first position relative to the first corner piece structure such that:

(a) every cross-section of the header piece defined along imaginary planes that are each parallel to the first corner piece structure second edge is of substantially a same header piece cross-sectional shape;

(b) in the header piece first position, a back side of the header piece is substantially co-planar with the first imaginary plane, and at least some of the extremities of the header piece protrusions are farther from the imaginary first plane than the extremities of at least some of the first corner piece protrusions are, and at least some of the extremities of the header piece valleys are closer to the first imaginary plane than the extremities of at least some of the first corner piece valleys are; and (c) from the header piece first position, the header piece is capable of being freely slid, relative to the first corner piece structure, in a direction perpendicular to the first corner piece structure second edge, such that at least some regions of the header piece protrusions pass at least some regions of the first corner piece protrusions, with the back side of the header piece remaining substantially co-planar with the first imaginary plane during an entirety of such sliding movement, the first plinth structure has at least a first plinth structure front side, a first plinth structure rear side, a first plinth structure first edge, a first plinth structure second edge, a first plinth structure third edge and a first plinth structure fourth edge, the first plinth structure rear side comprises at least one first plinth raised surface and at least a first plinth first recessed surface, each of the at least one first plinth raised surface is substantially flat, the at least a first plinth first recessed surface is recessed from the at least one first plinth raised surface, the at least a first plinth first recessed surface comprises a plurality of first plinth protrusions and a plurality of first plinth valleys, each of the first plinth valleys recessed relative to at least one of the first plinth protrusions, each of the first plinth protrusions comprising a respective extremity of the first plinth protrusion, each of the first plinth valleys comprising a respective extremity of the first plinth valley, the first corner piece and the first plinth structure are configured such that they and a molding piece that comprises a plurality of aligned molding piece protrusions and a plurality of aligned molding piece valleys, each of the molding piece protrusions comprising a respective extremity of the molding piece protrusion, each of the molding piece valleys comprising a respective extremity of the molding piece valley, can be positioned relative to each other, such that:

(a) the molding piece protrusions and the molding piece valleys are aligned in the first direction, (b) every cross-section of the molding piece defined along imaginary planes that are each parallel to the first corner piece structure first edge is of substantially a same molding piece cross-sectional shape, (c) a back side of the molding piece is substantially co-planar with the first imaginary plane, and at least some of the extremities of the molding piece protrusions are farther from the imaginary first plane than the extremities of at least some of the first corner piece protrusions are, and at least some of the extremities of the molding piece valleys are closer to the first imaginary plane than the extremities of at least some of the first corner piece valleys are, (d) the molding piece is capable of being freely slid, relative to the first corner piece, in a direction perpendicular to the first corner piece structure first edge, such that at least some regions of the molding piece protrusions pass at least some regions of the first corner piece protrusions, with the back side of the molding piece remaining substantially co-planar with the first imaginary plane during an entirety of such sliding movement, (e) the first plinth structure first edge is substantially parallel to the first corner piece structure first edge, (f) each of the at least one first plinth raised surfaces is substantially co-planar with the first imaginary plane, (g) the extremities of at least some of the molding piece protrusions are farther from the imaginary first plane than the extremities of at least some of the first plinth protrusions are, (h) the extremities of at least some of the molding piece valleys are closer to the first imaginary plane than the extremities of at least some of the first plinth valleys are, and (i) the molding piece is capable of being freely slid from the molding piece first position, in a direction perpendicular to the first plinth structure first edge, such that at least some regions of the molding piece protrusions pass at least some regions of the first plinth structure, with the back side of the molding piece remaining substantially co-planar with the first imaginary plane during such sliding movement.

11. The kit as recited in claim 10, wherein:

the kit further comprises packaging, and the first plinth structure and the first corner piece are attached to the packaging.

12. A kit as recited in claim 10, wherein:

the kit further comprises a second corner piece structure, and a second plinth structure, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises a plurality of second corner piece protrusions and a plurality of second corner piece valleys, each of the second corner piece valleys recessed relative to at least one of the second corner piece protrusions, the second plinth structure has at least a second plinth structure front side, a second plinth structure rear side, a second plinth structure first edge, a second plinth structure second edge, a second plinth structure third edge and a second plinth structure fourth edge, the second plinth structure rear side comprises at least one second plinth raised surface and at least one second plinth recessed surface, the at least one second plinth recessed surface comprising a second plinth first recessed surface, each of the at least one second plinth raised surface is substantially flat, the first corner piece structure and the second corner piece structure are configured such that they and a header piece that comprises a plurality of aligned header piece protrusions and a plurality of aligned header piece valleys, each of the header piece protrusions comprising a respective extremity of the header piece protrusion, each of the header piece valleys comprising a respective extremity of the header piece valley, can be positioned relative to each other, such that:

(a) each of the header piece protrusions are aligned in the second direction and each of the header piece valleys are aligned in the second direction, (b) every cross-section of the header piece defined along imaginary planes that are each parallel to the corner piece structure second edge is of substantially a same header piece cross-sectional shape, (c) a back side of the header piece is substantially co-planar with the first imaginary plane, and at least some of the extremities of the header piece protrusions are farther from the imaginary first plane than the extremities of at least some of the corner piece protrusions are, and at least some of the extremities of the header piece valleys are closer to the first imaginary plane than the extremities of at least some of the corner piece valleys are, (d) from the header piece first position, the header piece is capable of being freely slid, relative to the second corner piece structure, in a direction perpendicular to the second corner piece structure second edge, such that at least some regions of the header piece protrusions pass at least some regions of the second corner piece protrusions, with the back side of the header piece remaining substantially co-planar with the first imaginary plane during an entirety of such sliding movement, (e) the second corner piece first recessed surface is recessed from the first imaginary plane, (f) the second corner piece structure first edge and the second corner piece structure third edge are each substantially parallel to the first corner piece structure first edge and the first corner piece structure third edge, (g) the second corner piece structure second edge and the second corner piece structure fourth edge are each substantially parallel to the first corner piece structure second edge and the first corner piece structure fourth edge, (h) each of the at least one second corner piece raised surface is substantially co-planar with the first imaginary plane, (i) at least some of the extremities of the header piece protrusions are farther from the imaginary first plane than the extremities of at least some of the second corner piece protrusions are, and at least some of the extremities of the header piece valleys are closer to the first imaginary plane than the extremities of at least some of the second corner piece valleys are, and (j) the header piece is capable of being freely slid, relative to the second corner piece structure, in a direction perpendicular to the second corner piece structure first edge, such that at least some regions of the header piece protrusions pass at least some regions of the second corner piece protrusions, with the back side of the header piece remaining substantially co-planar with the first imaginary plane during an entirety of such sliding movement.

13. The kit as recited in claim 12, wherein:

the kit further comprises packaging, and the first plinth structure, the first corner piece, the second corner piece and the second plinth structure are attached to the packaging.

14. A kit comprising:

a first corner piece; and a first plinth structure, wherein:

the first corner piece comprises a first corner piece structure having at least a first corner piece structure front side, a first corner piece structure rear side, a first corner piece structure first edge, a first corner piece structure second edge, a first corner piece structure third edge and a first corner piece structure fourth edge, the first corner piece structure rear side comprises a plurality of first corner piece raised surfaces and at least a first corner piece first recessed surface, the first corner piece raised surfaces are each substantially flat and are each substantially co-planar with a first imaginary plane, the at least a first corner piece first recessed surface is recessed from the first imaginary plane, the at least a first corner piece first recessed surface comprises a plurality of first corner piece protrusions and a plurality of first corner piece valleys, each of the first corner piece valleys recessed relative to at least one of the first corner piece protrusions, each of the first corner piece protrusions comprising a respective extremity of the first corner piece protrusions, each of the first corner piece valleys comprising a respective extremity of the first corner piece valley, each of the at least a first corner piece first recessed surface is configured such that:

(1) with the first corner piece structure in a first corner piece first position, a first molding piece comprising a plurality of first molding piece protrusions and a plurality of first molding piece valleys, each of the first molding piece protrusions comprising a respective extremity of the first molding piece protrusion, each of the first molding piece protrusions aligned in a first direction, each of the first molding piece valleys comprising a respective extremity of the first molding piece valley, each of the first molding piece valleys aligned in the first direction, the first direction substantially parallel to the first imaginary plane, is capable of being positioned in a first molding piece first position relative to the first corner piece structure such that:

(a) every cross-section of the first molding piece defined along imaginary planes that are each parallel to the first corner piece structure first edge is of substantially a same first molding piece cross-sectional shape;

(b) in the first molding piece first position, a back side of the first molding piece is substantially co-planar with the first imaginary plane, and at least some of the extremities of the first molding piece protrusions are farther from the first imaginary plane than the extremities of at least some of the first corner piece protrusions are, and at least some of the extremities of the first molding piece valleys are closer to the first imaginary plane than the extremities of at least some of the first corner piece valleys are;

(c) from the first molding piece first position, the first molding piece is capable of being freely slid, relative to the first corner piece structure, in a direction perpendicular to the first corner piece structure first edge, such that at least some regions of the first molding piece protrusions pass at least some regions of the first corner piece protrusions, with the back side of the first molding piece remaining substantially co-planar with the first imaginary plane during an entirety of such sliding movement, and (2) with the first corner piece in the first corner piece first position, a header piece comprising a plurality of header piece protrusions and a plurality of header piece valleys, each of the header piece protrusions comprising a respective extremity of the header piece protrusion, each of the header piece protrusion aligned in a second direction, each of the header piece valleys comprising a respective extremity of the header piece valley, each of the header piece valleys aligned in the second direction, the second direction substantially parallel to the first imaginary plane and substantially perpendicular to the first direction, is capable of being positioned in a header piece first position relative to the first corner piece structure such that:

(a) every cross-section of the header piece defined along imaginary planes that are each parallel to the first corner piece structure second edge is of substantially a same header piece cross-sectional shape;

(b) in the header piece first position, a back side of the header piece is substantially co-planar with the first imaginary plane, and at least some of the extremities of the header piece protrusions are farther from the imaginary first plane than the extremities of at least some of the first corner piece protrusions are, and at least some of the extremities of the header piece valleys are closer to the first imaginary plane than the extremities of at least some of the first corner piece valleys are; and (c) from the header piece first position, the header piece is capable of being freely slid, relative to the first corner piece structure, in a direction perpendicular to the first corner piece structure second edge, such that at least some regions of the header piece protrusions pass at least some regions of the first corner piece protrusions, with the back side of the header piece remaining substantially co-planar with the first imaginary plane during an entirety of such sliding movement, the first molding piece comprises a plurality of first molding piece protrusions and a plurality of first molding piece valleys, the first corner piece is configured such that with the first corner piece in the first corner piece first position, the first molding piece is capable of being positioned in a first molding position relative to the first corner piece structure such that:

(a) the first molding piece protrusions are aligned in the first direction and the first molding piece valleys are aligned in the first direction;

(b) every cross-section of the first molding piece defined along imaginary planes that are each parallel to the first corner piece structure first edge is of substantially a same first molding piece cross-sectional shape;

(c) in the first molding piece first position, a back side of the first molding piece is substantially co-planar with the first imaginary plane, and at least some of the extremities of the first molding piece protrusions are farther from the imaginary first plane than the extremities of at least some of the first corner piece protrusions are, and at least some of the extremities of the first molding piece valleys are closer to the first imaginary plane than the extremities of at least some of the first corner piece valleys are; and (d) from the first molding piece first position, the first molding piece is capable of being freely slid, relative to the first corner piece structure, in a direction perpendicular to the first corner piece structure first edge, such that at least some regions of the first molding piece protrusions pass at least some regions of the first corner piece protrusions, with the back side of the first molding piece remaining substantially co-planar with the first imaginary plane during an entirety of such sliding movement.

15. A kit as recited in claim 14, wherein:

the kit further comprises a header piece, a second corner piece, and a second molding piece, the header piece comprises a plurality of header piece protrusions and a plurality of header piece valleys, each of the header piece protrusions comprising a respective extremity of the header piece protrusion, each of the header piece valleys comprising a respective extremity of the header piece valley, with the first corner piece in the first corner piece first position, the header piece is capable of being positioned in a header piece first position relative to the first corner piece structure such that:

(a) the header piece protrusions are aligned in the second direction and the header piece valleys are aligned in the second direction;

(b) every cross-section of the header piece defined along imaginary planes that are each parallel to the first corner piece structure second edge is of substantially a same header piece shape;

(c) in the header piece first position, a back side of the header piece is substantially co-planar with the first imaginary plane, and at least some of the extremities of the header piece protrusions are farther from the imaginary first plane than the extremities of at least some of the first corner piece protrusions are, and at least some of the extremities of the header piece valleys are closer to the first imaginary plane than the extremities of at least some of the first corner piece valleys are; and (d) from the header piece first position, the header piece is capable of being freely slid, relative to the first corner piece, in a direction perpendicular to the first corner piece structure second edge, such that at least some regions of the header piece protrusions pass at least some regions of the first corner piece protrusions, with the back side of the header piece remaining substantially co-planar with the first imaginary plane during an entirety of such sliding movement, the second corner piece structure has at least a second corner piece structure front side, a second corner piece structure rear side, a second corner piece structure first edge, a second corner piece structure second edge, a second corner piece structure third edge and a second corner piece structure fourth edge, the second corner piece structure rear side comprises at least one second corner piece raised surface and at least one second corner piece recessed surface, each of the at least one second corner piece raised surface is substantially flat, the at least one second corner piece recessed surface comprises a plurality of second corner piece protrusions and a plurality of second corner piece valleys, each of the second corner piece protrusions comprising a respective extremity of the second corner piece protrusion, each of the second corner piece valleys comprising a respective extremity of the second corner piece valley, each of the second corner piece valleys recessed relative to at least one of the second corner piece protrusions, the at least one second corner piece comprises a second corner piece first recessed surface, the second corner piece is configured such that with the molding piece in the molding piece first position and the first corner piece in the first corner piece first position, the second corner piece is capable of being positioned in a second corner piece first position such that:

(a) the second corner piece first recessed surface is recessed from the first imaginary plane, (b) the second corner piece structure first edge and the second corner piece structure third edge are each substantially parallel to the first corner piece structure first edge and the first corner piece structure third edge, (c) the second corner piece structure second edge and the second corner piece structure fourth edge are each substantially parallel to the first corner piece structure second edge and the first corner piece structure fourth edge, (d) each of the at least one second corner piece raised surface is substantially co-planar with the first imaginary plane, (e) at least some of the extremities of the header piece protrusions are farther from the imaginary first plane than the extremities of at least some of the second corner piece protrusions are, and at least some of the extremities of the header piece valleys are closer to the first imaginary plane than the extremities of at least some of the second corner piece valleys are, and (f) from the molding piece first position, the molding piece is capable of being freely slid, relative to the second corner piece structure, in a direction perpendicular to the second corner piece structure first edge, such that at least some regions of the molding piece protrusions pass at least some regions of the second corner piece protrusions, with the back side of the molding piece remaining substantially co-planar with the first imaginary plane during an entirety of such sliding movement, the second molding piece comprises a plurality of second molding piece protrusions and a plurality of second molding piece valleys, each of the second molding piece protrusions comprising a respective extremity of the second molding piece protrusion, each of the second molding piece valleys comprising a respective extremity of the second molding piece valley, the second molding piece is configured such that with the second corner piece in the second corner piece first position, the second molding piece is capable of being positioned in a second molding piece first position such that:

(a) the second molding piece protrusions are aligned in the first direction and the molding piece valleys are aligned in the first direction;

(b) every cross-section of the second molding piece defined along imaginary planes that are each parallel to the second corner piece structure first edge is of substantially a same second molding piece cross-sectional shape;

(c) in the second molding piece first position, a back side of the molding piece is substantially co-planar with the first imaginary plane, and at least some of the extremities of the second molding piece protrusions are farther from the imaginary first plane than the extremities of at least some of the second corner piece protrusions are, and at least some of the extremities of the second molding piece valleys are closer to the first imaginary plane than the extremities of at least some of the second corner piece valleys are; and (d) from the second molding piece first position, the second molding piece is capable of being freely slid, relative to the second corner piece, in a direction perpendicular to the second corner piece structure first edge, such that at least some regions of the second molding piece protrusions pass at least some regions of the second corner piece protrusions, with the back side of the second molding piece remaining substantially co-planar with the first imaginary plane during an entirety of such sliding movement.

16. A kit comprising:

a plinth; and a molding piece, wherein:

the plinth comprises a plinth structure having at least a plinth structure front side, a plinth structure rear side, a plinth structure first edge, a plinth structure second edge, a plinth structure third edge and a plinth structure fourth edge, the plinth structure rear side comprises at least one plinth raised surfaces and at least a first plinth recessed surface, each of the at least one plinth raised surface is substantially flat and is substantially in a first imaginary plane, the at least a first plinth recessed surface is recessed from the first imaginary plane, the at least a first plinth recessed surface comprises a plurality of plinth protrusions and a plurality of plinth valleys, each of the plinth protrusions comprising a respective extremity of the plinth protrusion, each of the plinth valleys comprising a respective extremity of the plinth valley, each plinth of the valleys recessed relative to at least one of the plinth protrusions, the first plinth recessed surface configured such that with the plinth structure in a plinth first position, a molding piece comprising a plurality of molding piece protrusions aligned in a first direction and a plurality of molding piece valleys aligned in the first direction, each of the molding piece protrusions comprising a respective extremity of the molding piece protrusion, each of the molding piece valleys comprising a respective extremity of the molding piece valley, the first direction substantially parallel to the first imaginary plane, is capable of being positioned in a molding piece first position relative to the plinth structure such that:

(a) every cross-section of the molding piece defined along imaginary planes that are each parallel to the plinth structure first edge is of substantially a same molding piece cross-sectional shape;

(b) in the molding piece first position, a back side of the molding piece is substantially co-planar with the first imaginary plane, and extremities of at least some of the molding piece protrusions are farther from the imaginary first plane than extremities of at least some of the plinth protrusions are, and the extremities of at least some of the molding piece valleys are closer to the first imaginary plane than extremities of at least some adjacent of the plinth valleys are; and (c) from the molding piece first position, the molding piece is capable of being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement, the molding piece comprises a plurality of molding piece protrusions aligned in a first direction and a plurality of molding piece valleys aligned in the first direction, each of the molding piece protrusions comprising a respective extremity of the molding piece protrusion, each of the molding piece valleys comprising a respective extremity of the molding piece valley, the first direction substantially parallel to the first imaginary plane, with the plinth structure in a first plinth position, the molding piece is capable of being positioned in a molding piece first position relative to the plinth structure such that:

(a) every cross-section of the molding piece defined along imaginary planes that are each parallel to the plinth structure first edge is of substantially a same molding piece cross-sectional shape;

(b) in the molding piece first position, a back side of the molding piece is substantially co-planar with the first imaginary plane, and the extremities of at least some of the molding piece protrusions are farther from the imaginary first plane than the extremities of at least some of the plinth protrusions are, and the extremities of at least some of the molding piece valleys are closer to the first imaginary plane than the extremities of at least some of the plinth valleys are; and (c) from the molding piece first position, the molding piece is capable of being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement.

17. The kit as recited in claim 16, wherein:

the kit further comprises packaging, and the plinth and the molding piece are attached to the packaging.

18. A corner piece, comprising:

a corner piece structure having at least a corner piece structure front side, a corner piece structure rear side, a corner piece structure first edge, a corner piece structure second edge, a corner piece structure third edge and a corner piece structure fourth edge, the corner piece structure rear side comprising a plurality of corner piece raised surfaces and at least a first corner piece recessed surface, the corner piece raised surfaces are each substantially flat and are each substantially co-planar with a first imaginary plane, the at least a first corner piece recessed surface is recessed from the first imaginary plane, the at least a first corner piece recessed surface comprising a plurality of corner piece protrusions and a plurality of corner piece valleys, each of the corner piece valleys recessed relative to at least one of the corner piece, protrusions, each of the corner piece protrusions comprising a respective extremity of the corner piece protrusion, each of the corner piece valleys comprising a respective extremity of the corner piece valley, each of the at least a first corner piece recessed surface configured such that:

(1) with the corner piece structure in a corner piece first position, a molding piece comprising a plurality of molding piece protrusions and a plurality of molding piece valleys, each of the molding piece protrusions comprising a respective extremity of the molding piece protrusion, each of the molding piece protrusions aligned in a first direction, each of the molding piece valleys comprising a respective extremity of the molding piece valley, each of the molding piece valleys aligned in the first direction, the first direction substantially parallel to the first imaginary plane, is capable of being positioned in a molding piece first position relative to the corner piece structure such that:

(a) every cross-section of the molding piece defined along imaginary planes that are each parallel to the corner piece structure first edge is of substantially a same molding piece cross-sectional shape;

(b) in the molding piece first position, a back side of the molding piece is substantially co-planar with the first imaginary plane, and at least some of the extremities of the molding piece protrusions are farther from the first imaginary plane than the extremities of at least some of the corner piece protrusions are, and at least some of the extremities of the molding piece valleys are closer to the first imaginary plane than the extremities of at least some of the corner piece valleys are;

(c) from the molding piece first position, the molding piece is capable of being freely slid, relative to the corner piece structure, in a direction perpendicular to the corner piece structure first edge, such that at least some regions of the molding piece protrusions pass at least some regions of the corner piece protrusions, with the back side of the molding piece remaining substantially co-planar with the first imaginary plane during an entirety of such sliding movement, and (2) with the corner piece in the corner piece first position, a header piece comprising a plurality of header piece protrusions and a plurality of header piece valleys, each of the header piece protrusions comprising a respective extremity of the header piece protrusion, each of the header piece protrusion aligned in a second direction, each of the header piece valleys comprising a respective extremity of the header piece valley, each of the header piece valleys aligned in the second direction, the second direction substantially parallel to the first imaginary plane and substantially perpendicular to the first direction, is capable of being positioned in a header piece first position relative to the corner piece structure such that:

(a) every cross-section of the header piece defined along imaginary planes that are each parallel to the corner piece structure second edge is of substantially a same header piece cross-sectional shape;

(b) in the header piece first position, a back side of the header piece is substantially co-planar with the first imaginary plane, and at least some of the extremities of the header piece protrusions are farther from the imaginary first plane than the extremities of at least some of the corner piece protrusions are, and at least some of the extremities of the header piece valleys are closer to the first imaginary plane than the extremities of at least some of the corner piece valleys are; and (c) from the header piece first position, the header piece is capable of being freely slid, relative to the corner piece structure, in a direction perpendicular to the corner piece structure second edge, such that at least some regions of the header piece protrusions pass at least some regions of the corner piece protrusions, with the back side of the header piece remaining substantially co-planar with the first imaginary plane during an entirety of such sliding movement.

19. The corner piece as recited in claim 18, wherein:

the corner piece further comprises a corner piece cover piece, the corner piece cover piece is removably engaged with the corner piece structure, and the corner piece cover piece covers at least a portion of the corner piece structure front side.

20. A plinth, comprising:

a plinth structure having at least a plinth structure front side, a plinth structure rear side, a plinth structure first edge, a plinth structure second edge, a plinth structure third edge and a plinth structure fourth edge, the plinth structure rear side comprising at least one plinth raised surface and at least a first plinth recessed surface, each of the at least one plinth raised surface is substantially flat and is substantially in a first imaginary plane, the at least a first plinth recessed surface is recessed from the first imaginary plane, the at least a first plinth recessed surface comprising a plurality of plinth protrusions and a plurality of plinth valleys, each of the plinth protrusions comprising a respective extremity of the plinth protrusions, each of the plinth valleys comprising a respective extremity of the plinth valley, each of the plinth valleys recessed relative to at least one of the plinth protrusions, the first plinth recessed surface configured such that with the plinth structure in a plinth first position, a molding piece comprising a plurality of molding piece protrusions aligned in a first direction and a plurality of molding piece valleys aligned in the first direction, each of the molding piece protrusions comprising a respective extremity of the molding piece protrusion, each of the molding piece valleys comprising a respective extremity of the molding piece valley, the first direction substantially parallel to the first imaginary plane, is capable of being positioned in a molding piece first position relative to the plinth structure such that:

(a) every cross-section of the molding piece defined along imaginary planes that are each parallel to the plinth structure first edge is of substantially a same molding piece cross-sectional shape;

(b) in the molding piece first position, a back side of the molding piece is substantially co-planar with the first imaginary plane, and the extremities of at least some of the molding piece protrusions are farther from the imaginary first plane than the extremities of at least some of the plinth protrusions are, and the extremities of at least some of the molding piece valleys are closer to the first imaginary plane than the extremities of at least some of the plinth valleys are; and (c) from the molding piece first position, the molding piece is capable of being freely slid, relative to the plinth structure, in a direction perpendicular to the plinth structure first edge, such that at least some regions of the molding piece protrusions pass at least some regions of the plinth protrusions, with the back side of the molding piece remaining substantially co-planar with the first imaginary plane during an entirety of such sliding movement.

21. The plinth as recited in claim 20, wherein:

the plinth further comprises a plinth cover piece, the plinth cover piece is removably engaged with the plinth structure, and the plinth cover piece covers at least a portion of the plinth structure front side.

* * * * *